US010503102B2

(12) United States Patent
Tomita

(10) Patent No.: US 10,503,102 B2
(45) Date of Patent: Dec. 10, 2019

(54) DRIVE TRANSMITTING DEVICE AND IMAGE FORMING APPARATUS INCORPORATING THE DRIVE TRANSMITTING DEVICE

(71) Applicant: Kenji Tomita, Tokyo (JP)

(72) Inventor: Kenji Tomita, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/242,121

(22) Filed: Jan. 8, 2019

(65) Prior Publication Data

US 2019/0250540 A1 Aug. 15, 2019

(30) Foreign Application Priority Data

Feb. 14, 2018 (JP) ..... 2018-023755

(51) Int. Cl.

| | |
|---|---|
| ***G03G 15/20*** | (2006.01) |
| ***B65H 5/06*** | (2006.01) |
| ***G03G 21/16*** | (2006.01) |
| ***G03G 15/00*** | (2006.01) |

(52) U.S. Cl.

CPC ..... *G03G 15/2017* (2013.01); *B65H 5/062* (2013.01); *G03G 15/2064* (2013.01); *G03G 15/6573* (2013.01); *G03G 21/1647* (2013.01); *B65H 2403/42* (2013.01); *B65H 2403/481* (2013.01); *B65H 2403/732* (2013.01)

(58) Field of Classification Search

CPC ..... G03G 15/2017; G03G 15/2032; G03G 15/2064; G03G 15/6573; G03G 21/1647; G03G 21/1857; G03G 21/186; G03G 2221/1657; B65H 5/062; B65H 2403/42; B65H 2403/481; B65H 2403/732; F16D 1/06

See application file for complete search history.

(56) References Cited

U.S. PATENT DOCUMENTS

| | | | | |
|---|---|---|---|---|
| 9,880,508 | B2 * | 1/2018 | Tomita | |
| 2013/0272753 | A1 * | 10/2013 | Fukasawa | 399/279 |
| 2017/0343937 | A1 * | 11/2017 | Tomita | |
| 2019/0018353 | A1 * | 1/2019 | Tomita | G03G 15/2064 |

FOREIGN PATENT DOCUMENTS

| | | |
|---|---|---|
| JP | 2006-335485 | 12/2006 |
| JP | 2010-128132 | 6/2010 |
| JP | 2012-229723 | 11/2012 |
| JP | 2016-131437 | 7/2016 |

* cited by examiner

*Primary Examiner* — Sophia S Chen

(74) *Attorney, Agent, or Firm* — Harness, Dickey & Pierce, P.L.C.

(57) ABSTRACT

A drive transmitting device, which is included in an image forming apparatus, includes a drive source, a drive transmitting body, and a rotary shaft. The drive transmitting body has a press-in target portion. The rotary shaft includes a press-in portion mounted on one end of the rotary shaft in an axial direction of the rotary shaft to be pressed into the press-in target portion of the drive transmitting body. The press-in portion includes a flat face and a plurality of circular arc faces having different distances from an axial center of the rotary shaft and being disposed at a same position as at least a portion of the flat face in the axial direction of the rotary shaft. A radius of curvature of one of the plurality of circular arc faces is greater than a radius of curvature of another of the plurality of circular arc faces.

18 Claims, 32 Drawing Sheets

COMPARATIVE ART

COMPARATIVE ART

COMPARATIVE ART

T<R

ROTATED BY ANGLE OF 180 DEGREES

T<R

T>R

ROTATED BY ANGLE OF 180 DEGREES

DRIVE TRANSMITTING DEVICE AND IMAGE FORMING APPARATUS INCORPORATING THE DRIVE TRANSMITTING DEVICE

CROSS-REFERENCE TO RELATED APPLICATION

This patent application is based on and claims priority pursuant to 35 U.S.C. § 119(a) to Japanese Patent Application No. 2018-023755, filed on Feb. 14, 2018, in the Japan Patent Office, the entire disclosure of which is hereby incorporated by reference herein.

BACKGROUND

Technical Field

This disclosure relates to a drive transmitting device and an image forming apparatus incorporating the drive transmitting device.

Related Art

Various known drive transmitting devices include a drive transmitting member to transmit a driving force from a drive source, and a rotary shaft having a flat face parallel to the axial direction of the rotary shaft and having a press-in portion that is mounted on one end in the axial direction of the rotary shaft to be pressed in a press-in target portion of the drive transmitting member.

A known drive transmitting device includes a press-in portion having a polygonal cross sectional shape mounted on one end in the axial direction of a rotary shaft, so that the press-in portion is pressed into a press-in target portion of a gear that functions as a drive transmitting member.

However, the known drive transmitting device has poor assembly of the drive transmitting member such as a gear or gears to the rotary shaft.

SUMMARY

At least one aspect of this disclosure provides a drive transmitting device including a drive source, a drive transmitting body, and a rotary shaft. The drive source applies a driving force. The drive transmitting body has a press-in target portion and receives the driving force from the drive source. The rotary shaft includes a press-in portion mounted on one end of the rotary shaft in an axial direction of the rotary shaft to be pressed into the press-in target portion of the drive transmitting body. The press-in portion includes a flat face and a plurality of circular arc faces. The flat face extends parallel to the axial direction of the rotary shaft. The plurality of circular arc faces is disposed parallel to the axial direction of the rotary shaft, has distances different from each other from an axial center of the rotary shaft, and extends parallel to the axial direction of the rotary shaft. Each of the plurality of circular arc faces is disposed at a same position in the axial direction of the rotary shaft as at least a portion of the flat face in the axial direction of the rotary shaft. The plurality of circular arc faces includes a first circular arc face and a second circular arc face. The first circular arc face is on an upstream side of the second circular arc face in an attaching direction of the drive transmitting body and having a radius of curvature. The second circular arc face is on a downstream side of the first circular arc face in the attaching direction of the drive transmitting body and having a radius of curvature. The radius of curvature of the second circular arc face is greater than the radius of curvature of the first circular arc face.

Further, at least one aspect of this disclosure provides an image forming apparatus including the above-described drive transmitting device.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1:
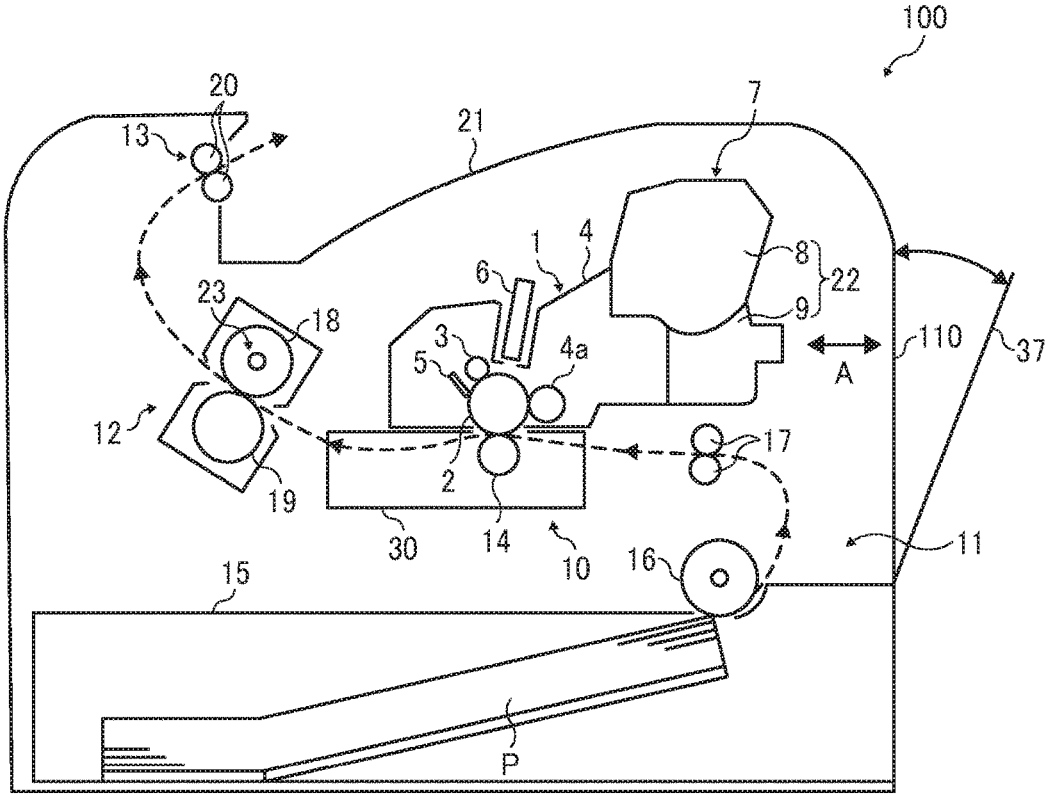
FIG. 1 is a schematic diagram illustrating an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Now, a description is given of an electrophotographic printer that functions as an electrophotographic image forming apparatus for forming images by electrophotography.

It is to be noted that elements (for example, mechanical parts and components) having the same functions and shapes are denoted by the same reference numerals throughout the specification and redundant descriptions are omitted.

FIG. 1 is a schematic diagram illustrating an image forming apparatus 100 according to an embodiment of this disclosure.

The image forming apparatus 100 may be a copier, a facsimile machine, a printer, a multifunction peripheral or a multifunction printer (MFP) having at least one of copying, printing, scanning, facsimile, and plotter functions, or the like. According to the present example, the image forming apparatus 100 is an electrophotographic printer that prints toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

In FIG. 1, the image forming apparatus 100 according to the present embodiment of this disclosure is a monochrome printer. The image forming apparatus 100 includes an apparatus body 110 and a process cartridge 1 that functions as a detachably attachable unit and is disposed detachably attached to the apparatus body 110.

The process cartridge 1 includes a photoconductor 2, a charging roller 3, a developing device 4, and a cleaning blade 5. The photoconductor 2 functions as an image bearer to bear an image on a surface thereof. The charging roller 3 functions as a charging device to uniformly charge the surface of the photoconductor 2. The developing device 4 develops an electrostatic latent image formed on the surface of the photoconductor 2 into a visible image. The developing device 4 includes a developing roller 4*a* and supplies toner by the developing roller 4*a* onto the electrostatic latent image formed on the surface of the photoconductor 2, so that the electrostatic latent image is developed (visualized) into a visible image as a toner image. The cleaning blade 5 functions as a cleaning device to clean the surface of the photoconductor 2. The image forming apparatus 100 further includes an LED (light emitting diode) head array 6 disposed near the photoconductor 2. The LED head array 6 functions as an exposing device to expose the surface of the photoconductor 2.

The process cartridge 1 includes a toner cartridge 7 that functions as a developer container. The toner cartridge 7 is detachably attached to the process cartridge 1. The toner cartridge 7 includes a container body 22 in which a developer storing section 8 and a developer collecting section 9 are provided as a single unit. The developer storing section 8 accommodates toner that functions as developer to be supplied to the developing device 4. The developer collecting section 9 collects toner (used toner or waste toner) that has been removed by the cleaning blade 5.

The image forming apparatus 100 further includes a transfer device 10, a sheet feeding device 11, a fixing device 12, and a sheet ejection device 13. The transfer device 10 transfers the image formed on the surface of the photoconductor 2 onto a sheet P such as a transfer medium. The sheet feeding device 11 supplies and feeds the sheet P toward the transfer device 10. The fixing device 12 fixes the image transferred onto the sheet P to the sheet P. The sheet ejection device 13 ejects the sheet P outside the apparatus body 110 of the image forming apparatus 100.

The transfer device 10 includes a transfer roller 14. The transfer roller 14 functions as a transfer body rotatably supported by a transfer frame 30. The transfer roller 14 is in contact with the photoconductor 2 in a state in which the process cartridge 1 is attached to the apparatus body 110 of the image forming apparatus 100. A transfer nip region is formed at a contact portion at which the photoconductor 2 and the transfer roller 14 contact to each other. In addition, the transfer roller 14 is connected to a power source, and a predetermined direct current (DC) voltage and/or an alternating current (AC) voltage are supplied to the transfer roller 14.

The sheet feeding device 11 includes a sheet feed tray 15 and a sheet feed roller 16. The sheet feed tray 15 contains the sheet P. The sheet feed roller 16 feeds the sheet P contained in the sheet feed tray 15. Further, a pair of registration rollers 17 is disposed downstream from the sheet feed roller 16 in a sheet conveying direction. The pair of registration rollers 17 functions as a pair of timing rollers to convey the sheet P to the transfer nip region at a proper timing of conveyance of the sheet P. It is to be noted that the sheet P is not limited to the above-described transfer medium but also includes thick paper, post card, envelope, plain paper, thin paper, coated paper, art paper, tracing paper, and the like. The sheet P further includes a non-paper material such as OHP sheet, OHP film, and any other sheet-shaped material on which an image can be formed.

The fixing device 12 includes a fixing roller 18 and a pressure roller 19. The fixing roller 18 is heated by an infrared heater 23 that is disposed inside the fixing roller 18. The pressure roller 19 is pressed toward the fixing roller 18 to contact the fixing roller 18. A fixing nip region is formed at a position where the fixing roller 18 and the pressure roller 19 contact with each other.

The sheet ejection device 13 includes a pair of sheet ejecting rollers 20. After having been ejected to the outside of the apparatus body 110 of the image forming apparatus 100 by the pair of sheet ejecting rollers 20, the sheet P is loaded on a sheet ejection tray 21 that has a concaved shape or a downwardly curved shape on an upper face of the apparatus body 110 of the image forming apparatus 100.

Next, a description is given of basic functions of the image forming apparatus 100 according to the present embodiment of this disclosure, with reference to FIG. 1.

When an image forming operation is started, the photoconductor 2 of the process cartridge 1 is rotated in a clockwise direction in FIG. 1, and the charging roller 3 uniformly charges the surface of the photoconductor 2 with a predetermined polarity. The LED head array 6 emits a light beam onto the charged face of the photoconductor 2 based on image data input from an external device, so that an electrostatic latent image is formed on the surface of the photoconductor 2.

The developing device 4 supplies toner onto the electrostatic latent image formed on the photoconductor 2, thereby developing (visualizing) the electrostatic latent image into a visible image as a toner image.

Further, as the image forming operation is started, the transfer roller 14 is rotated and a predetermined direct current (DC) and/or the alternating current (AC) are supplied to the transfer roller 14. As a result, a transfer electric field is formed between the transfer roller 14 and the opposing photoconductor 2.

By contrast, the sheet feed roller 16 that is disposed in a lower portion of the apparatus body 110 of the image forming apparatus 100 is driven and rotated to feed the sheet P from the sheet feed tray 15. Conveyance of the sheet P fed from the sheet feed tray 15 is temporarily interrupted by the pair of registration rollers 17.

Thereafter, at the predetermined timing, the pair of registration rollers 17 starts the rotation again. Then, in synchronization with movement of the toner image formed on the surface of the photoconductor 2 reaching the transfer nip region, the sheet P is conveyed to the transfer nip region. Due to the transfer electric field, the toner image formed on the surface of the photoconductor 2 is collectively transferred onto the sheet P. After transfer of the toner image from the photoconductor 2 onto the sheet P, residual toner that has failed to be transferred onto the sheet P remains on the surface of the photoconductor 2. Therefore, the cleaning blade 5 removes the residual tone from the surface of the photoconductor 2. The removed toner is conveyed and collected into the developer collecting section 9 of the container body 22.

Thereafter, the sheet P having the toner image thereon is conveyed to the fixing device 12, where the toner image is fixed to the sheet P. Then, the sheet P is ejected by the pair of sheet ejecting rollers 20 to the outside of the apparatus body 110 of the image forming apparatus 100 and is stacked onto the sheet ejection tray 21.

The image forming apparatus 100 further includes a cover 37 on a side face (the right side face in FIG. 1) of the apparatus body 110 of the image forming apparatus 100. The cover 37 opens and closes in a direction indicated by a bi-direction arrow A in FIG. 1. By opening the cover 37, the process cartridge 1 can be removed from the apparatus body 110 of the image forming apparatus 100.

Figure 2:
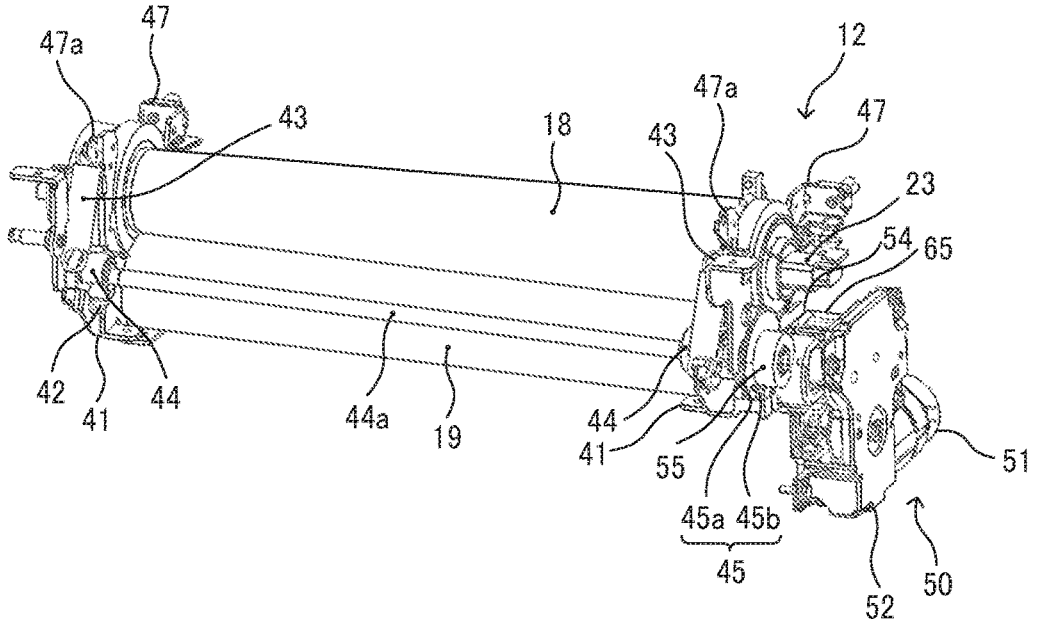
FIG. 2 is a perspective view illustrating a fixing device included in the image forming apparatus of FIG. 1.
Figure 3:
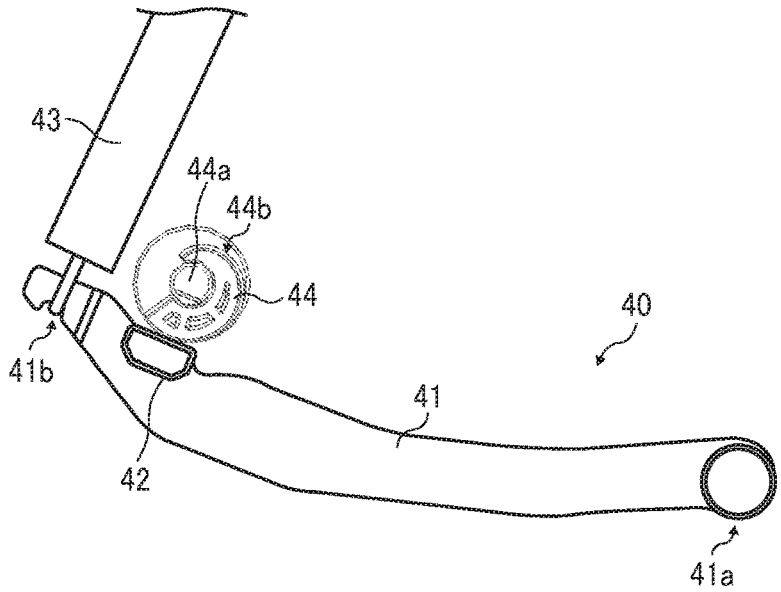
FIG. 3 is a diagram illustrating a main part of a pressure adjustment mechanism included in the fixing device.
Figure 4:
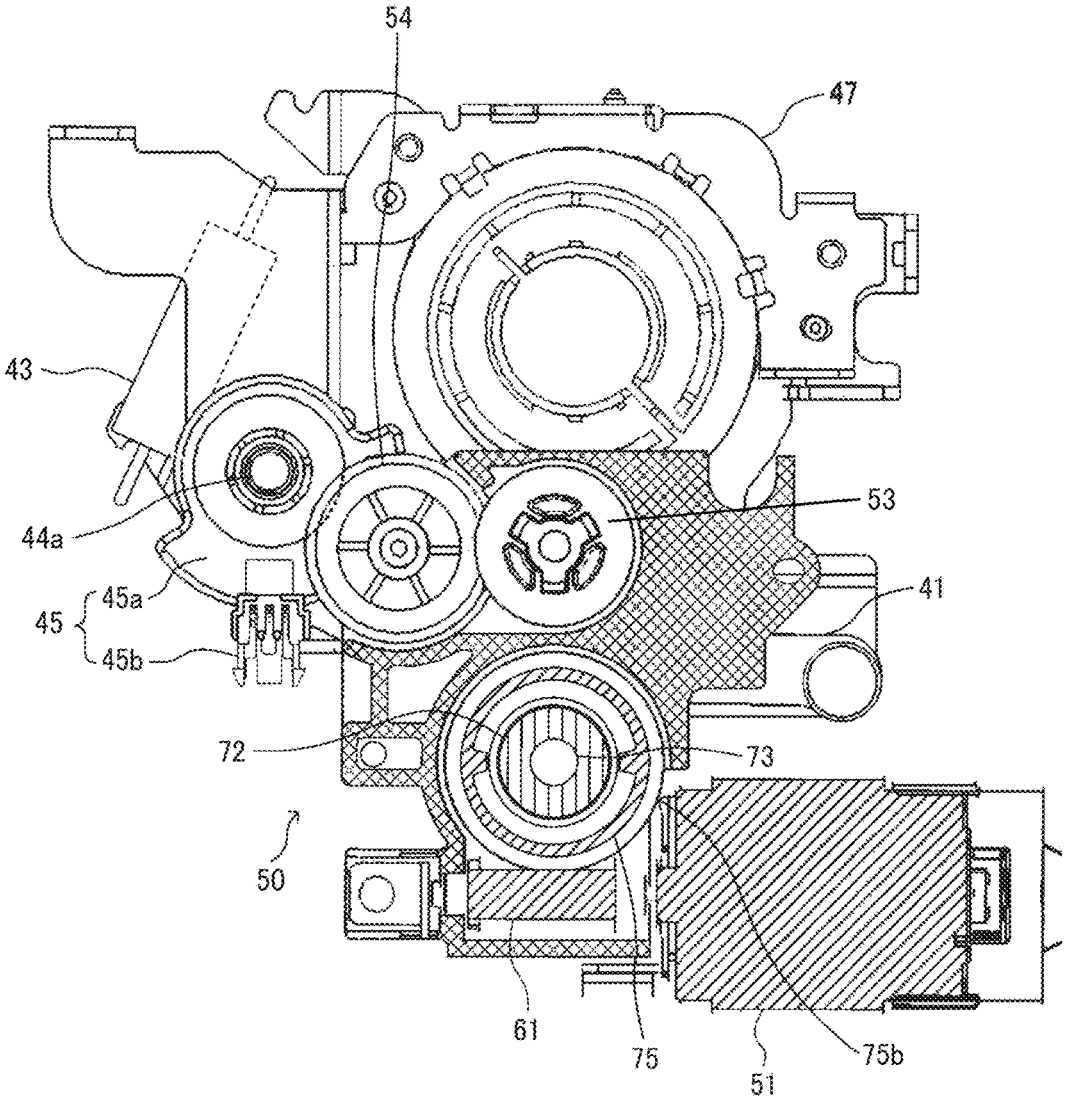
FIG. 4 is a cross sectional view illustrating the fixing device, viewed in a direction perpendicular to the axial direction of a far side end of the fixing device.
Figure 5:
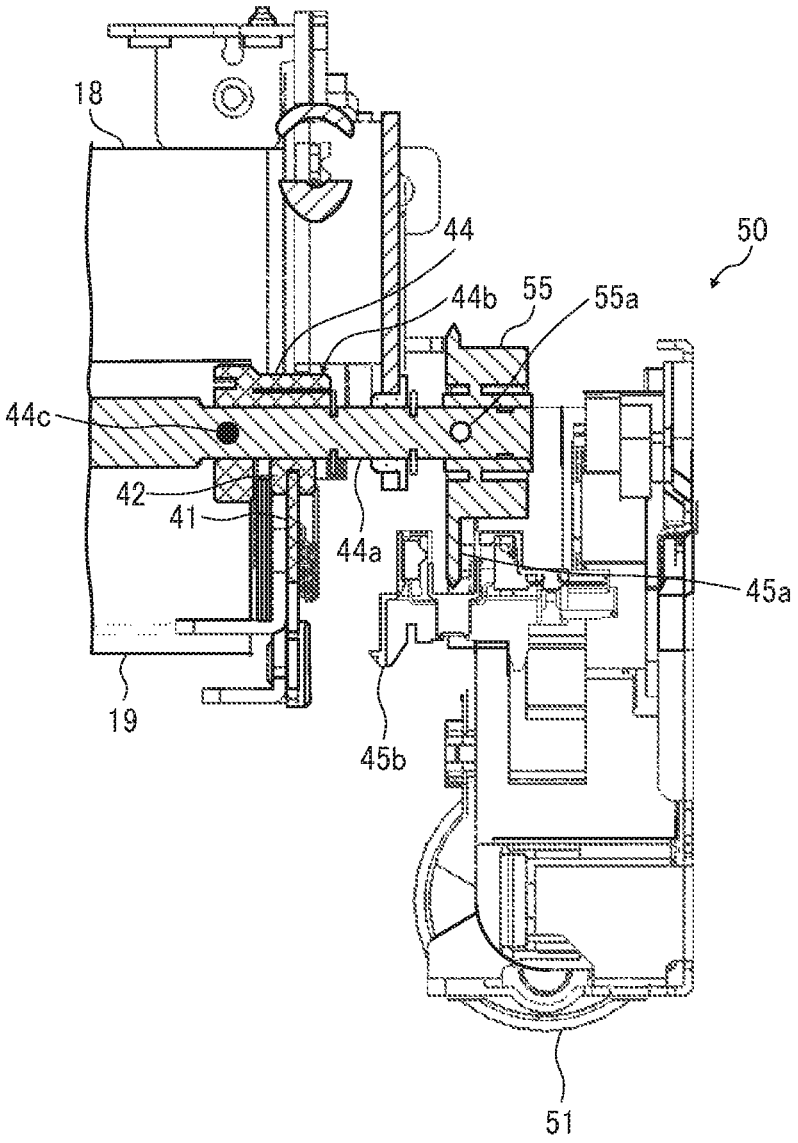
FIG. 5 is a cross sectional view illustrating the fixing device, viewed in a direction perpendicular to a sheet conveying direction at the far side end of the fixing device.

FIG. 2 is a perspective view illustrating the fixing device 12 included in the image forming apparatus 100 of FIG. 1. FIG. 3 is a diagram illustrating a main part of a pressure adjustment mechanism 40 included in the fixing device 12. FIG. 4 is a cross sectional view illustrating the fixing device 12, viewed in a direction perpendicular to the axial direction of a far side end of the fixing device 12. FIG. 5 is a cross sectional view illustrating the fixing device 12, viewed in a direction perpendicular to a sheet conveying direction of the sheet P at the far side end of the fixing device 12.

The fixing device 12 includes the fixing roller 18, the pressure roller 19, and the pressure adjustment mechanism 40. The fixing roller 18 functions as a heater facing body and includes the infrared heater 23 therein, so that the infrared heater 23 applies heat to the fixing roller 18. The pressure roller 19 functions as a moving body to press the fixing roller 18 and form a fixing nip region with the fixing roller 18. The pressure adjustment mechanism 40 causes the pressure roller 19 to move to the fixing roller 18 and adjusts a pressing force of the pressure roller 19 applied to the fixing roller 18.

The pressure adjustment mechanism 40 includes a pair of levers 41, a pair of springs 43, a pair of cams 44, and a drive device 50. The pair of levers 41 supports the pressure roller 19 to adjust the pressing force to approach and separate relative to the fixing roller 18. The pair of springs 43 functions as a biasing body to bias the pressure roller 19 toward the fixing roller 18 via the pair of levers 41. The pair of cams 44 moves the pressure roller 19 against a biasing force applied by the pair of springs 43 via the pair of levers 41, in a direction to separate from the fixing roller 18. The drive device 50 drives the pair of cams 44.

The fixing roller 18 is rotatably supported by a pair of side plates 47 on both sides in the axial direction. Both sides in the axial direction of the pressure roller 19 are rotatably supported by the pair of levers 41 of the pressure adjustment mechanism 40. As illustrated in FIG. 3, a support shaft 41*a* is mounted on one end of each of the pair of levers 41 and is rotatably supported by the pair of side plates 47. A spring receiver 41*b* is mounted on an opposed end of each of the pair of levers 41. One end of the pair of springs 43 that functions as a biasing body is attached to the spring receiver 41*b*. As illustrated in FIG. 2, the opposed end of each of the pair of springs 43 is attached to a bearing 47*a* mounted on each of the pair of side plates 47. A cam bearing 42 is provided on the opposed end of each of the pair of levers 41. Each of the pair of cams 44 is in contact with the cam bearing 42.

The pair of cams 44 is mounted on a cam shaft 44*a* with a parallel pin 44*c* (see FIG. 5) so that the pair of cams 44 rotates together with the cam shaft 44*a* as a single unit. A cam gear 55 is mounted on the cam shaft 44*a* at a far end (the right side end in FIG. 2) of the cam shaft 44*a* with a parallel pin 55*a*, so that the cam gear 55 that meshes with a second output gear 54 of the drive device 50 rotates together with the cam shaft 44*a* as a single unit.

The rotation angle detection mechanism 45 that detects the rotation angle of the pair of cams 44 includes a feeler 45*a*. The feeler 45*a* of the rotation angle detection mechanism 45 is mounted on the cam gear 55. The rotation angle detection mechanism 45 further includes an optical sensor 45*b*. The optical sensor 45*b* that detects the feeler 45*a* is disposed on a far side plate of the pair of side plates 47. The feeler 45*a* is a semicircle shape. The optical sensor 45*b* is a photointerrupter (a transmission optical sensor).

Figure 6A:
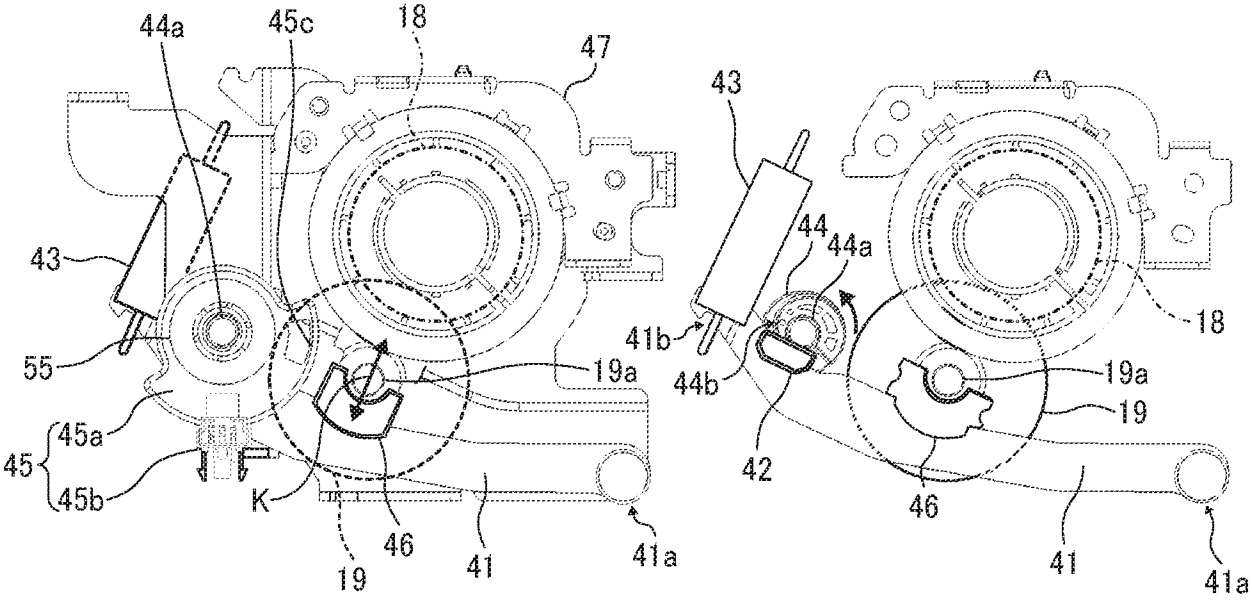
FIG. 6A is a diagram illustrating a state in which a pressure roller is in a pressing state.
Figure 6B:
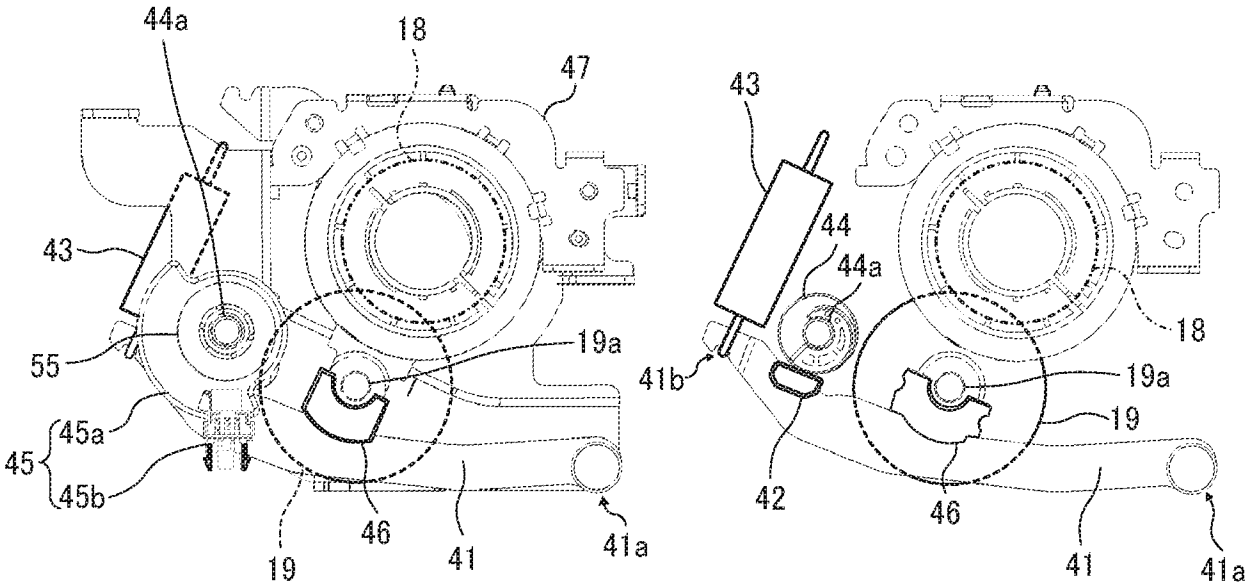
FIG. 6B is a diagram illustrating a state in which the pressure roller is in a non-pressing state.

FIG. 6A is a diagram illustrating a state in which the pressure roller 19 is in a pressing state. FIG. 6B is a diagram illustrating a state in which the pressure roller 19 is in a non-pressing state. The pressing state of the rotation angle detection mechanism 45 is illustrated on the left side of FIG. 6A. The non-pressing state of the rotation angle detection mechanism 45 is illustrated on the left side of FIG. 6B.

As illustrated in FIGS. 6A and 6B, the pair of levers 41 is in contact with a bearing 46 that receives a shaft 19*a* of the pressure roller 19. The bearing 46 is supported by the pair of side plates 47 reciprocally in a direction indicated by arrow K in FIGS. 6A and 6B. Further, the feeler 45*a* of the rotation angle detection mechanism 45 is a semicircle shape and has an opening 45*c* at one end side in the rotational direction.

As illustrated in FIG. 6A, in the pressing state, the feeler 45*a* is located between a light emitting element and a light receiving element of the optical sensor 45*b*, so that the feeler 45*a* interrupts the optical path formed between the light emitting element and the light receiving element of the optical sensor 45*b*. Further, in the pressing state, the bottom dead center of the pair of cams 44 is in contact with the cam bearing 42.

As the drive device 50 is driven to change the state of the rotation angle detection mechanism 45 from the pressing state to the non-pressing state, the pair of cams 44 and the feeler 45*a* rotate in the counterclockwise direction in FIGS. 6A and 6B. Consequently, the pair of cams 44 in the state as illustrated in FIG. 6A presses the cam bearing 42 downwardly in FIG. 6A, against the biasing force applied by the pair of springs 43. According to this action, the pair of levers 41 rotates about the support shaft 41*a* in the counterclockwise direction in FIG. 6A. Then, the pressure roller 19 that functions as a moving body is moved by a reaction force from the fixing roller 18, in a direction to separate from the fixing roller 18, resulting in a reduction in the pressing force of the pressure roller 19 to the fixing roller 18.

As illustrated in FIG. 6B, as the top dead center of the pair of cams 44 contacts the cam bearing 42, the opening 45*c* is brought to a position between the light emitting element and the light receiving element of the optical sensor 45*b*, so that the light receiving element of the optical sensor 45*b* detects light emitted from the light emitting element. According to this action, it is detected that the pressure roller 19 has retreated to a non-pressure position.

In the present embodiment, in a case in which a paper jam occurs in the fixing device 12, the pressure adjustment mechanism 40 changes the state to the non-pressing state. Consequently, a sheet or sheets jammed in the fixing nip region can be removed from the fixing nip region easily.

Further, in a case in which the image forming apparatus 100 is changed from a standby state to a sleep mode or in a case in which the power source is turned off, the pressure adjustment mechanism 40 reduces a pressing force of the pressure roller 19 to the fixing roller 18, thereby preventing occurrence of creep (deformation) at the fixing nip region. Further, in a case in which a thick paper such as an envelope is conveyed, the pressure adjustment mechanism 40 reduces the pressing force of the pressure roller 19 to the fixing roller 18. By so doing, a fixing operation can be performed without causing creases in the thick paper.

When transferring from the non-pressing state to the pressing state, a drive motor 51 is driven to rotate in a direction opposite the rotational direction to transfer from the pressing state to the non-pressing state. Consequently, the pair of cams 44 rotates in the clockwise direction, and the pair of levers 41 rotates due to the biasing force of the pair of springs 43, about the support shaft 41*a* in the clockwise direction in FIG. 6B. Accordingly, the pressure roller 19 is brought to press the fixing roller 18. Further, the feeler 45*a* enters between the light receiving element and the light emitting element of the optical sensor 45*b*. After a predetermined period of time has elapsed since the light receiving element stopped detecting light emitted from the light emitting element, it is determined that the pressing force has reached a specified value and the driving of the drive motor 51 is stopped.

Figure 7:
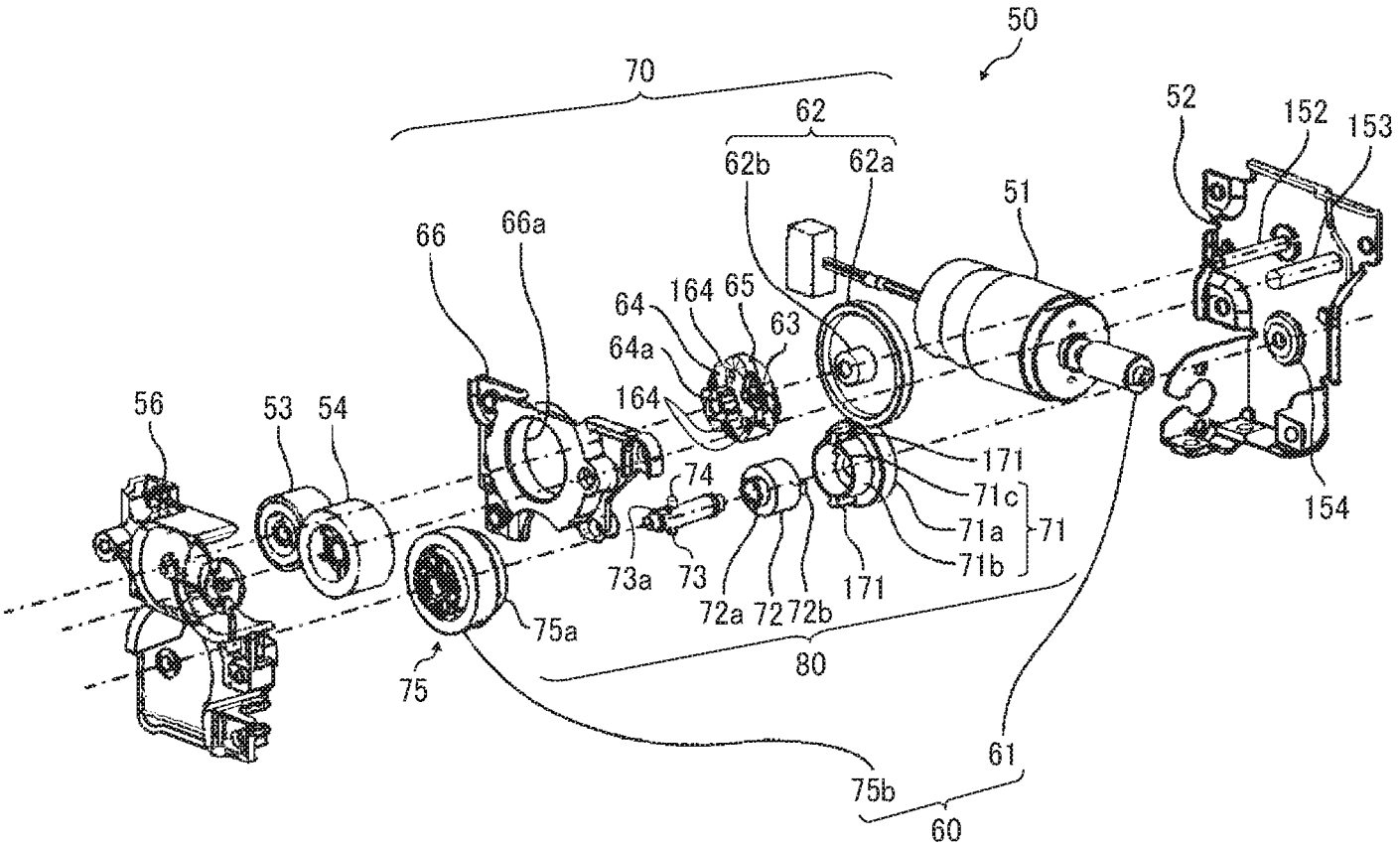
FIG. 7 is an exploded perspective view illustrating a drive device of a pressure adjustment mechanism.
Figure 8:
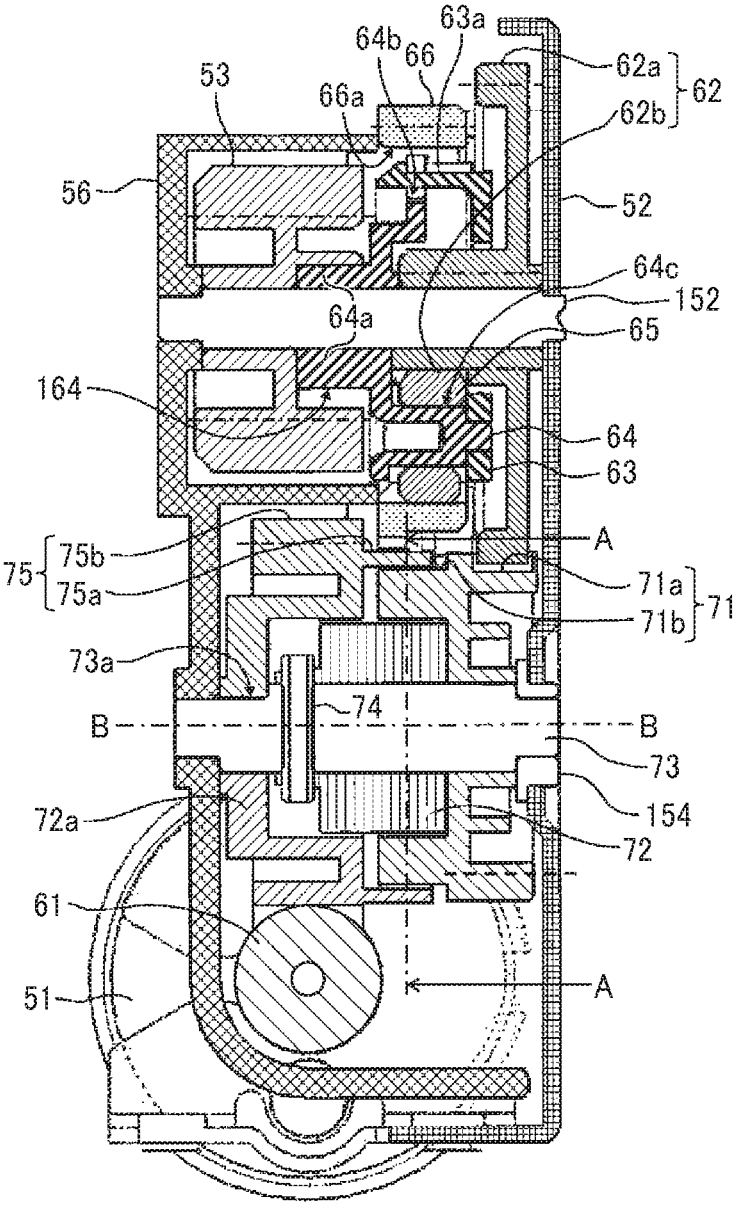
FIG. 8 is a cross sectional view illustrating the drive device, cut parallel along the axial direction of the drive device.
Figure 9:
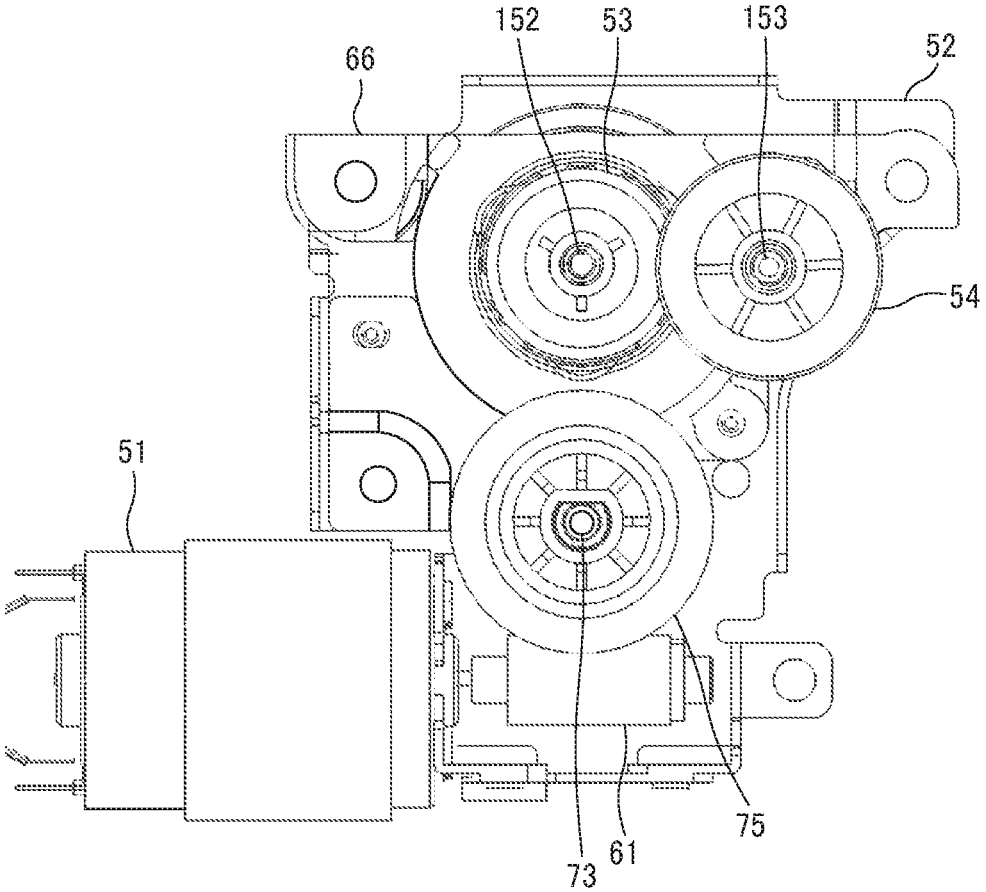
FIG. 9 is a front view illustrating the drive device, viewed from the left side of FIG. 8, after a second housing is removed.
Figure 10:
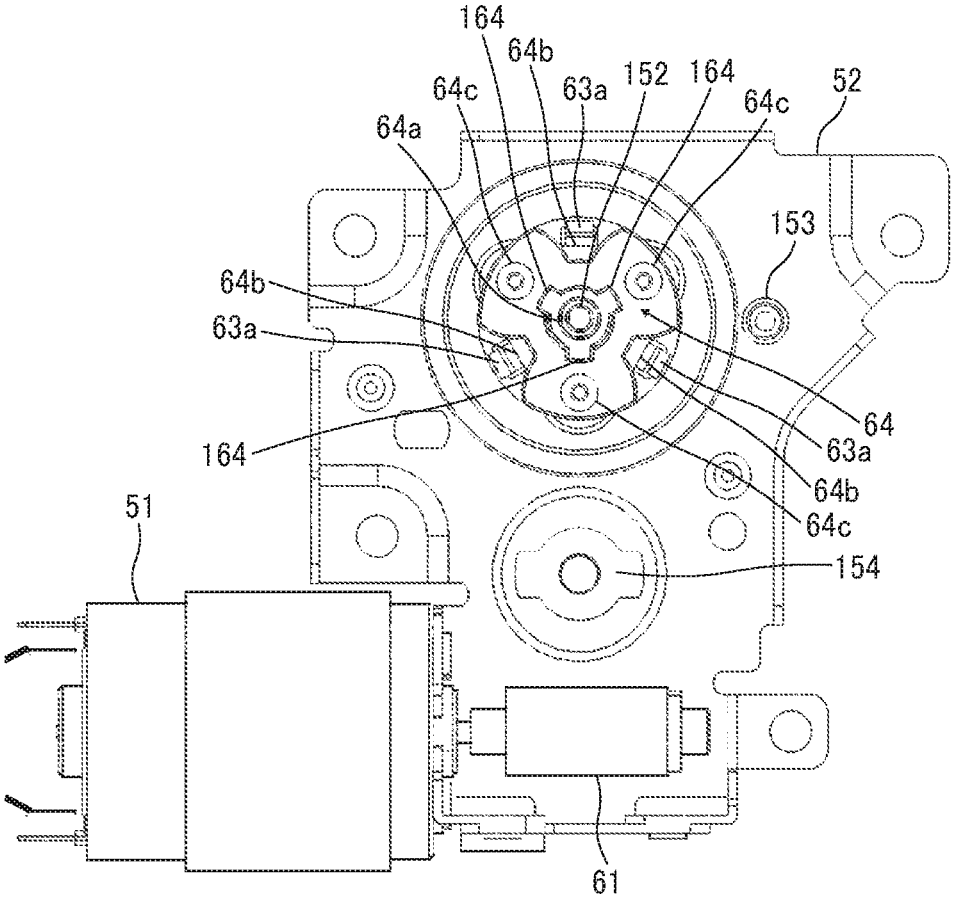
FIG. 10 is a front view illustrating the drive device, after a worm wheel, a first housing, a drive shaft, a first output gear and a second output gear are further removed from the drive device of FIG. 9.

FIG. 7 is an exploded perspective view illustrating the drive device 50 included in the pressure adjustment mechanism 40. FIG. 8 is a cross sectional view illustrating the drive device 50, cut parallel to the axial direction. FIG. 9 is a front view illustrating the drive device 50, viewed from the left side of FIG. 8, after a second housing 56 is removed from the drive device 50. FIG. 10 is a front view illustrating the drive device 50 of FIG. 9, after a worm wheel 75, a first housing 66, a drive shaft 73, a first output gear 53 and the second output gear 54 are further removed from the drive device 50.

The drive device 50 according to the present embodiment includes the drive motor 51, a worm gear 60, a planetary gear mechanism 70 and a load applying device 80. A driving force exerted by the drive motor 51 is transmitted to the worm gear 60, the load applying device 80, and the planetary gear mechanism 70 in this order.

In the present embodiment, the drive motor 51 is a brush motor that is less expensive and more compact than a brushless motor. A worm 61 of the worm gear 60 is mounted on a motor shaft of the drive motor 51, so that the worm 61 is rotated together with the motor shaft of the drive motor 51 as a single unit. The worm 61 is meshed with a worm wheel 75. The worm wheel 75 is rotatably supported by a drive shaft 73 that is secured to the bracket 52 via a bearing 154.

Figure 11A:
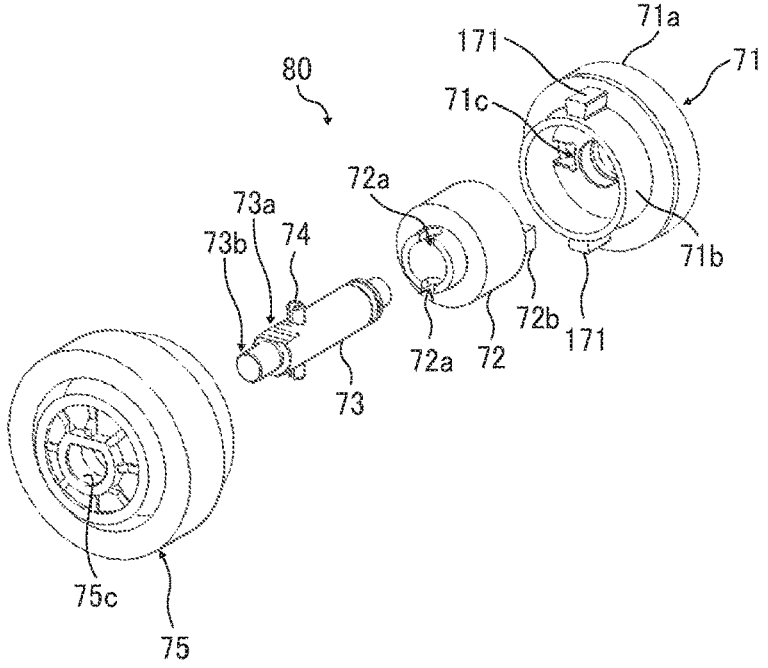
FIG. 11A is an exploded perspective view illustrating a load applying device.
Figure 11B:
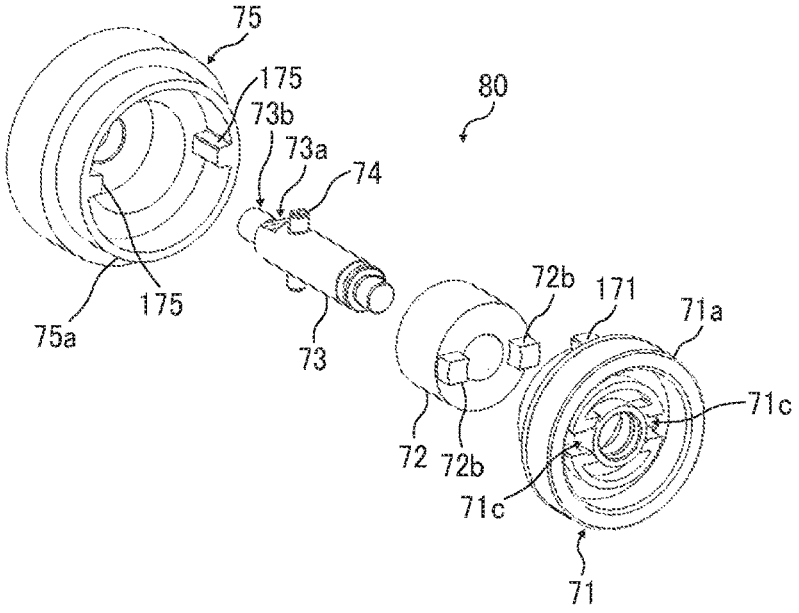
FIG. 11B is another exploded perspective view illustrating the load applying device, viewed from a different angle from FIG. 11A.
Figure 12:
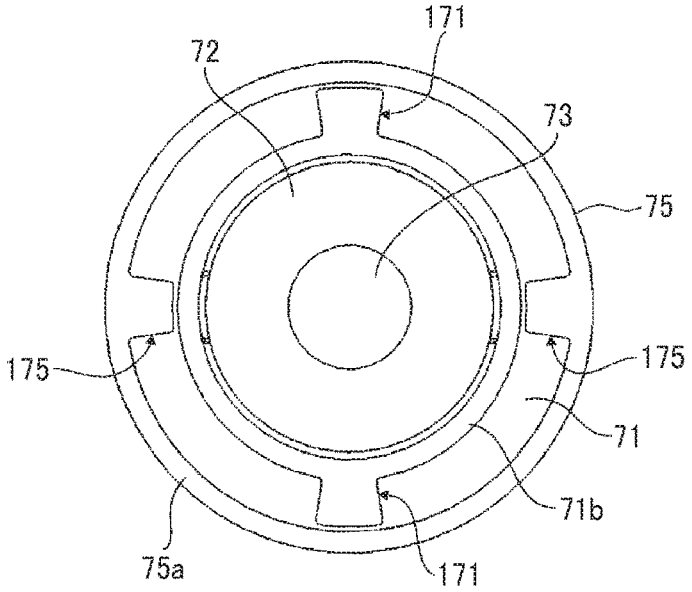
FIG. 12 is a cross sectional view illustrating the drive device of FIG. 8, along a line A-A of FIG. 8.
Figure 13:
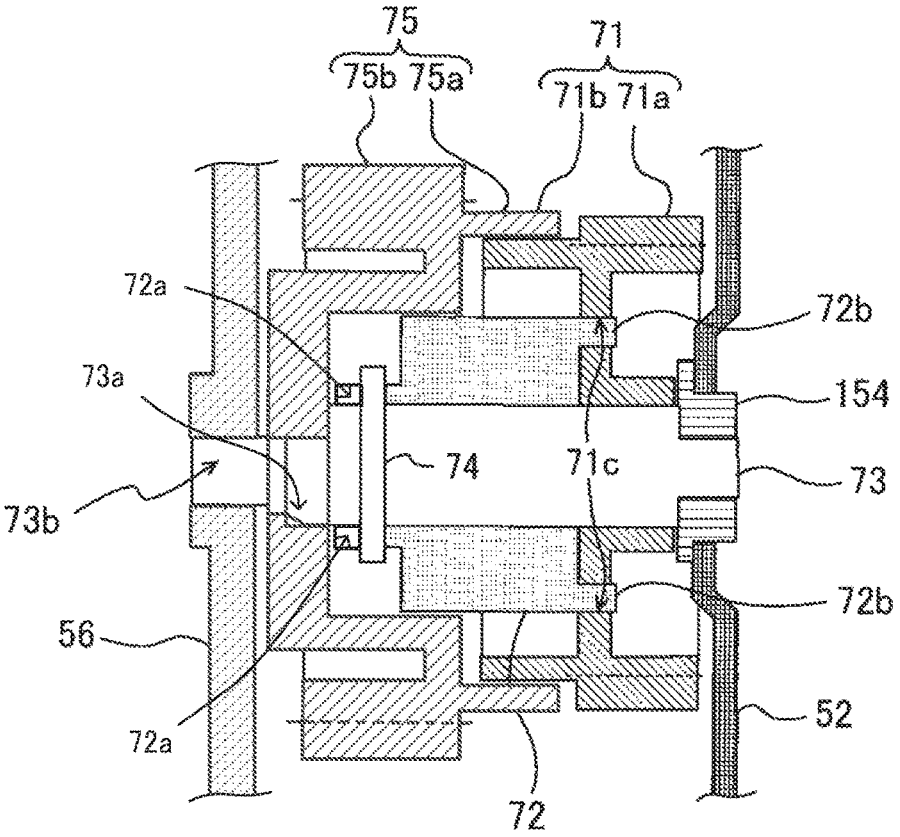
FIG. 13 is a cross sectional view illustrating the drive device of FIG. 8, along a line B-B of FIG. 8.

FIG. 11A is an exploded perspective view illustrating the load applying device 80. FIG. 11B is another exploded perspective view illustrating the load applying device 80, viewed from a different angle from FIG. 11A. FIG. 12 is a cross sectional view illustrating the drive device 50 of FIG. 8, along a line A-A of FIG. 8. FIG. 13 is a cross sectional view illustrating the drive device 50 of FIG. 8, along a line B-B of FIG. 8.

The load applying device 80 includes a drive side coupling 75*a*, a driven side coupling 71*b*, the drive shaft 73, and a torque limiter 72 that functions as a load applying body. The driving side coupling 75*a* is mounted on the worm wheel 75. As illustrated in FIGS. 11B and 12, two drive side engagement projections 175 are provided on an inner circumferential surface of the drive side coupling 75*a*, at intervals of an angle of 180 degrees. Hereinafter, the two drive side engagement projections 175 are occasionally referred to in a singular form for convenience.

The worm wheel 75 is mounted on the drive shaft 73 so that the worm wheel 75 rotates together with the drive shaft 73 as a single unit. Specifically, the drive shaft 73 has a press-in portion 73*a* having a D-shaped cross section and the worm wheel 75 includes a substantially elastically deformable material such as resin and has a press-in hole 75*c* as a press-in target portion having a D-shaped cross section to which the press-in portion 73*a* is pressed. The press-in portion 73*a* of the drive shaft 73 is press-fitted into the press-in hole 75*c* of the worm wheel 75 while the press-in hole 75*c* of the worm wheel 75 is being expanded (being deformed widely). By so doing, the worm wheel 75 is attached to the drive shaft 73 so as to be rotated together with the drive shaft 73 as a single unit. It is to be noted that details of the press-in portion 73*a* and the press-in hole 75*c* are described below.

One end of the drive shaft 73 is rotatably supported by a bracket 52 via a bearing 154. The drive shaft 73 has an opposed end on which a support 73*b* that is rotatably supported by the second housing 56 is mounted. The support 73*b* has a diameter smaller than the diameter of the press-in portion 73*a*.

The torque limiter 72 that functions as a load applying body and a drive coupling member 71 are mounted on the drive shaft 73. Two cut portions 72*a* are provided at an end of the torque limiter 72 on the side of the worm wheel 75. The two cut portions 72*a*, each of which extending in the axial direction, are located at intervals of an angle of 180 degrees in the direction of rotation of the torque limiter 72. A parallel pin 74 is inserted into the drive shaft 73. The parallel pin 74 is fitted and inserted into the cut portions 72*a* of the torque limiter 72.

Two engagement projections 72*b* are provided at an opposed end of the torque limiter 72 on the side of the drive coupling member 71. The two engagement projections 72*b*, each of which extending in the axial direction, are located at intervals of an angle of 180 degrees in the direction of rotation of the torque limiter 72. These engagement projections 72*b* are fitted and inserted into an engagement opening 71*c* that is provided on the opposing face of the drive coupling member 71 facing the torque limiter 72.

The drive coupling member 71 is rotatably supported by the drive shaft 73 and includes the driven side coupling 71*b* and a gear portion 71*a*. The driven side coupling 71*b* has an outer diameter to enter and fit to the drive side coupling 75*a*. Two driven side engagement projections 171 are formed on an outer circumferential surface of the driven side coupling 71*b* at intervals of an angle of 180 degrees in the direction of rotation of the driven side coupling 71*b*. Hereinafter, the two driven side engagement projections 171 are occasionally referred to in a singular form for convenience.

As illustrated in FIGS. 7 and 8, the planetary gear drive transmission member 62 is rotatably supported by a first support shaft 152 that is secured to the bracket 52 by caulking. A sun gear 62*b* of the planetary gear mechanism 70 is formed on the planetary gear drive transmission member 62.

The planetary gear mechanism 70 includes the sun gear 62*b*, three planetary gears 65, a carrier 64, an internal gear 66*a*, and a carrier holder 63. The three planetary gears 65 mesh with the sun gear 62*b*. The carrier 64 rotatably supports the three planetary gears 65. The internal gear 66*a* meshes with the three planetary gears 65. The carrier holder 63 causes the three planetary gears 65 to be held by the carrier 64.

The planetary gears 65 are rotatably supported by respective planetary gear support shafts 64*c* mounted on the carrier 64 at equal intervals in a direction of rotation of the carrier 64. Snap fits 63*a* are mounted on the carrier holder 63 to be attached to the carrier 64. While elastically deforming the snap fits 63*a*, claws at the leading edges of the snap fits 63*a* are inserted through respective engaging holes 64*b* of the carrier 64. By so doing, the carrier holder 63 is attached to the carrier 64. Accordingly, the planetary gears 65 are held by the carrier 64.

The internal gear 66*a* is mounted on a first housing 66. The first housing 66 is combined with the bracket 52 or the second housing 56, thereby covering the worm gear 60, the planetary gear mechanism 70, and the load applying device 80.

As illustrated in FIGS. 7, 8 and 10, the carrier 64 includes a support target portion 64*a* having a cylindrical shape, to be supported by the first support shaft 152. By inserting the support target portion 64*a* into the first support shaft 152, the carrier 64 is rotatably supported by the first support shaft 152. Three drive coupling projections 164 are provided on the outer circumferential surface of the support target portion 64*a*, at equal intervals having an angle of 120 degrees. The three drive coupling projections 164 are drivingly coupled to the first output gear 53 that is rotatably supported by the first support shaft 152. By contrast, the first output gear 53 has a cylindrical portion on an opposing face to the carrier 64. A support target portion 64*a* is inserted into the circumferential portion of the first output gear 53. Three grooves into which the drive coupling projections 164 are fitted and inserted are provided on the inner circumferential surface of the cylindrical portion of the first output gear 53, at equal intervals having an angle of 120 degrees. Accordingly, the driving force is transmitted from the carrier 64 to the first output gear 53.

The second output gear 54 is meshed with the first output gear 53. The second output gear 54 is rotatably supported by a second support shaft 153 that is secured to the bracket 52 by caulking. The second output gear 54 is meshed with the cam gear 55, as illustrated in FIG. 2.

As the drive motor 51 rotates, the worm gear 60 reduces the speed of transmission of the driving force. Due to the driving force having the reduced speed reduced by the worm gear 60, the drive side coupling 75*a* and the drive shaft 73 rotate. When the drive side engagement projection 175 of the drive side coupling 75*a* is not in contact with the driven side engagement projection 171, the drive torque of the drive motor 51 is added to the torque limiter 72 via the drive shaft 73. As the drive torque is added to the torque limiter 72, the torque limiter 72 is operated to interrupt the transmission of the driving force from the torque limiter 72 to the drive coupling member 71, and therefore the drive coupling member 71 is prevented from rotating.

When the drive side engagement projection 175 of the drive side coupling 75*a* contacts the driven side engagement projection 171, the driving force of the drive motor is transmitted from the drive side coupling 75*a* to the driven side coupling 71*b*, thereby rotating the drive coupling member 71. Then, the driving force is transmitted from the gear portion 71*a* of the drive coupling member 71 to the input gear 62*a* of the planetary gear drive transmission member 62. Consequently, the sun gear 62*b* of the planetary gear mechanism 70 rotates.

As the sun gear 62*b* rotates, the planetary gears 65 that mesh with the sun gear 62*b* revolve around the sun gear 62*b* while rotating. Due to revolution of the planetary gears 65 around the sun gear 62*b*, the carrier 64 is rotated, and the first output gear 53 that is engaged with the carrier 64 is rotated together with the carrier 64. Then, the driving force is transmitted to the second output gear 54 that is meshed with the first output gear 53, and therefore the pair of cams 44 is rotated via the cam gear 55, as illustrated in FIG. 2.

As described above, when reducing the pressing force of the pressure roller 19 to the fixing roller 18, the pair of cams 44 presses the pair of levers 41 downwardly against the biasing force of the pair of springs 43. As a result, a load torque of the pair of cams 44 increases. Further, as the opposed end of the pair of levers 41 is pressed downwardly in FIG. 3, the pair of springs 43 extends, and therefore the biasing force of the pair of springs 43 increases. Consequently, the load torque of the pair of cams 44 increases. Accordingly, as the pressing force of the pressure roller 19 to the fixing roller 18 decreases, the load torque of the pair of cams 44 increases.

Now, a description is given of a comparative fixing device having a drive transmission mechanism that transmits a driving force applied by a drive motor of a drive device to a pair of cams. When the drive transmission mechanism of the comparative fixing device includes a gear train that transmits the driving force by meshing of multiple external gears, a sufficient reduction ratio cannot be obtained. Therefore, the drive motor employs a motor having a large drive torque, so that an output torque to be output to the pair of cams becomes greater than the load torque of the pair of cams. Consequently, a pair of levers can be rotated against the biasing force of the pair of springs. However, such a drive motor having a large drive torque is large in size and expensive. As a result, the size and cost of an image forming apparatus that includes the comparative fixing device provided with the drive transmission mechanism increase.

In order to address this inconvenience, the drive device 50 according to the present embodiment has a configuration to obtain a relatively high reduction ratio using the worm gear 60 and the planetary gear mechanism 70. Thus, a relatively high reduction ratio can be obtained as described above, even when the drive motor 51 having a relatively small drive torque is used, the output torque to the pair of cams 44 can be made greater than the load torque of the pair of cams 44. Accordingly, even when the drive motor 51 employs a less expensive and compact brush motor having a relatively small torque, the drive motor 51 can rotate the pair of cams 44 against the biasing force of the pair of springs 43 preferably, and the pressing force of the pressure roller 19 to the fixing roller 18 can be adjusted reliably.

Further, the drive device 50 according to the present embodiment includes the worm gear 60 and the planetary gear mechanism 70. According to this configuration, a relatively large reduction ratio can be obtained without using gears having a large diameter. Therefore, when compared with a configuration in which a gear train is employed to obtain a large reduction ratio, the configuration according to the present embodiment can prevent or restrain an increase in size of the image forming apparatus 100.

Further, in the present embodiment, a high reduction ratio can be obtained, and therefore the angle of rotation of the pair of cams 44 to the amount of driving force of the drive motor 51 can be relatively small. Accordingly, the angle of rotation of the pair of cams 44 can be adjusted finely, and therefore fine adjustment of the pressing force can be performed.

Further, in the planetary gear mechanism 70 according to the present embodiment, the sun gear 62*b* functions as an input portion (a driving portion), the internal gear 66*a* functions as a fixed portion, and the carrier 64 functions as an output portion (a driven portion). By setting the sun gear 62*b* as the input portion, the internal gear 66*a* as the fixed portion, and the carrier 64 as the output portion, the planetary gear mechanism 70 according to the present embodiment can obtain a maximum reduction ratio or a greatest reduction ratio.

Further, in assembly of the fixing device 12 to the apparatus body 110 of the image forming apparatus 100, even when the gear tip of the cam gear 55 that is mounted on the fixing device 12 is likely to abut against the gear tip of the second output gear 54 that is mounted on the apparatus body 110 of the image forming apparatus 100. In order to avoid this inconvenience, when the gear tip of the cam gear 55 hits the gear tip of the second output gear 54 mounted on the apparatus body 110 of the image forming apparatus 100, the second output gear 54 rotates to mesh the second output gear 54 and the cam gear 55 with each other. As described above, the drive device 50 according to the present embodiment has the configuration to obtain a high reduction ratio. Therefore, a large amount of force is to be applied to rotate the drive motor 51 that remains stopped. Accordingly, the drive device 50 my need to have a configuration in which the second output gear 54 rotates to some extent without rotating the drive motor 51 that is not rotated.

In the present embodiment, as illustrated in FIG. 12, the two driven side engagement projections 171 are provided at an interval of an angle 180 degrees in the rotation direction and the two drive side engagement projections 175 are provided at an interval of an angle 180 degrees in the rotation direction. According to this configuration, the drive coupling member 71 is rotatable by substantially 180 degrees to the worm wheel 75. Consequently, by rotating the worm wheel 75 without rotating the drive motor 51 that is not rotated, the drive transmission member (i.e., the second output gear 54, the first output gear 53, each member of the planetary gear mechanism 70) disposed downstream from the worm wheel 75 in the drive transmission direction is rotated until the drive coupling member 71 is rotated by substantially half-turn, in other words, by substantially 180 degrees. By so doing, in assembly of the fixing device 12 to the apparatus body 110 of the image forming apparatus 100, when the gear tip of the cam gear 55 contacts the gear tip of the second output gear 54, the second output gear 54 rotates to mesh the second output gear 54 and the cam gear 55 with each other without rotating the drive motor 51 that is stopped. Accordingly, the fixing device 12 can be assembled to the apparatus body 110 of the image forming apparatus 100 easily, without a large amount of force to be applied in assembly of the fixing device 12.

Figure 14:
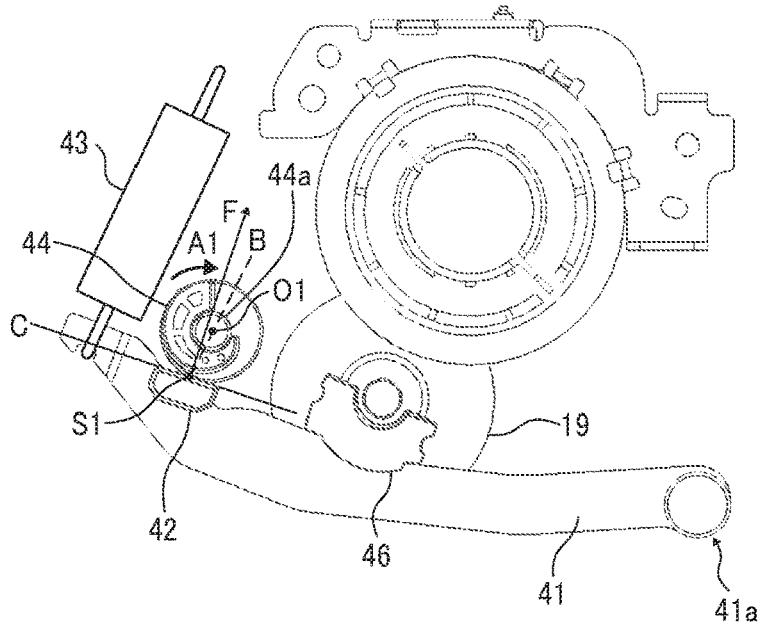
FIG. 14 is a diagram illustrating movement of the pressure roller from the non-pressing state (with no pressure force) to the pressing state.

FIG. 14 is a diagram illustrating movement of the pressure roller 19 from the non-pressing state (with no pressing force applied) to the pressing state.

When the pressure roller 19 is in the non-pressing state, a top dead center of the pair of cams 44, where a distance from the axial center of the cam shaft 44*a* of the pair of cams 44 to the outer circumferential surface of the pair of cams 44 becomes the greatest distance, contacts the cam bearing 42, as illustrated in FIG. 6B. When the pair of cams 44 is rotated in a direction indicated by arrow A1 in FIG. 14 from this state, a biasing direction F of the springs 43, normal to a line C, that is received by the pair of cams 44 via the cam bearing 42 is shifted to the rotation direction, relative to a line B that connects a point of contact S1 of the cam bearing 42 and a cam face 44*b* and a center of rotation O1 of the pair of cams 44. As a result, the biasing force F of the pair of springs 43 works to the pair of cams 44 in the rotation direction of the pair of cams 44, and the pair of cams 44 is pressed in the rotation direction, and therefore the pair of cams 44 is rotated faster than a rotation drive speed to rotate the pair of cams 44 by receiving the driving force from the drive motor 51.

Figure 15:
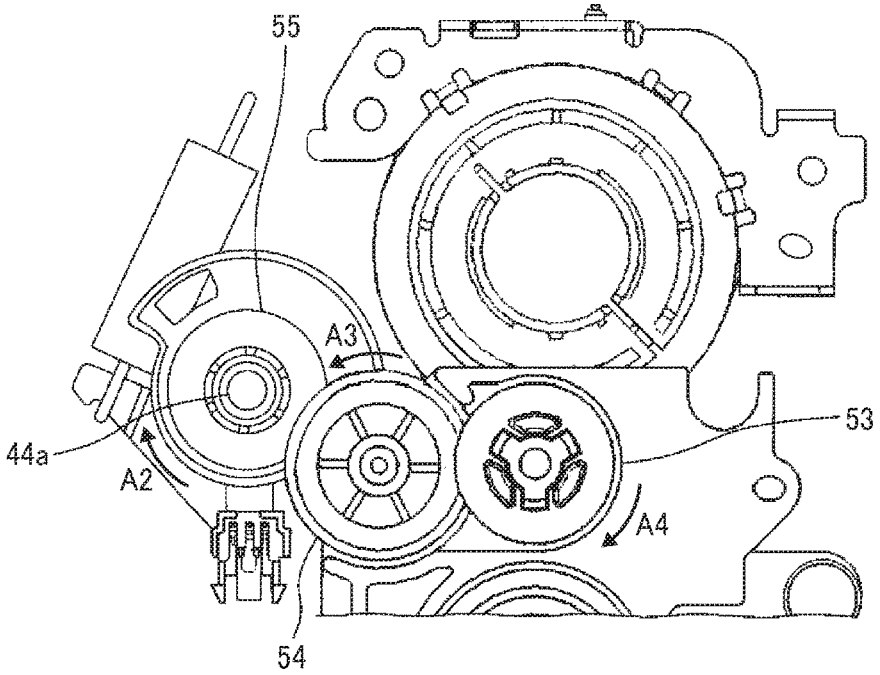
FIG. 15 is a diagram illustrating respective movements of gears of the drive device in a state in which a cam rotates at a rotation speed faster than a rotation speed rotating by receiving a driving force from a drive motor by a biasing force of a spring.

FIG. 15 is a diagram illustrating respective movements of gears of the drive device 50 in a state in which the pair of cams 44 rotates at a rotation speed faster than the rotation speed by receiving the driving force from the drive motor 51 by the biasing force of the pair of springs 43.

There is a predetermined play such as a backlash in an engaging portion between drive transmitting members, such as a meshing portion of gears of the drive device 50. Therefore, when the pair of cams 44 is rotated faster than the rotation drive speed to rotate by receiving the biasing force of the pair of springs 43, the cam shaft 44*a* rotates, together with the pair of cams 44, faster than the rotation drive speed. As a result, as indicated by arrow A2 illustrated in FIG. 15, the cam gear 55 mounted on the cam shaft 44*a* rotates faster than the rotation drive speed. After the cam gear 55 has rotated faster by an amount of play (backlash) with the second output gear 54, a tooth of the cam gear 55 contacts a tooth of the second output gear 54, so that the second output gear 54 is pressed in the rotation direction. Consequently, as indicated by arrow A3 illustrated in FIG. 15, the second output gear 54 rotates by the amount of play with the first output gear 53 and presses the first output gear 53, so as to rotate the first output gear 53 faster than the rotation drive speed, as indicated by arrow A4 illustrated in FIG. 15.

Then, similar to the above-described configuration, the biasing force F of the pair of springs 43 (i.e., a back torque) is transmitted from the first output gear 53 to the planetary gear mechanism 70 and the drive coupling member 71. Therefore, the drive coupling member 71 rotates faster than the rotation drive speed.

Figure 16B:
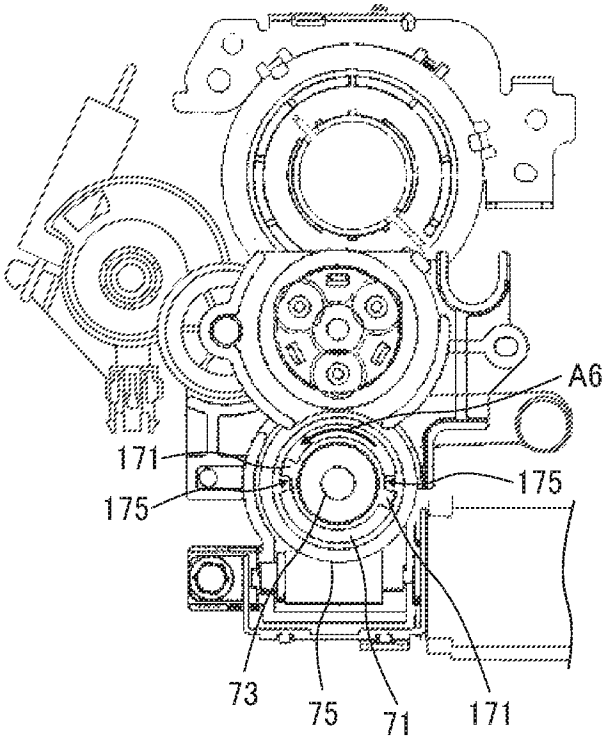
FIG. 16B is a diagram illustrating the drive coupling member having rotated faster than the rotation drive speed by a back torque.
Figure 16A:
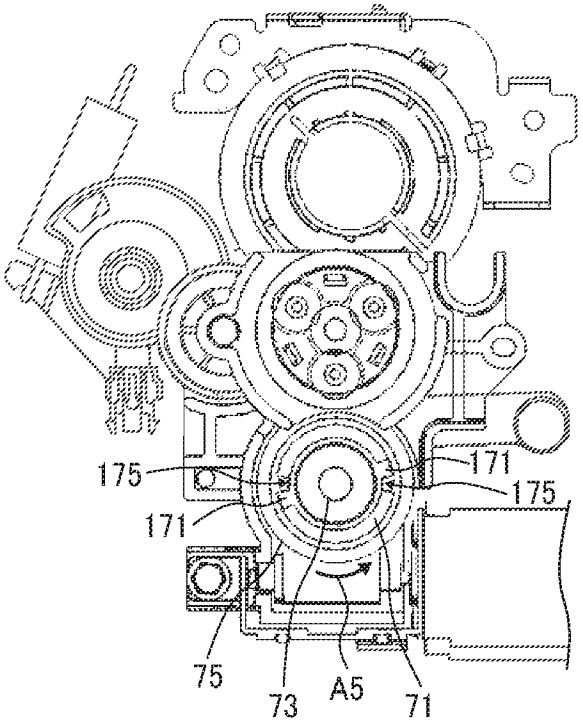
FIG. 16A is a diagram illustrating a drive coupling member before rotating faster than a rotation drive speed.

FIG. 16A is a diagram illustrating the drive coupling member 71 before rotating faster than the rotation drive speed. FIG. 16B is a diagram illustrating the drive coupling member 71 having rotated faster than the rotation drive speed by the back torque.

As indicated by arrow A5 illustrated in FIG. 16A, while the drive coupling member 71 is rotating at the rotation drive speed by receiving the driving force from the drive motor 51, the drive side engagement projection 175 contacts the driven side engagement projection 171 from the upstream side of the rotation direction, so as to transmit the driving force to the drive coupling member 71. Consequently, the worm wheel 75 and the drive coupling member 71 rotate as a single unit.

As indicated by arrow A6 illustrated in FIG. 16B, as the drive coupling member 71 rotates faster than the rotation drive speed due to the back torque, the driven side engagement projection 171 moves in the rotation direction to separate from the drive side engagement projection 175.

In the present embodiment, in order to make assembly of the fixing device 12 easy, the play of the drive coupling member 71 between the driven side engagement projection 171 and the drive side engagement projection 175 is set to substantially an angle of 180 degrees. Therefore, as the drive coupling member 71 increases the rotation speed by the back torque and after the driven side engagement projection 171 has been moved in the rotation direction by an angle of substantially 180 degrees, the driven side engagement projection 171 is likely to hit against the drive side engagement projection 175 with great force, resulting in generation of sound of collision.

For these reasons, the drive device 50 (the drive transmission device 90) further includes the torque limiter 72 that functions as a load applying body, so that a load is applied to rotation of the drive coupling member 71 by backlash. Specifically, the back torque is transmitted to the drive coupling member 71, and as the drive coupling member 71 rotates faster than the rotation drive speed, the back torque is inputted to the torque limiter 72 via the drive coupling member 71. The torque to operate the torque limiter 72 is set smaller than the value of the above-described back torque. As the drive torque is inputted to the torque limiter 72, the torque limiter 72 is operated to interrupt the transmission of the driving force between the drive coupling member 71 and the drive shaft 73.

When the torque limiter 72 is operated and the drive transmission is interrupted, a predetermined rotational load is applied. For example, in a case in which the torque limiter 72 is a friction type limiter, when a torque that is applied to the torque limiter 72 is greater than a static friction force generated between a first member that is attached to the drive shaft 73 of the torque limiter 72 and a second member that is attached to the drive coupling member 71, the second member rotates relative to the first member so as to cut off the drive transmission. Accordingly, while the second member is rotating relative to the first member and the drive transmission is being blocked, a predetermined frictional force is generated between the first member and the second member, thereby generating a rotational load.

By contrast, in a case in which the torque limiter 72 is a magnetic type limiter, while the second member is rotating relative to the first member and the drive transmission is being blocked, a predetermined magnetic force is generated between the first member and the second member, thereby generating a rotational load. As described above, when the torque limiter 72 is operated to block the drive transmission, a rotational load is generated. Therefore, when the back torque is transmitted to the drive coupling member 71, the drive coupling member 71 rotates faster than the rotation drive speed to operate the torque limiter 72. Then, the load is generated and applied to the torque limiter 72, so as to brake the rotation of the drive coupling member 71. Accordingly, after the rotation of the drive coupling member 71 is reduced sufficiently, the driven side engagement projection 171 collides with the drive side engagement projection 175, and therefore occurrence of a sound of collision can be restrained.

Further, when the pair of cams 44 is rotated by the driving force applied by the drive motor 51, no torque is applied to the torque limiter 72, and therefore the torque limiter 72 is not operated. The torque limiter 72 is operated to apply the rotational load when the pair of cams 44 is rotated by the biasing force applied by the pair of springs 43. Accordingly, the load that is applied when the pair of cams 44 is rotated by the driving force applied by the drive motor 51 can be reduced, and therefore the drive motor 51 can employ a motor that is less expensive and has a relatively small output torque.

Further, in the present embodiment, the rotational load can be applied when the pair of cams 44 is rotated relatively fast by applying the biasing force of the pair of springs 43, even without detecting the rotation speed of the pair of cams 44 using a detection sensor. Further, the present embodiment of this disclosure can apply a load with a simpler configuration in comparison with a configuration in which, when the pair of cams 44 is rotated faster than a regulated speed, a frictional resistance member is moved so as to press the frictional resistance member against the drive coupling member 71 to apply a load. Accordingly, the configuration according to the present embodiment can form the load applying device 80 with a less expensive configuration, and therefore can reduce the cost and size of the image forming apparatus 100. Further, by enclosing the torque limiter 72 by the drive side coupling 75*a* and the driven side coupling 71*b*, the configuration according to the present embodiment can restrain an increase in size of the load applying device 80.

Further, in the present embodiment, it is preferable that a spur gear is employed as each gear (i.e., the cam gear 55, the second output gear 54 and the first output gear 53) of the drive device 50 (the drive transmission device 90). In the present embodiment, when the non-pressing state is changed to pressing state, the drive motor 51 is driven and rotated in a direction opposite the rotational direction to change from the pressing state to the non-pressing state. Consequently, each gear (i.e., the cam gear 55, the second output gear 54 and the first output gear 53) of the drive device 50 (the drive transmission device 90) is rotated in a direction opposite the rotational direction to change from the non-pressing state to the pressing state. Therefore, in a case in which each gear of the drive device 50 (the drive transmission device 90) is a helical teeth gear, a force acting in a thrust direction (an axial direction) to change from the non-pressing state to the pressing state and a force acting in the thrust direction (the axial direction) to change from the pressing state to the non-pressing state direct opposite to each other. As a result, each gear of the drive device 50 (the drive transmission device 90) moves different thrust directions in a case of changing from the non-pressing state to the pressing state and in a case of changing from the pressing state to the non-pressing state. Consequently, it is likely that each gear collides a member opposed to the thrust direction, resulting in generation of sound of collision. As an example, when the second output gear 54 that is rotatably supported by the second support shaft 153 is changed from the non-pressing state to the pressing state, the second output gear 54 moves to the second housing 56 to collide with the second housing 56, thereby generating the sound of collision. Further, when the second output gear 54 is changed from the pressing state to the non-pressing state, the second output gear 54 moves to the bracket 52 to collide with the bracket 52, thereby generating the sound of collision.

By contrast, in a case in which each gear of the drive device 50 (the drive transmission device 90) employs a spur gear, the force of the gear does not act in the thrust direction, and therefore each gear is restrained from moving in the thrust direction. Consequently, each gear is restrained from colliding a member opposed to the thrust direction, and therefore generation of a sound of collision is restrained.

Figure 17:
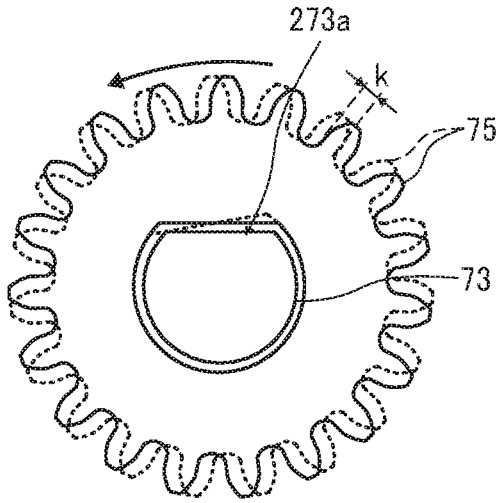
FIG. 17 is a diagram illustrating a case in which the worm wheel is attached to a D-shaped cut portion of the drive shaft with a non-pressed manner.

FIG. 17 is a diagram illustrating a case in which the worm wheel 75 is attached to a D-shaped cut portion 273*a* of the drive shaft 73 with a non-pressing manner.

As illustrated in FIG. 17, in a case in which the worm wheel 75 is attached to the D-shaped cut portion 273*a* of the drive shaft 73 with a non-pressing manner, the worm wheel 75 rattles in the rotational direction by an amount "k" indicated in FIG. 17, relative to the drive shaft 73, as illustrated with a broken line in FIG. 17.

In the present embodiment, before the torque limiter 72 is operated to interrupt the drive transmission, the back torque is transmitted to the drive shaft 73 via the torque limiter 72. As a result, the worm wheel 75 rotates relatively fast by the back torque, and the teeth of a gear teeth portion 75*b* of the worm wheel 75 collide the worm 61. The worm 61 is a member mounted on the motor shaft to directly transmit the drive transmission force to the drive motor 51. Therefore, different from other drive transmission members, the back torque cannot be transmitted to the drive transmission member such as gears disposed on the upstream side of the drive transmitting direction. Therefore, as illustrated in FIG. 17, when the worm wheel 75 is mounted on the D-shaped cut portion 273*a* of the drive shaft 73 with the non-pressing manner and is rattled in the rotational direction, after the teeth of the gear teeth portion 75*b* of the worm wheel 75 have collided to the worm 61, and the worm wheel 75 vibrates in the rotational direction. As a result, the teeth of the gear teeth portion 75*b* of the worm wheel 75 hits against the worm 61 again and again, the noise has been generated.

In order to address this inconvenience, in the present embodiment, the worm wheel 75 is attached to the drive shaft 73 in a pressing manner. According to this operation, the worm wheel 75 is restrained from rattling in the rotational direction to the drive shaft 73. As a result, the worm wheel 75 rotates faster than the rotation drive speed by the back torque. Therefore, after the worm wheel 75 has collided to the worm 61, the worm wheel 75 is prevented from vibrating in the rotational direction and is prevented or restrained from generating noise.

However, in a case of a configuration in which the worm wheel 75 is attached to the drive shaft 73 in the pressing manner, the assembly of the worm wheel 75 to the drive shaft 73 becomes difficult.

In order to address this inconvenience, in the present embodiment, the press-in portion 73*a* of the drive shaft 73 has a substantially D-shaped cross section and has two circular arc faces provided adjacent to each other. The two circular arc faces have different diameters from the axial center of the drive shaft 73, extend in the axial direction of the drive shaft 73, and are aligned in the axial direction of the drive shaft 73. Each of the two circular arc faces is located at the same position in the axial direction of the drive shaft 73 as at least a portion of the cut face (i.e., the flat face) in the axial direction of the cut face (the flat face) that extends parallel to the axial direction of the drive shaft 73. In particular, press-in portion 73*a* according to the present embodiment includes a sloped face that connects the two circular arc faces.

A description is given of the detailed configurations of the worm wheel 75 and the press-in portion 73*a* of the drive shaft 73 with reference to the drawings.

Figure 18:
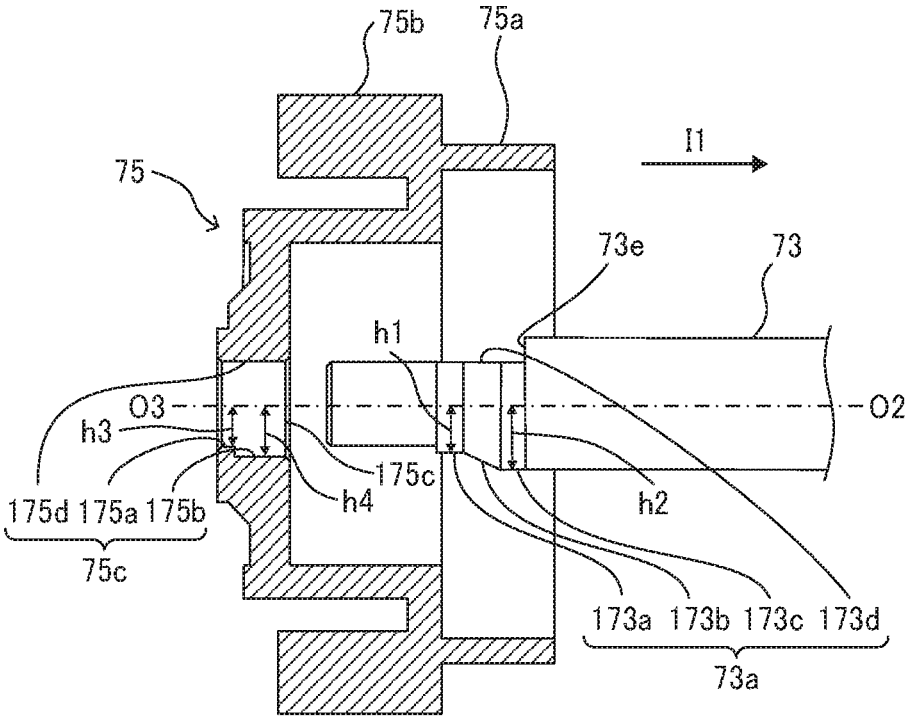
FIG. 18 is a cross sectional view illustrating a drive shaft and the worm wheel.

FIG. 18 is a cross sectional view illustrating the drive shaft 73 and the worm wheel 75.

As illustrated in FIG. 18, the press-in portion 73*a* that is to be pressed to the press-in hole 75*c* of the worm wheel 75 is provided to one end of the drive shaft 73 (i.e., the left end in FIG. 18). The press-in portion 73*a* includes a flat face (a cut face) 173*d*, two circular arc faces, which are a first circular arc face 173*a* and a second circular arc face 173*c*, and a sloped face 173*b*. The flat face (the cut face) 173*d* extends parallel to the axial direction of the drive shaft 73. The first circular arc face 173*a* and the second circular arc face 173*c* are provided at the same position in the axial direction of the drive shaft 73 as at least a portion of the flat face 173*d* in the axial direction of the cut face (the flat face) that extends parallel to the axial direction of the drive shaft 73. The sloped face 173*b* is inclined relative to the axis of the drive shaft 73 to connect the first circular arc face 173*a* and the second circular arc face 173*c*. The two circular arc faces, which are the first circular arc face 173*a* and the second circular arc face 173*c*, have a center of curvature that coincides with an axial center O2 of the drive shaft 73. However, a distance h1 (that corresponds to a radius of curvature) of the first circular arc face 173*a* from the axial center O2 is different from a distance h2 (that corresponds to a radius of curvature) of the second circular arc face 173*c* from the axial center O2. Specifically, the first circular arc face 173*a* is located on an upstream side of an attaching direction of the worm wheel 75 (i.e., on the left side of FIG. 18) and the second circular arc face 173*c* is located on a downstream side of the attaching direction of the worm wheel 75 (i.e., near the center close to the right side of FIG. 18). As illustrated in FIG. 18, the attaching direction is a direction to attach the worm wheel 75 to the drive shaft 73 and indicated by arrow I1 in FIG. 18. A distance h1 is a distance between the first circular arc face 173*a* and the axial center O2 and a distance h2 is a distance between the second circular arc face 173*c* and the axial center O2. The distance h2 of the second circular arc face 173*c* from the axial center O2 is longer (greater) than the distance h1 of the first circular arc face 173*a* from the axial center O2, which is described as h1<h2.

The press-in hole 75*c* of the worm wheel 75, into which the drive shaft 73 is pressed, has an inner circumferential face on which an inner circumferential flat face 175*d*, a first press-in target face 175*a*, and a second press-in target face 175*b* are provided. The inner circumferential flat face 175*d* extends in the axial direction of the worm wheel 75 and contacts the flat face 173*d* of the press-in portion 73*a* of the drive shaft 73. The first circular arc face 173*a* of the drive shaft 73 contacts the first press-in target face 175*a* of the press-in hole 75*c* of the worm wheel 75. The second circular arc face 173*c* of the drive shaft 73 contacts the second press-in target face 175*b* of the worm wheel 75. The first press-in target face 175*a* and the second press-in target face 175*b* have different distances, i.e., a distance h3 and a distance h4, from the axial center O3 of the worm wheel 75 that is to match or to be at the same position as the axial center O2 of the drive shaft 73. When the worm wheel 75 is completely attached to the drive shaft 73, the distance h3 of the first press-in target face 175*a* and the second press-in target face 175*b* and the distance h4 of the second press-in target face 175*b* are different from each other. Specifically, the first press-in target face 175*a* is located on an upstream side of the attaching direction I1 of the worm wheel 75 (i.e., on the left side of FIG. 18) and the second press-in target face 175*b* is located on a downstream side of the attaching direction I1 of the worm wheel 75 (i.e., on the right side of FIG. 18). The first press-in target face 175*a* has a distance h3 from the axial center O3 and the second press-in target face 175*b* has a distance h4 from the axial center O3 from the axial center O3. The distance h4 of the second press-in target face 175*b* from the axial center O3 is longer (greater) than the distance h3 of the first press-in target face 175*a* from the axial center O3, which is described as h3<h4. Further, the worm wheel 75 further includes a tapered portion 175*c* that is disposed at a downstream end of the press-in hole 75*c* on a downstream side of the inserting direction I1 of the worm wheel 75. An inner diameter of the tapered portion 175*c* increases as the tapered portion 175*c* extends toward the downstream side of the inserting direction I1 of the worm wheel 75.

FIGS. 19A, 19B, 19C, 19D, 19E and 19F are diagrams illustrating respective steps when the worm wheel 75 is attached to the drive shaft 73.

Figure 19A:
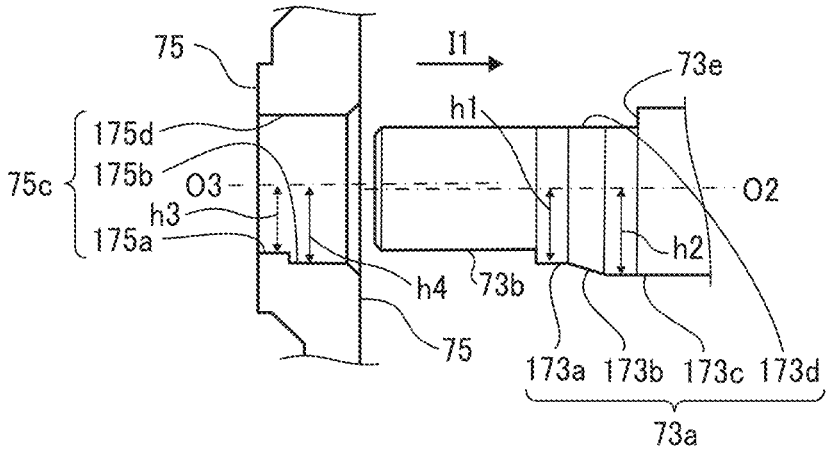
FIGS. 19A through 19F are diagrams illustrating respective steps when the worm wheel is pressed into the drive shaft.
Figure 19B:
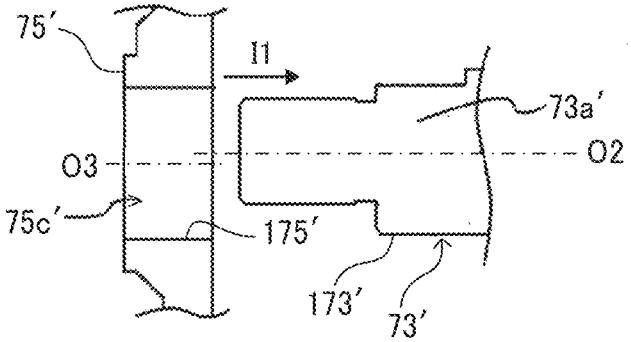
Figure 19C:
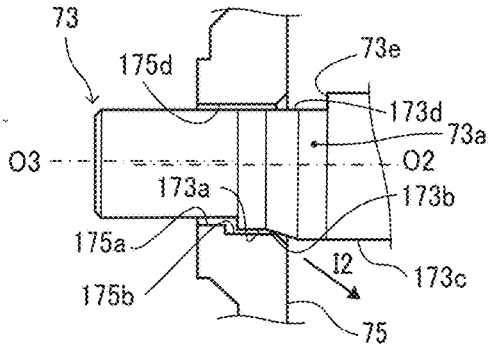
Figure 19D:
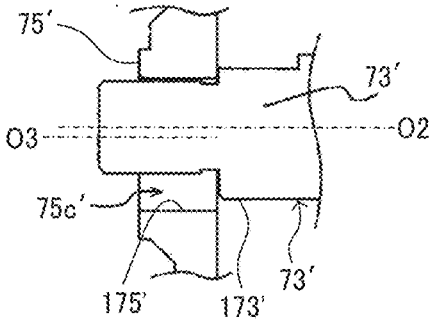
Figure 19E:
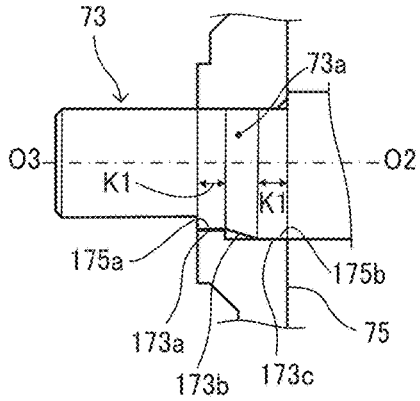
Figure 19F:
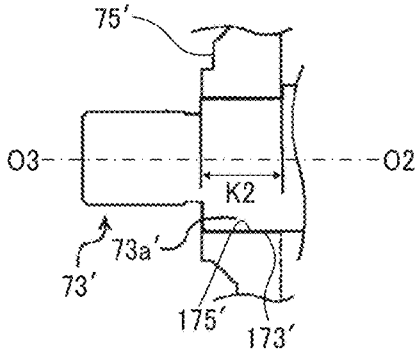

FIGS. 19A, 19C and 19E are diagrams illustrating the steps of attachment of the worm wheel 75 according to the present embodiment. FIGS. 19B, 19D and 19F are diagrams illustrating the steps of attachment of a comparative worm wheel 75'.

In the configuration of the comparative worm wheel 75' illustrated in FIGS. 19B, 19D, and 19F, a press-in portion 73*a'* of a comparative drive shaft 73' is provided with a single circular arc face 173' in an axial direction of the comparative drive shaft 73' and a press-in hole 75*c'* of the comparative worm wheel 75' is provided with a single press-in target face 175'.

As illustrated in FIGS. 19B and 19D, an axial center O2 of the comparative drive shaft 73' and an axial center O3 of the comparative worm wheel 75' are not matched, in other words, are misaligned. Therefore, as the comparative worm wheel 75' is attached to the comparative drive shaft 73', an upper end of the comparative worm wheel 75' on the downstream side of the inserting direction I1 of the comparative worm wheel 75' (i.e., an end portion on the flat face side of the inner circumference of the comparative worm wheel 75') contacts an upper end of the comparative drive shaft 73' on the upstream side of the inserting direction I1 of the comparative worm wheel 75' (i.e., an end portion on the flat face side (the cut face side) of the comparative drive shaft 73'). Therefore, in this case, the comparative worm wheel 75' is moved to the flat face (the cut face) 173' (i.e., an upward direction in FIGS. 19B and 19D), so as to match the axial center O2 of the comparative drive shaft 73' and the axial center O3 of the comparative worm wheel 75'. However, in a case in which the comparative worm wheel 75' is moved to the upward direction in FIGS. 19B and 19D too much, the downstream end of the press-in hole 75*c'* (i.e., the end portion on the press-in target face side) contacts the downstream end of the press-in portion 73*a'* (i.e., the end portion on the circular arc face side). As described above, in the comparative configuration, it is not easy to match the axial center O2 of the comparative drive shaft 73' and the axial center O3 of the comparative worm wheel 75' when the press-in hole 75*c'* is pressed into the press-in portion 73*a'*, and therefore it is not easy to perform a pressing operation of the comparative worm wheel 75' to the comparative drive shaft 73'.

Further, as the downstream side end of the inserting direction I1 of the comparative worm wheel 75' contacts the end portion of the press-in portion 73*a'*, the resistance of the comparative worm wheel 75' increases at attachment of the comparative worm wheel 75' to the comparative press-in portion 73*a'*. However, it is difficult to determine whether the increase of the resistance of the comparative worm wheel 75' is caused by the insertion resistance generated when the press-in portion 73*a'* is pressed into the press-in hole 75*c'* or by the insertion resistance generated when the downstream side end of the comparative worm wheel 75' in the attaching direction contacts the end portion of the press-in portion 73*a'*. Therefore, the cause of the increase of the resistance of the comparative worm wheel 75' is revealed after the press-in hole 75*c'* is pressed to the press-in portion 73*a'* with a certain amount of force. That is, when the comparative worm wheel 75' does not move in the attaching direction even though the comparative worm wheel 75' is pressed to the comparative drive shaft 73' with the certain amount of force, it is known that the downstream side end in the attaching direction I1 of the comparative press-in portion 73*a'* is in contact with the end portion of the press-in portion 73*a'* of the comparative drive shaft 73'.

By contrast, in the present embodiment as illustrated in FIGS. 19A and 19C, as the worm wheel 75 is brought to be attached to the drive shaft 73 in the state in which the axial center O2 of the drive shaft 73 and the axial center O3 of the worm wheel 75 are shifted from each other (in other words, misaligned), the lower end on the downstream side of the attaching direction I1 of the worm wheel 75 contacts the sloped face 173*b* of press-in portion 73*a* of the drive shaft 73. Therefore, as the worm wheel 75 is brought to be attached to the drive shaft 73 in the state in which the lower end on the downstream side of the attaching direction I1 of the worm wheel 75 is in contact with the sloped face 173*b* of press-in portion 73*a* of the drive shaft 73, the worm wheel 75 is moved in a direction indicated by arrow 12 illustrated in FIG. 19C while being guided by the sloped face 173*b*. By so doing, the axial center O2 of the drive shaft 73 and the axial center O3 of the worm wheel 75 come to match with each other. Then, the press-in portion 73*a* is pressed into the press-in hole 75*c* in the state in which the axial center O2 of the drive shaft 73 and the axial center O3 of the worm wheel 75 match with each other.

As described above, in the present embodiment, as the worm wheel 75 is attached to the drive shaft 73, the axial center O2 of the drive shaft 73 and the axial center O3 of the worm wheel 75 are matched automatically. Therefore, when compared with the comparative configuration as illustrated in FIGS. 19C, 19D and 19F, in which the axial center O2 of the comparative drive shaft 73' and the axial center O3 of the comparative worm wheel 75' are matched manually, the worm wheel 75 can be pressed to the drive shaft 73 more easily. Accordingly, easy attachment of the worm wheel 75 to the drive shaft 73 can be achieved.

Further, as illustrated in FIG. 19F, in the comparative configuration, the distance of movement of the comparative worm wheel 75' while being pressed (hereinafter, referred to as a "press-in moving distance") is equal to an axial length K2 of the comparative press-in portion 73*a'* in the axial direction over the entire area of the flat face (i.e., the cut face). By contrast, in the present embodiment, a press-in moving distance corresponds to an axial length K1 of a given area of the flat face (the cut face) corresponding to the first circular arc face 173*a* and the second circular arc face 173*c*, which are shorter (smaller) than the axial length K2 of the press-in portion 73*a*. Therefore, the press-in moving distance in the configuration of the present embodiment can be shorter than a press-in moving distance in the comparative configuration. In the configuration of the present embodiment, the press-in portion 73*a* is provided with multiple circular arc faces, which are the first circular arc face 173*a* and the second circular arc face 173*c*, having different distances from the axial center O2 of the drive shaft 73 and the press-in hole 75*c* is provided with the multiple press-in target faces having different distances from the axial center O3 of the worm wheel 75. Therefore, the multiple press-in target faces of the worm wheel 75 are pressed to the corresponding multiple circular arc faces (i.e., the first circular arc face 173*a* and the second circular arc face 173*c*) of the drive shaft 73 simultaneously. As described above, since the press-in moving distance can be reduced, the time to press the worm wheel 75 to the drive shaft 73 with great force can be also reduced, and therefore the worm wheel 75 can be attached to the drive shaft 73 more easily.

Further, in the present embodiment, the press-in hole 75*c* of the worm wheel 75 to be pressed into the drive shaft 73 has two portions, which are a portion having the first press-in target face 175*a* in the axial direction and a portion having the second press-in target face 175*b* in the axial direction. Accordingly, the portion to be pressed to the drive shaft 73 according to the present embodiment is smaller than the comparative configuration in which the drive shaft 73' is pressed to the entire inner circumferential face of the press-in hole 75*c*'. However, in the present embodiment, press-in target faces are formed at both axial ends of the press-in hole 75*c*. Therefore, even if a portion of the worm wheel 75 to be pressed is smaller, the worm wheel 75 can be pressed in and fixed to the drive shaft 73 without tilting. Accordingly, the worm wheel 75 can be meshed with the worm wheel 75 preferably.

Further, in the present embodiment, the tapered portion 175*c* having the inner diameter increasing toward the downstream side end of the attaching direction of the worm wheel 75 to the drive shaft 73 is provided at the downstream side end of the attaching direction of the worm wheel 75. According to this configuration, when the support 73*b* of the drive shaft 73 is inserted into the press-in hole 75*c* of the worm wheel 75, the support 73*b* of the drive shaft 73 is guided to the tapered portion 175*c* guides toward the press-in hole 75*c* of the worm wheel 75. Accordingly, the support 73*b* of the drive shaft 73 is easily inserted to the press-in hole 75*c* of the worm wheel 75.

Figure 20A:
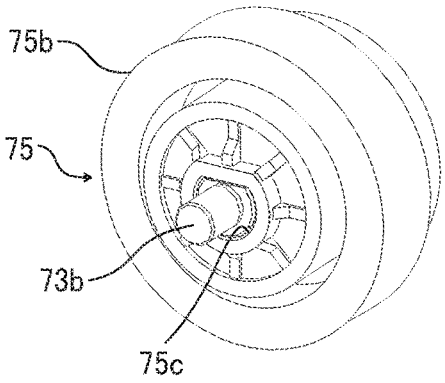
FIGS. 20A and 20B are perspective views illustrating the worm wheel pressed into the drive shaft.
Figure 20B:
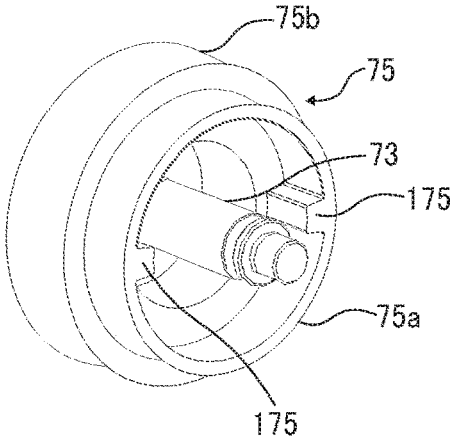
Figure 21A:
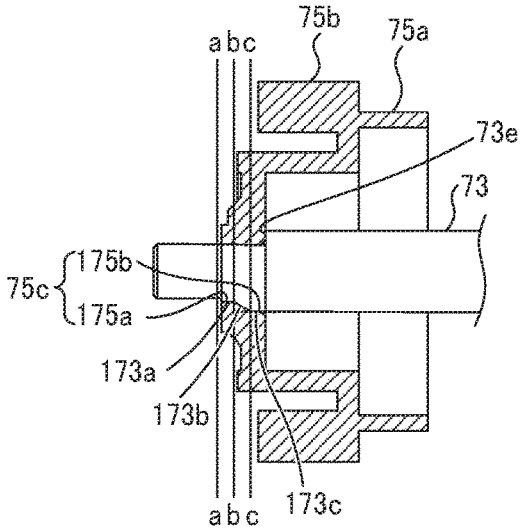
FIG. 21A is a lateral cross sectional view illustrating the worm wheel pressed into the drive shaft.
Figure 21B:
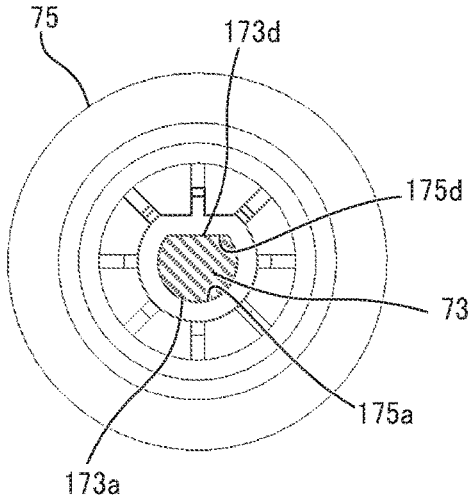
FIG. 21B is a cross sectional view of the worm wheel pressed into the drive shaft, along a line a-a of FIG. 21A.
Figure 21C:
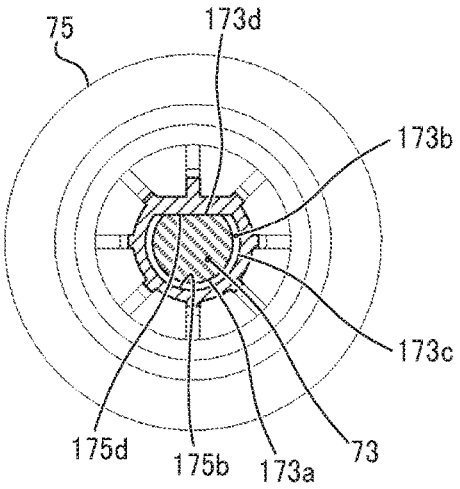
FIG. 21C is a cross sectional view of the worm wheel pressed into the drive shaft, along a line b-b of FIG. 21A.
Figure 21D:
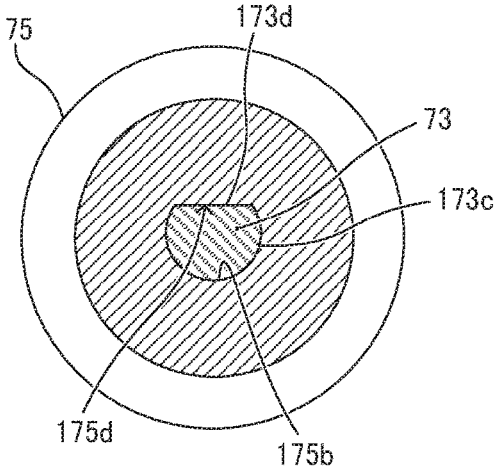
FIG. 21D is a cross sectional view of the worm wheel pressed into the drive shaft, along a line c-c of FIG. 21A.

Further, FIGS. 20A and 20B are perspective views illustrating the worm wheel 75 attached to the drive shaft 73. Specifically, FIG. 20A is a perspective view illustrating the worm wheel 75, viewed from a side from which the drive shaft 73 is attached to the worm wheel 75 and FIG. 20B is a perspective view illustrating the worm wheel 75, viewed from an opposite side to the side from which the drive shaft 73 is attached to the worm wheel 75 of FIG. 20A. FIG. 21A is a lateral cross sectional view illustrating the worm wheel 75 attached to the drive shaft 73. FIG. 21B is a cross sectional view of the worm wheel 75 attached to the drive shaft 73, along a line a-a of FIG. 21A. FIG. 21C is a cross sectional view of the worm wheel 75 attached to the drive shaft 73, along a line b-b of FIG. 21A. FIG. 21D is a cross sectional view of the worm wheel 75 attached to the drive shaft 73, along a line c-c of FIG. 21A.

There are cases in which the axial length of the second circular arc face 173*c* and the axial length of the sloped face 173*b* are shifted from a specified length, due to manufacturing errors. There may be a configuration in which a different sloped face is provided between the first press-in target face 175*a* and the second press-in target face 175*b* of the press-in hole 75*c* of the worm wheel 75 so that the different sloped face contacts the sloped face 173*b* of the press-in portion 73*a*. With this configuration, in a case in which the entire inner circumferential face of the press-in hole 75*c* is brought to contact the press-in portion 73*a* of the drive shaft 73, even if such manufacturing errors are made to this configuration, the press-in portion 73*a* cannot be pressed into the worm wheel 75 entirely. As an example, in a case in which the length of the second circular arc face 173*c* becomes longer (greater) than a specified length, the sloped face 173*b* of the press-in portion 73*a* makes surface contact to the different sloped face of the press-in hole 75*c* of the worm wheel 75 before the press-in portion 73*a* of the drive shaft 73 is entirely pressed into the press-in hole 75*c* of the worm wheel 75. As a result, the press-in portion 73*a* of the drive shaft 73 cannot be pressed in further to the worm wheel 75. If the press-in portion 73*a* of the drive shaft 73 cannot be entirely pressed into the press-in hole 75*c* of the worm wheel 75, the end face of the worm wheel 75 cannot contact a step 73*e* of the drive shaft 73 that stands up in a normal direction from the end portion of the press-in portion 73*a* on the downstream side of the attaching direction portion of the worm wheel 75. As a result, the worm wheel 75 cannot be positioned at the specified position in the axial direction, and therefore it is not likely that the worm wheel 75 is meshed with the worm 61 preferably.

By contrast, in the present embodiment, as illustrated in FIGS. 21A through 21D, in a state in which the worm wheel 75 is attached to the drive shaft 73, the inner wall face of press-in hole 75*c* of the worm wheel 75 has a gap with the sloped face 173*b* of the press-in portion 73*a* of the drive shaft 73, and therefore the worm wheel 75 is not in contact with the sloped face 173*b* of the press-in portion 73*a* of the drive shaft 73. Therefore, even when the axial lengths of the first circular arc face 173*a*, the second circular arc face 173*c*, and the sloped face 173*b* are different relative to the specified lengths due to manufacturing error, the press-in portion 73*a* of the drive shaft 73 can be pressed into the press-in hole 75*c* of the worm wheel 75 entirely. It is to be noted that, in the present embodiment, in a case in which the position in the axial direction of the sloped face 173*b* is shifted to the upstream side of the attaching direction of the worm wheel 75, the downstream side of the first press-in target face 175*a* in the attaching direction of the worm wheel 75 is elastically deformed, and the sloped face 173*b* bites or is pressed into the inside of the first press-in target face 175*a*. Accordingly, the press-in portion 73*a* of the drive shaft 73 is pressed into the press-in hole 75*c* of the worm wheel 75 entirely. At this time, in order to cause the sloped face 173*b* to smoothly enter the inside of the first press-in target face 175*a*, it is preferable that the angle of inclination of the sloped face 173*b* is relatively smaller.

As described above, the press-in hole 75*c* is formed to provide a gap between the worm wheel 75 and the sloped face 173*b* of the press-in portion 73*a* of the drive shaft 73 in the state in which the worm wheel 75 is attached to the drive shaft 73. According to this configuration, even if there is a manufacturing error (or manufacturing errors), the worm wheel 75 is brought to contact the step 73*e*, and therefore the worm wheel 75 can be positioned at the specified position in the axial direction. As a result, the worm wheel 75 can be meshed with the worm 61 preferably.

Figure 22A:
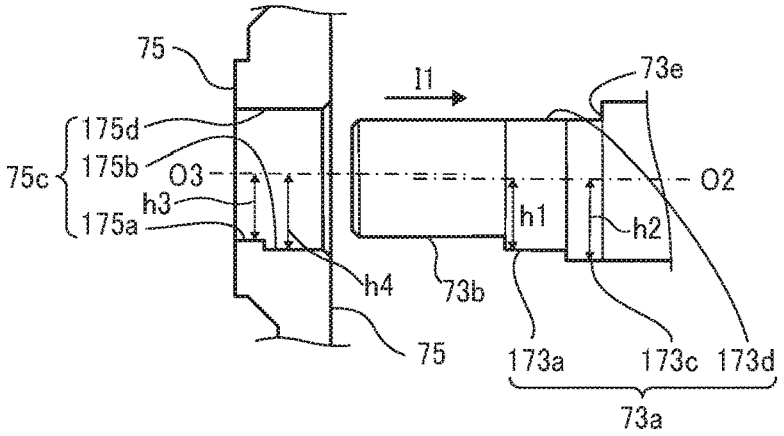
FIGS. 22A, 22B and 22C are diagrams illustrating an example in which a press-in portion is not mounted on a sloped face.
Figure 22B:
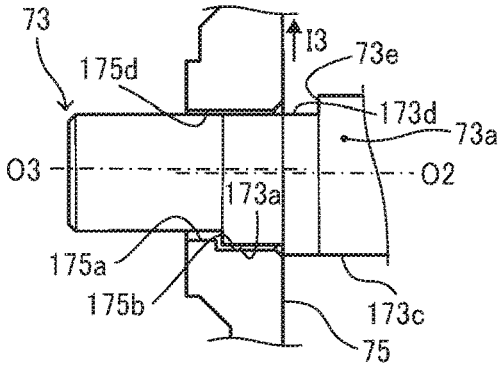
Figure 22C:
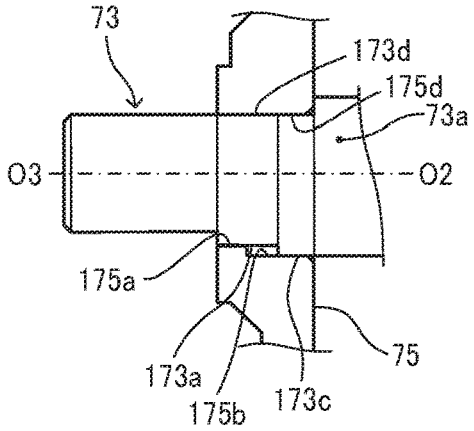

FIGS. 22A, 22B and 22C are diagrams illustrating an example in which the press-in portion 73*a* without the sloped face 173*b*.

As illustrated in FIGS. 22A and 22B, in the state in which the axial center O3 of the worm wheel 75 is shifted from the axial center O2 of the drive shaft 73, as the worm wheel 75 is brought to be attached to the drive shaft 73, the downstream side end of the worm wheel 75 in the attaching direction of the worm wheel 75 contacts the upstream side end of the second circular arc face 173*c* in the attaching direction of the second circular arc face 173*c*. However, at this time, the press-in portion 73*a* is inserted into a part of the press-in hole 75*c* of the worm wheel 75. Therefore, by moving the worm wheel 75 in a direction indicated by arrow 13 illustrated in FIG. 22B (i.e., the upward direction in FIG. 22B) and contacting the flat face (the cut face) 173*d* of the press-in portion 73*a* to the inner circumferential flat face 175*d* of the press-in hole 75*c*, the axial center O3 of the worm wheel 75 and the axial center O2 of the drive shaft 73 can be matched. Then, as the worm wheel 75 is moved in the axial direction, the press-in portion 73*a* is pressed into the press-in hole 75*c* of the drive shaft 73 in the state in which the axial center O3 of the worm wheel 75 is matched to the axial center O2 of the drive shaft 73. Accordingly, the worm wheel 75 can be easily attached to the drive shaft 73.

In the present embodiment, both the first press-in target face 175*a* and the second press-in target face 175*b* provided to the press-in hole 75*c* of the worm wheel 75 are circular arc faces that contact the first circular arc face 173*a* and the second circular arc face 173*c* of the press-in portion 73*a*, respectively, over the entire circumferential direction of the first circular arc face 173*a* and the second circular arc face 173*c*. According to this configuration, a relatively large contact area is provided between the first press-in target face 175*a* and the first circular arc face 173*a* and another relatively large area is provided between the second press-in target face 175*b* and the second circular arc face 173*c*. Therefore, in this configuration, the worm wheel 75 does not come off from the drive shaft 73 easily.

However, the configuration of the first press-in target face 175*a* and the second press-in target face 175*b* provided to the press-in hole 75*c* is not limited to this configuration.

For example, the configuration of the first press-in target face 175*a* provided to the press-in hole 75*c* may be arranged as illustrated in FIGS. 23A through 30. It is to be noted that the configuration of the second press-in target face 175*b* provided to the press-in hole 75*c* may also be arranged as the configuration of the first press-in target face 175*a*.

Figure 23A:
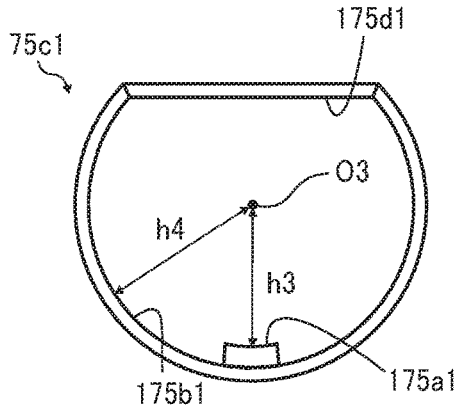
FIGS. 23A, 23B and 23C are diagrams illustrating Configuration Example 1 of a first press-in target face provided to a press-in hole.
Figure 23B:
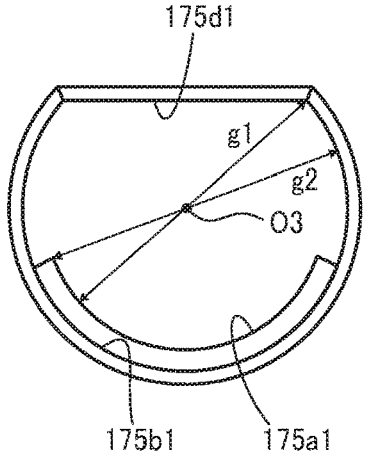
Figure 23C:
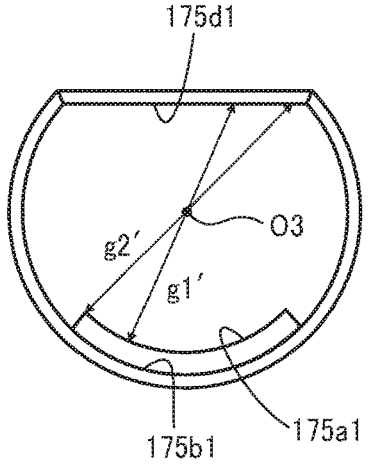

FIGS. 23A through 23C are diagrams illustrating Configuration Example 1 of a first press-in target face 175*a*1 provided to a press-in hole 75*c*1 of the worm wheel 75.

In Configuration Example 1 illustrated in FIGS. 23A through 23C, the press-in hole 75*c*1 has the first press-in target face 175*a*1, a second press-in target face 175*b*1, and an inner circumferential flat face 175*d*1. The first press-in target face 175*a*1 provided to the press-in hole 75*c*1 of the worm wheel 75 of Configuration Example 1 is formed as a circular arc face that contacts a portion of the first circular arc face 173*a* in the circumferential direction of the press-in portion 73*a*. In FIG. 23A, "h3" represents a distance from the axial center O3 of the worm wheel 75 to the first press-in target face 175*a*1 and "h4" represents a distance from the axial center O3 of the worm wheel 75 to the second press-in target face 175*b*1. In FIG. 23B, "g1" represents a distance between a measurement point on the first press-in target face 175*a*1 in the circumferential direction and an opposing point on the inner wall face that faces the measurement point across the axial center O3, which corresponds to a length of a straight line passing through the axial center O3 and connecting the measurement point and the opposing point and "g2" represents a distance between a different measurement point on the first press-in target face 175*a*1 in the circumferential direction and a different opposing point on the inner wall face that faces the different measurement point across the axial center O3, which corresponds to a length of another straight line passing through the axial center O3 and connecting the different measurement point and the different opposing point. In FIG. 23C, "g1"" represents a distance between a measurement point on one of the first press-in target face 175*a* different from the distance g1 and "g2"" represents a distance between a different measurement point on the first press-in target face 175*a* different from the distance g2.

According to this configuration, the resistance generated when the press-in portion 73*a* of the drive shaft 73 is pressed into the press-in hole 75*c*1 of the worm wheel 75 is smaller than the configuration in which the first press-in target face 175*a* has a circular arc face that contacts the entire area of the first circular arc face 173*a* in the circumferential direction. Accordingly, easy attachment of the worm wheel 75 to the drive shaft 73 can be achieved.

As illustrated in FIG. 23A, in a case in which the first press-in target face 175*a*1 is a contact face that contacts part in the circumferential direction of the first circular arc face 173*a* of the press-in portion 73*a*, it is likely that backlash is generated in a direction perpendicular to the attaching direction. Such backlash may cause rotational unevenness of the worm wheel 75 or generate abnormal sound due to contact of the worm wheel 75 and the drive shaft 73. Even in such a case, for example, as illustrated in FIGS. 23B and 23C, the length of the first press-in target face 175*a*1 in the circumferential direction of the first circular arc face 173*a* is increased to be longer than the length of the first press-in target face 175*a*1 illustrated in FIG. 23A. By increasing the length of the first press-in target face 175*a*1, backlash is restrained, and the rotational unevenness and abnormal sound are prevented. By increasing the number of the first press-in target face 175*a*1 in the circumferential direction of the first circular arc face 173*a*, backlash and other inconveniences may be restrained without increasing the length of the first press-in target face 175*a*1. However, the smaller number of the first press-in target face 175*a*1 reduces the manufacturing processes of the first press-in target face 175*a*1, and the configuration of Configuration Example 1 is better in regard to manufacturing cost.

Figure 24:
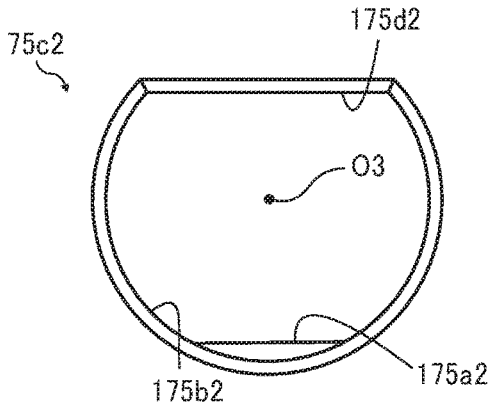
FIG. 24 is a diagram illustrating Configuration Example 2 of the first press-in target faces provided to the press-in hole.

FIG. 24 is a diagram illustrating Configuration Example 2 of a first press-in target face 175*a*2 provided to a press-in hole 75*c*2 of the worm wheel 75.

In Configuration Example 2 illustrated in FIG. 24, the press-in hole 75*c*2 has the first press-in target face 175*a*2, a second press-in target face 175*b*2, and an inner circumferential flat face 175*d*2. The first press-in target face 175*a*2 provided to the press-in hole 75*c*2 of the worm wheel 75 of Configuration Example 2 is formed as a flat face that contacts a portion of the first circular arc face 173*a* in the circumferential direction of the press-in portion 73*a*. Similar to the first press-in target face 175*a*1 of Configuration Example 1, the first press-in target face 175*a*2 of Configuration Example 2 contributes to a reduction in the resistance generated when the press-in portion 73*a* of the drive shaft 73 is pressed into the press-in hole 75*c*2 of the worm wheel 75 when compared with the configuration in which the first press-in target face 175*a* has a circular arc face that contacts the entire area of the first circular arc face 173*a* in the circumferential direction. In other words, the resistance generated when the press-in portion 73*a* of the drive shaft 73 is pressed into the press-in hole 75*c*2 of the worm wheel 75 is smaller than the configuration including the first press-in target face 175*a* having a circular arc face that contacts the entire area of the first circular arc face 173*a* in the circumferential direction. Accordingly, easy attachment of the worm wheel 75 to the drive shaft 73 can be achieved. Further, the first press-in target face 175*a*2 of Configuration Example 2 is processed more easily than the first press-in target face 175*a*1 of Configuration Example 1 illustrated in FIGS. 23A through 23C.

Figure 25:
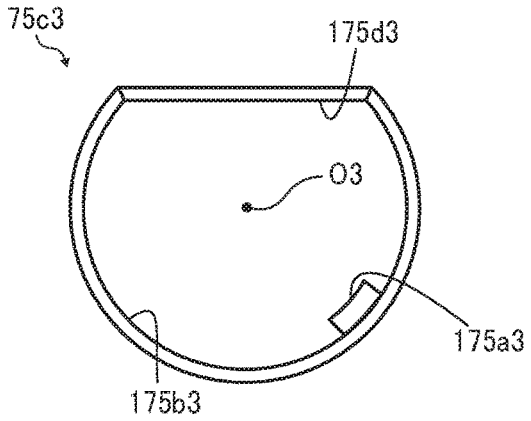
FIG. 25 is a diagram illustrating Configuration Example 3 of the first press-in target face provided to the press-in hole.

FIG. 25 is a diagram illustrating Configuration Example 3 of a first press-in target face 175*a*3 provided to a press-in hole 75*c*3 of the worm wheel 75.

In Configuration Example 3 illustrated in FIG. 25, the press-in hole 75*c*3 has the first press-in target face 175*a*3, a second press-in target face 175*b*3, and an inner circumferential flat face 175*d*3. The first press-in target face 175*a*3 provided to the press-in hole 75*c*3 of the worm wheel 75 of Configuration Example 3 is formed as a circular arc face that contacts a portion of the first circular arc face 173*a* in the circumferential direction of the press-in portion 73*a*. Different from the first press-in target face 175*a*1 of Configuration Example 1 in FIG. 23A, the first press-in target face 175*a*3 is located to one side of the press-in hole 75*c*3 divided by a line perpendicular to the flat face (the cut face) 173*d* of the press-in portion 73*a* of the drive shaft 73 (i.e., a line extending in a vertical direction in FIG. 25 to pass through the axial center O3 of the worm wheel 75) on a plane perpendicular to the axial direction of the worm wheel 75. In this case, the pressing force to press the flat face (the cut face) 173*d* of the press-in portion 73*a* to the inner circumferential flat face 175*d*3 of the press-in hole 75*c*3 becomes uneven in the press-in hole 75*c*3, and it is likely to generate backlash or assembly error.

Consequently, it is preferable to provide a configuration including two or more first press-in target faces 175*a*.

Figure 26:
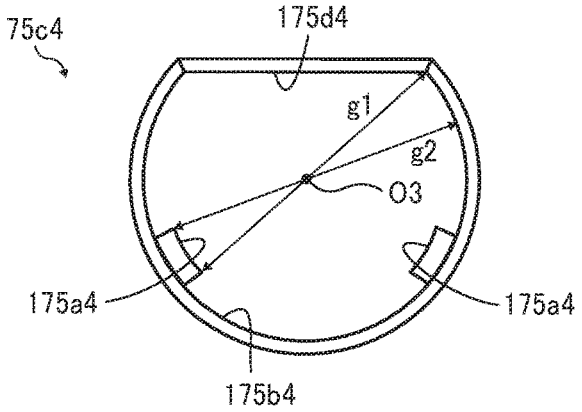
FIG. 26 is a diagram illustrating Configuration Example 4 of the first press-in target faces provided to the press-in hole.

FIG. 26 is a diagram illustrating Configuration Example 4 of two first press-in target faces 175*a*4 provided to a press-in hole 75*c*4 of the worm wheel 75.

In Configuration Example 4 illustrated in FIG. 26, the press-in hole 75*c*4 has the two first press-in target faces 175*a*4, a second press-in target face 175*b*4, and an inner circumferential flat face 175*d*4. The two first press-in target faces 175*a*4 provided to the press-in hole 75*c*4 of the worm wheel 75 of Configuration Example 4 are formed as two circular arc faces that contacts two different portions of the first circular arc face 173*a* in the circumferential direction of the press-in portion 73*a*. Similar to the first press-in target face 175*a*1 of Configuration Example 1 and the first press-in target face 175*a*2 of Configuration Example 2, the two first press-in target faces 175*a*4 contribute to a reduction in the resistance generated when the press-in portion 73*a* of the drive shaft 73 is pressed into the press-in hole 75*c*4 of the worm wheel 75 when compared with the configuration in which the first press-in target face 175*a* has a circular arc face that contacts the entire area of the first circular arc face 173*a* in the circumferential direction. In other words, the resistance generated when the press-in portion 73*a* of the drive shaft 73 is pressed into the press-in hole 75*c*4 of the worm wheel 75 is smaller than the configuration including the first press-in target face 175*a* having a circular arc face that contacts the entire area of the first circular arc face 173*a* in the circumferential direction. Moreover, different from the first press-in target face 175*a*3 of Configuration Example 3 in FIG. 25, the two first press-in target faces 175*a*4 are located on both sides of the press-in hole 75*c*4 divided by a line as a symmetry axis perpendicular to the flat face (the cut face) 173*d* of the press-in portion 73*a* of the drive shaft 73 (i.e., a line extending as a symmetry axis in a vertical direction in FIG. 26 to pass through the axial center O3 of the worm wheel 75) on a plane perpendicular to the axial direction of the worm wheel 75. Therefore, unevenness of the pressing force to press the flat face (the cut face) 173*d* of the press-in portion 73*a* to the inner circumferential flat face 175*d*4 of the press-in hole 75*c*4 is restrained, and therefore backlash or assembly error is restrained or prevented. Especially, as in Configuration Example 4 illustrated in FIG. 26, the configuration in which the two first press-in target faces 175*a*4 are disposed in line symmetrical positions with respect to the symmetry axis extending in the vertical direction in FIG. 26 acquires a higher effect of the above-described advantages.

In addition, as described in Configuration Examples 1, 2, and 3, in a case in which the first press-in target face 175*a* (i.e., the first press-in target face 175*a*1, 175*a*2, or 175*a*3) of the press-in hole 75*c* (i.e., the press-in hole 75*c*1, 75*c*2, or 75*c*3) contacts one portion in the circumferential direction of the first circular arc face 173*a* of the press-in portion 73*a*, the worm wheel 75 supports the drive shaft 73 at two portions, which are the inner circumferential flat face 175*d* (i.e., the inner circumferential flat face 175*d*1, 175*d*2, or 175*d*3) and the first press-in target face 175*a* (i.e., the first press-in target face 175*a*1, 175*a*2, or 175*a*3). Therefore, it is likely that backlash or play is generated even after the press-in portion 73*a* is pressed into the press-in hole 75*c* (i.e., the press-in hole 75*c*1, 75*c*2, or 75*c*3).

With Configuration Example 4 illustrated in FIG. 26 in which the two first press-in target faces 175*a*4 (specifically, two or more first press-in target faces 175*a*4) contact two (or more) portions in the circumferential direction of the first circular arc face 173*a* of the press-in portion 73*a*, the worm wheel 75 supports the drive shaft 73 at three (or more) portions, which are the inner circumferential flat faces 175*d*4 and the two (or more) first press-in target faces 175*a*4. Therefore, Configuration Example 4 restrains generation of backlash after the press-in portion 73*a* is pressed into the press-in hole 75*c*4.

Figure 27:
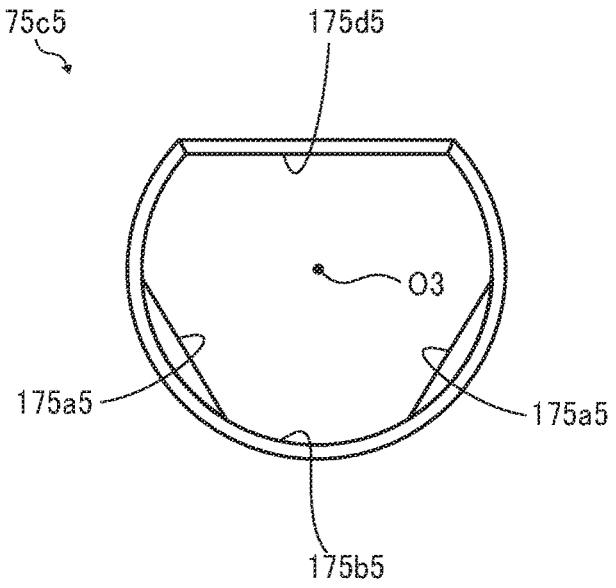
FIG. 27 is a diagram illustrating Configuration Example 5 of the first press-in target faces provided to the press-in hole.

Further, Configuration Example 5 illustrated in FIG. 27 may be provided.

FIG. 27 is a diagram illustrating Configuration Example 5 of two first press-in target faces 175*a*5 provided to a press-in hole 75*c*5 of the worm wheel 75.

In Configuration Example 5 illustrated in FIG. 27, the press-in hole 75*c*5 has the two first press-in target faces 175*a*5, a second press-in target face 175*b*5, and an inner circumferential flat face 175*d*5. The two first press-in target faces 175*a*5 provided to the press-in hole 75*c*5 of the worm wheel 75 of Configuration Example 5 are formed as two flat faces that contacts two different portions of the first circular arc face 173*a* in the circumferential direction of the press-in portion 73*a*. Further, the first press-in target faces 175*a*5 of Configuration Example 5 acquires the same effect as the first press-in target faces 175*a*4 of Configuration Example 5 and are processed easily.

Here, for example, an inspection of the first press-in target face 175*a* may be conducted to measure a distance of the first press-in target face 175*a* and an inner wall face of the press-in hole 75*c* opposed to first press-in target face 175*a* and check whether the distance measured falls within a specified range. In such a case, if the result of the inspection significantly varies as a measurement point (i.e., a point in a circumferential direction of the worm wheel 75) on the first press-in target face 175*a* is changed, it is difficult to perform an appropriate inspection. Further, Configuration Example 6 illustrated in FIG. 28 may be provided.

Figure 28:
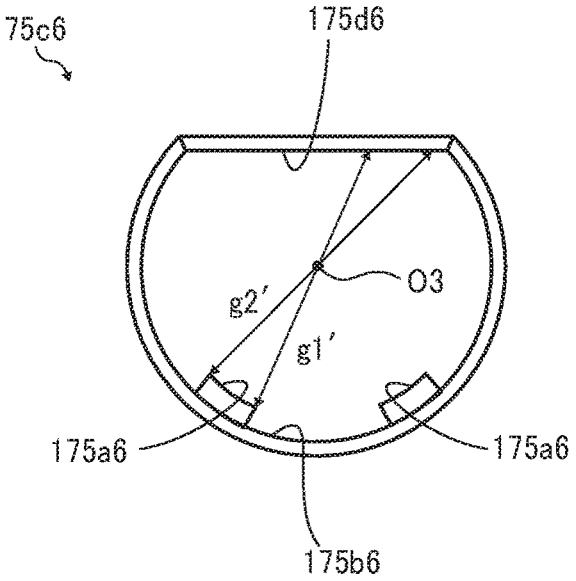
FIG. 28 is a diagram illustrating Configuration Example 6 of the first press-in target faces provided to the press-in hole.

FIG. 28 is a diagram illustrating Configuration Example 6 of two first press-in target faces 175*a*6 provided to a press-in hole 75*c*6 of the worm wheel 75. In Configuration Example 6 illustrated in FIG. 28, the press-in hole 75*c*6 has the two first press-in target faces 175*a*6, a second press-in target face 175*b*6, and an inner circumferential flat face 175*d*6. Specifically, in a case in which Configuration Example 6 illustrated in FIG. 28 includes a configuration in which the inner wall face of the press-in hole 75*c*6 facing the first press-in target faces 175*a*, each having a circular arc face corresponds to the inner circumferential flat face 175*d*6, as the measurement point on each of the first press-in target faces 175*a*6 changes, the distance g1' between the measurement point and the opposing point on the inner wall face of the press-in hole 75*c*6 along a straight line passing through the axial center O3 and connecting the measurement point and the opposing point becomes different from the distance g2' between a different measurement point and a different opposing point on the inner wall face of the press-in hole 75*c*6 along another straight line passing through the axial center O3 and connecting the different measurement point and the different opposing point. By contrast, in Configuration Example 4 illustrated in FIG. 26, the first press-in target face 175*a*4 has a circular arc face and the inner wall face of the press-in hole 75*c*4 opposing the first press-in target face 175*a*4 also has a circular arc face. The first press-in target face 175*a*4 and the inner wall face of the press-in hole 75*c*4 have the same center of curvature and the radius of curvature that is approximated. Therefore, no matter where the measurement point in the circumferential direction of the first press-in target face 175*a*4 is chosen, the distance g1 between the measurement point and the opposing point on the inner wall face of the press-in hole 75*c*4 along a straight line passing through the axial center O3 and connecting the measurement point and the opposing point is substantially same as the distance g2 between the different measurement point and the different opposing point on the inner wall face of the press-in hole 75*c*4 along another straight line passing through the axial center O3 and connecting the different measurement point and the different opposing point. Therefore, it is advantageous in performing an appropriate inspection of the first press-in target face 175*a*.

Figure 29:
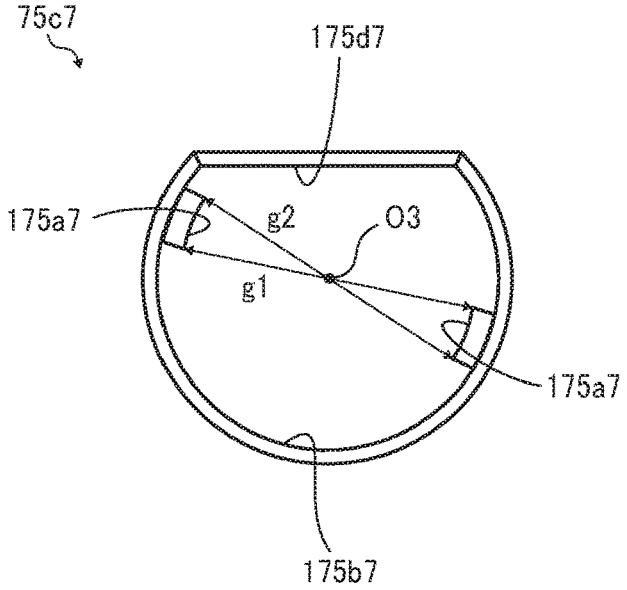
FIG. 29 is a diagram illustrating Configuration Example 7 of the first press-in target faces provided to the press-in hole.

FIG. 29 is a diagram illustrating Configuration Example 7 of two first press-in target faces 175*a*7 provided to a press-in hole 75*c*7 of the worm wheel 75.

In Configuration Example 7 illustrated in FIG. 29, the press-in hole 75*c*7 has the two first press-in target faces 175*a*7, a second press-in target face 175*b*7, and an inner circumferential flat face 175*d*7. The two first press-in target faces 175*a*7 provided to the press-in hole 75*c*7 of the worm wheel 75 of Configuration Example 7 are formed as two circular arc faces that contacts two different portions of the first circular arc face 173*a* in the circumferential direction of the press-in portion 73*a*.

Figure 30:
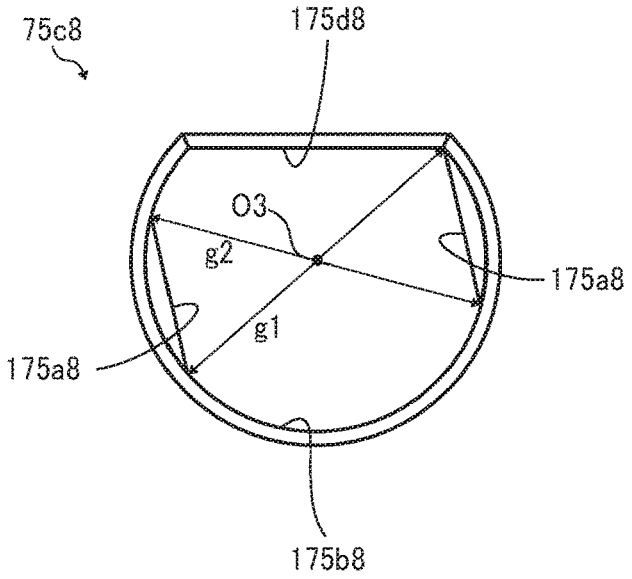
FIG. 30 is a diagram illustrating Configuration Example 8 of the first press-in target faces provided to the press-in hole.

Further, FIG. 30 is a diagram illustrating Configuration Example 8 of two first press-in target faces 175*a*8 provided to a press-in hole 75*c*8 of the worm wheel 75.

In Configuration Example 8 illustrated in FIG. 30, the press-in hole 75*c*8 has the two first press-in target faces 175*a*8, a second press-in target face 175*b*8, and an inner circumferential flat face 175*d*8. In Configuration Example 8 illustrated in FIG. 30, the two first press-in target faces 175*a*8 provided to the inner wall face of the press-in hole 75*c*8 of the worm wheel 75 are formed as two flat faces that contacts two different portions of the first circular arc face 173*a* in the circumferential direction of the press-in portion 73*a*. The two first press-in target faces 175*a*8 are opposed to each other across the axis center O3 of the worm wheel 75.

In Configuration Example 7 and Configuration Example 8, even though any point in the circumferential direction of one of the first press-in target faces 175*a* is selected as a measurement position, the distance g1 between the measurement position and the opposed position at which a straight line passing through the measurement position and the axial center O3 intersects with the inner wall face of the press-in hole 75*c* (i.e., the other of the first press-in target faces 175*a*) and the distance g2 between another measurement position of the one of the first press-in target faces 175*a* and the opposed position at which a straight line passing through the measurement position and the axial center O3 intersects with the inner wall face of the press-in hole 75*c* (i.e., the other of the first press-in target faces 175*a*) are substantially same as each other. Therefore, it is advantageous in performing an appropriate inspection of the first press-in target face 175*a*.

In Configuration Example 7 and Configuration Example 8, the two first press-in target faces 175*a* (i.e., the two first press-in target faces 175*a*7 or the two first press-in target faces 175*a*8) are disposed on the inner wall face of the press-in hole 75*c* of the worm wheel 75 while facing each other across the axial center O3. Specifically, when one of the first press-in target faces 175*a* is disposed below a line parallel to the inner circumferential flat face 175*d* (i.e., the inner circumferential flat face 175*d*7 or the inner circumferential flat face 175*d*8) of the press-in hole 75*c* (corresponding to the flat face (the cut face) 173*d* of the press-in portion 73*a*) and passing through the axial center O3 within a plane perpendicular to the axial direction of the worm wheel 75, the other of the first press-in target faces 175*a* is disposed above the line. In this case, the pressing force to press the flat face (the cut face) 173*d* of the press-in portion 73*a* against the inner circumferential flat face 175*d* of the press-in hole 75*c* is also applied to the other of the first press-in target faces 175*a*. As a result, the pressing force to press the flat face (the cut face) 173*d* of the press-in portion 73*a* against the inner circumferential flat face 175*d* of the press-in hole 75*c* becomes uneven in the press-in hole 75*c*, and it is likely to generate backlash or assembly error.

Next, a description is given of a drive transmission device to transmit a driving force of a sheet ejection motor to the pair of sheet ejecting rollers 20.

Figure 31:
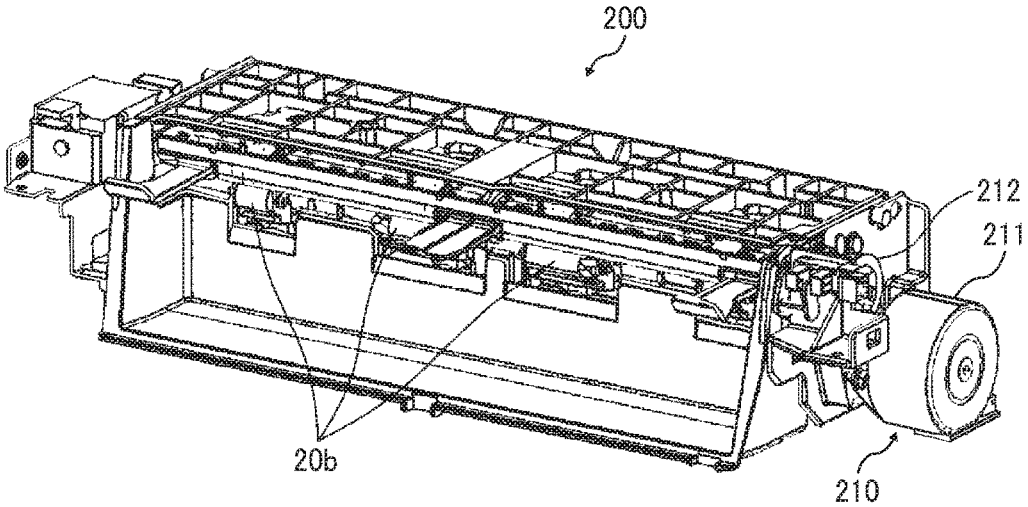
FIG. 31 is a perspective view illustrating a sheet ejection unit.
Figure 32:
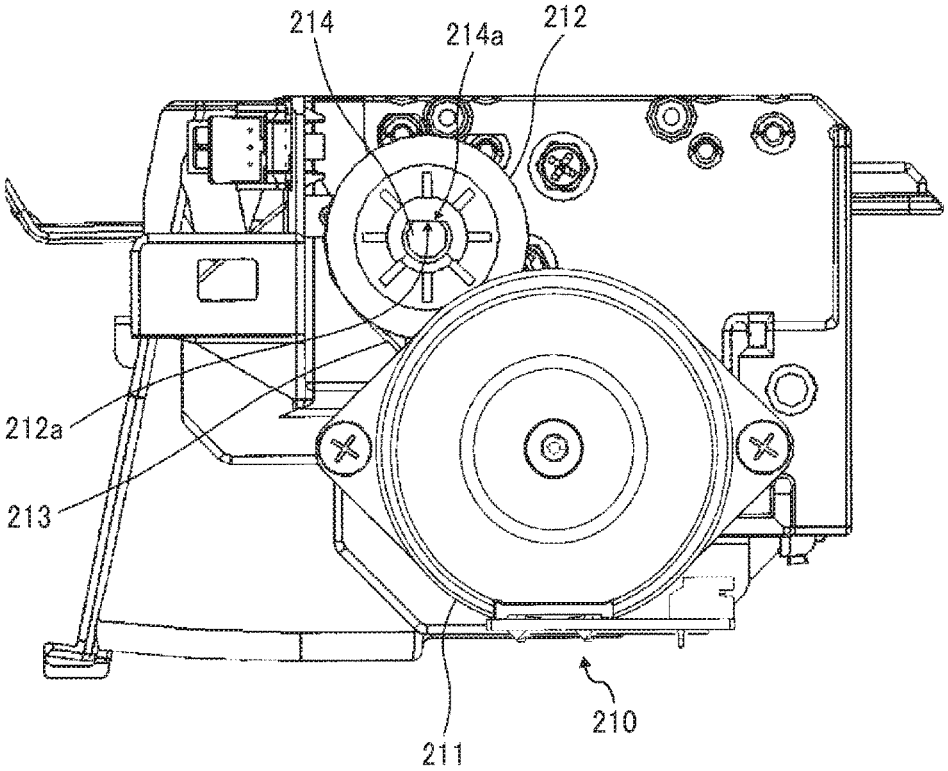
FIG. 32 is a side view illustrating the sheet ejection unit.
Figure 33:
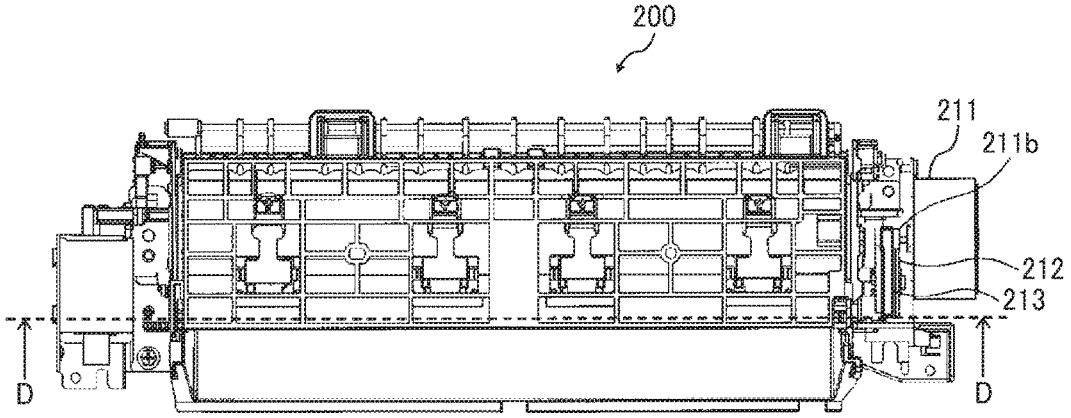
FIG. 33 is a plan view illustrating the sheet ejection unit.
Figure 34:
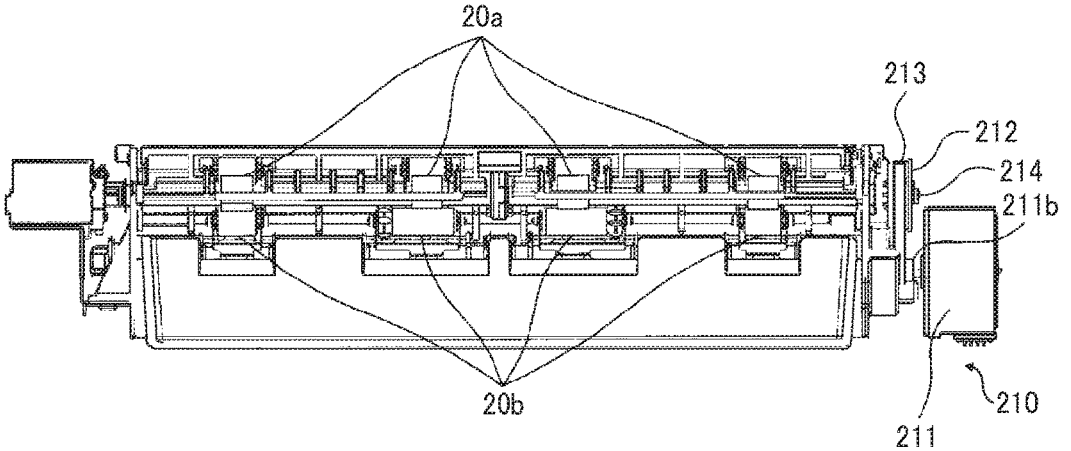
FIG. 34 is a cross sectional view illustrating the the sheet discharging unit of FIG. 33, along a D-D of FIG. 33.

FIG. 31 is a perspective view illustrating the front view illustrating a sheet ejection unit 200. FIG. 32 is a front view illustrating the sheet discharging unit 200. FIG. 33 is a plan view illustrating the sheet discharging unit 200. FIG. 34 is a cross sectional view illustrating the sheet discharging unit of FIG. 33, along a line D-D of FIG. 33.

The sheet discharging unit 200 includes the pair of sheet ejecting rollers 20 that includes a drive side sheet ejecting roller 20*a* and a driven side sheet ejecting roller 20*b*. The driven side sheet ejecting roller 20*b* contacts the drive side sheet ejecting roller 20*a* to be rotated along with the drive side sheet ejecting roller 20*a*. Four sets of the drive side sheet ejecting rollers 20*a* and the driven side sheet discharging rollers 20*b* (i.e., four pairs of sheet ejecting rollers 20) are aligned in the rotational axis direction at predetermined intervals. Further, a sheet ejection drive device 210 is provided on a side face of one the sheet discharging unit 200, so as to drive and rotate the drive side sheet ejecting rollers 20*a*.

Figure 35:
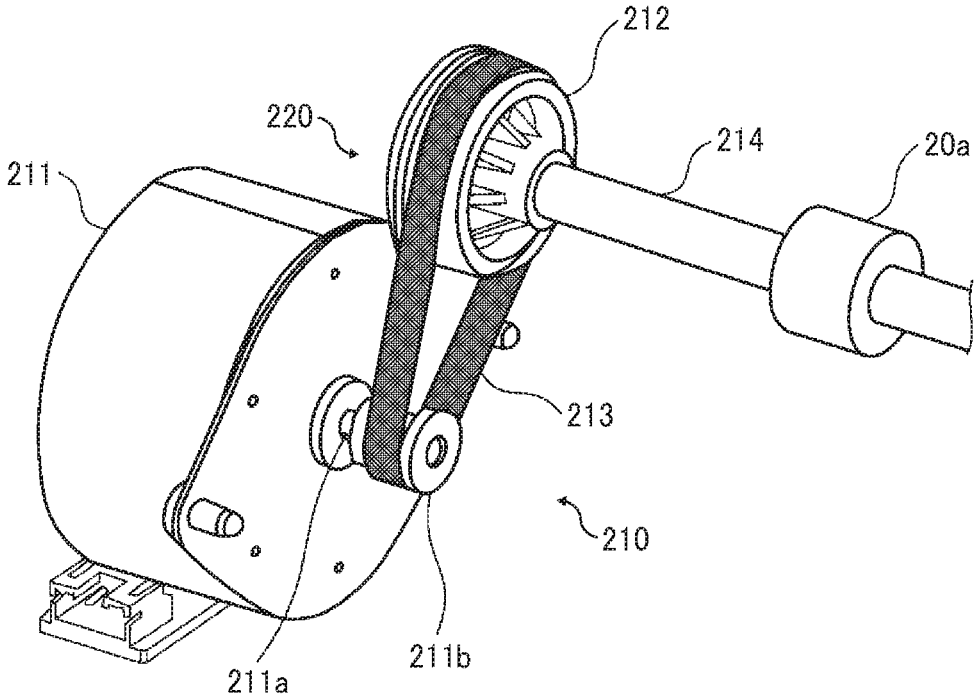
FIG. 35 is a perspective view illustrating a sheet ejection drive device.

FIG. 35 is a perspective view illustrating the sheet ejection drive device 210.

The sheet ejection drive device 210 includes a sheet ejection motor 211 and a belt drive transmission mechanism 220. The belt drive transmission mechanism 220 includes a drive pulley 211*b*, a driven pulley 212 and a timing belt 213. The drive pulley 211*b* is mounted on a motor shaft 211*a* of the sheet ejection motor 211. The driven pulley 212 is mounted on a sheet ejection shaft 214 of the drive side sheet ejecting roller 20*a*. The timing belt 213 is wound around and stretched by the drive pulley 211*b* and the driven pulley 212.

As illustrated in FIG. 32, the driven pulley 212 includes a substantially elastically deformable material such as resin and has a press-in hole 212*a* having a substantially D-shaped cross section that functions as a press-in target portion into which a press-in portion 214*a* having a substantially D-shaped cross section is pressed. The press-in portion 214*a* is provided on the sheet ejection shaft 214 at an end on the side close to the sheet ejection drive device 210.

In a case in which the driven pulley 212 is attached to a D-shaped portion of the sheet ejection shaft 214 in a non-press in manner, when a tension force of the timing belt 213 is greater than a reaction force from the flat face (cut face) of the sheet ejection shaft 214 (hereinafter, referred to as a "D-shaped face reaction force of the sheet ejection shaft 214"), a noise is generated.

A description is given of this occurrence of noise, as follows, with reference to the drawings.

Figure 36A:
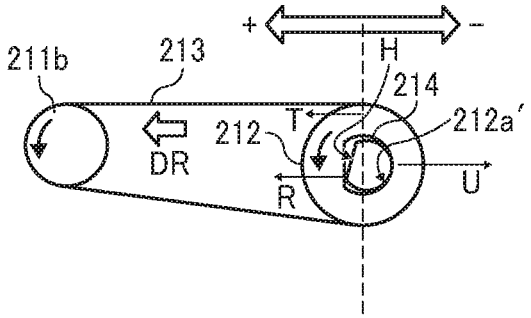
FIGS. 36A through 36E are diagrams illustrating occurrence of abnormal sound when a driven pulley is attached to the D-shaped cut portion of a sheet ejection shaft with a non-pressed manner.
Figure 36B:
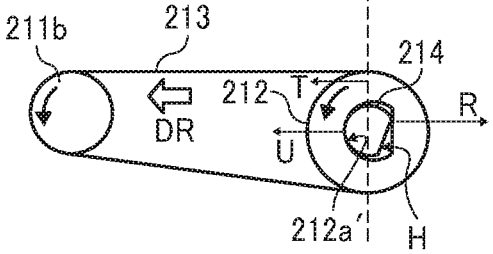
Figure 36C:
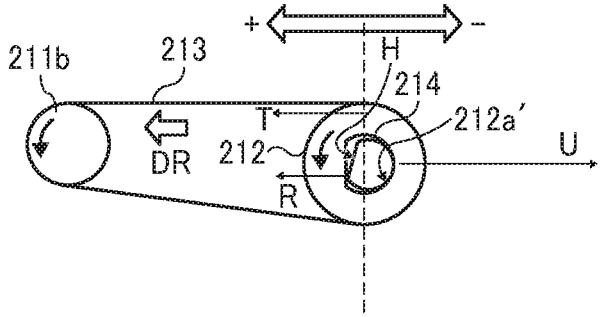
Figure 36D:
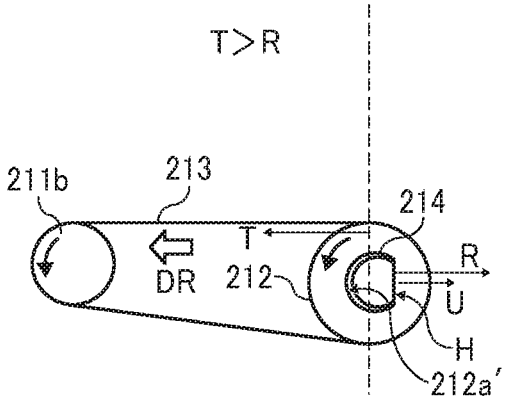
Figure 36E:
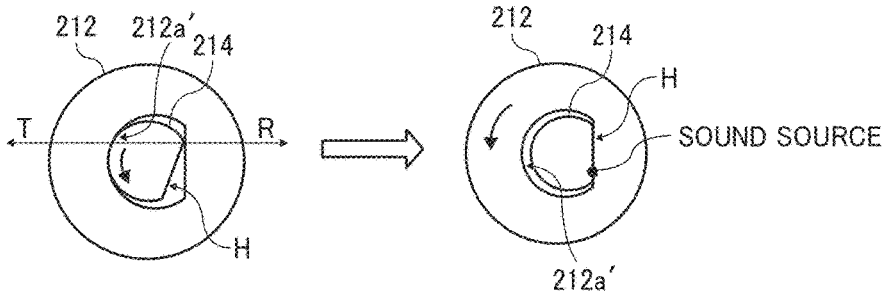

FIGS. 36A and 36B are diagrams illustrating a case in which a tension force T of the timing belt 213 is smaller than a shaft D-shaped face reaction force R of the sheet ejection shaft 214. FIGS. 36C, 36D, and 36E are diagrams illustrating a case in which the tension force T of the timing belt 213 is greater than the shaft D-shaped face reaction force R of the sheet ejection shaft 214.

It is to be noted that the "tension force T of the timing belt 213" includes a "tension force T1 transmitted from the timing belt 213" and a "tension force T2 for attaching the timing belt 213 (a tension force (or a belt tension) on the timing belt 213 in a rest state in which the timing belt 213 is wound around the drive pulley 211*b* and the driven pulley 212 while the drive pulley 211*b* is not rotating)". The relation is expressed in this expression: T T1+T2.

Further, in the following description, the term "positive (+) side" represents a side close to the drive pulley 211*b* from the center of rotation of the sheet ejection shaft 214 and the term "negative (−) side" represents an opposite side to the drive pulley 211*b* from the center of rotation of the sheet ejection shaft 214.

Examples of forces applied on the driven pulley 212 are the tension force T of the timing belt 213, the shaft D-shaped face reaction force R and a reaction force U from the sheet ejection shaft 214.

As illustrated in FIGS. 36A and 36C, in a case in which a flat face (a cut face) H of the D-shaped portion of the sheet ejection shaft 214 is located on the side close to the drive pulley 211*b* (i.e., the positive side), a direction of the tension force T of the timing belt 213 and a direction of the shaft D-shaped face reaction force R are identical to each other, which is the positive side. Therefore, at this time, the driven pulley 212 moves in the direction toward the drive pulley 211*b* by the tension force T of the timing belt 213, so that an inner circumferential face of a press-in hole 212*a*' of the driven pulley 212 contacts a circular arc face of the D-shaped portion of the sheet ejection shaft 214.

Further, since the inner circumferential face of the press-in hole 212*a*' of the driven pulley 212 contacts the circular arc face of the D-shaped portion of the sheet ejection shaft 214, a predetermined gap is provided between the inner circumferential face of the press-in hole 212*a*' and the flat face (the cut face) H of the D-shaped portion of the sheet ejection shaft 214. As the driven pulley 212 receives the rotation driving force from the timing belt 213 to rotate, the inner circumferential face of the press-in hole 212*a*' of the driven pulley 212 contacts the downstream side end of the flat face (cut face) H of the D-shaped portion of the sheet ejection shaft 214. Accordingly, the driving force is transmitted from the driven pulley 212 to the sheet ejection shaft 214, thereby rotating the sheet ejection shaft 214.

Further, since the inner circumferential face of the press-in hole 212*a*' of the driven pulley 212 contacts the circular arc face of the D-shaped portion of the sheet ejection shaft 214, the driven pulley 212 receives the reaction force U from the sheet ejection shaft 214 in the negative (−) direction. The reaction force U is a sum of the tension force T of the timing belt 213 and the shaft D-shaped face reaction force R.

In a case in which the tension force T of the timing belt 213 is smaller than the shaft D-shaped face reaction force R, when the sheet ejection shaft 214 is rotated in a direction of rotation DR by an angle of 180 degrees from the state of FIG. 36A, similar to FIG. 36A, the state in which the inner circumferential face of the press-in hole 212*a*' of the driven pulley 212 is in contact with the circular arc face of the D-shaped portion of the sheet ejection shaft 214 is maintained. Consequently, the driven pulley 212 receives the reaction force U from the circular arc face of the shaft D-shaped portion (see FIG. 36B).

By contrast, in a case in which the tension force T of the timing belt 213 is greater than the shaft D-shaped face reaction force R, as illustrated in FIG. 36D, when the sheet ejection shaft 214 is rotated in the direction of rotation DR by an angle of 180 degrees from the state of FIG. 36C, the flat face H of the of the sheet ejection shaft 214 remains in contact with the inner circumferential face of the press-in hole 212*a*' is maintained. Consequently, the driven pulley 212 receives the reaction force U from the flat face H of the shaft D-shaped portion. As described above, when the tension force T of the timing belt 213 is greater than the shaft D-shaped face reaction force R, the sheet ejection shaft 214 relatively moves in the press-in hole 212*a*' of the driven pulley 212 during one rotation. Due to this action, abnormal sound (noise) is generated for one time per rotation of the sheet ejection shaft 214.

FIG. 36E is a diagram illustrating a mechanism in which the flat face H of the sheet ejection shaft 214 contacts the inner circumferential face of the press-in hole 212*a*' of the driven pulley 212 when the sheet ejection shaft 214 is rotated by the angle of 180 degrees from the state in FIG. 36C.

As illustrated in FIG. 36E, when the sheet ejection shaft 214 is rotated by the angle of 180 degrees from the state of FIG. 36C and the flat face (the cut face) H of the D-shaped portion comes to the negative (−) side, the direction of the shaft D-shaped face reaction force R and the direction of the tension force T of the timing belt 213 become different from each other. At this time, the tension force T is added to the downstream side end of the flat face H of the sheet ejection shaft 214 via the driven pulley 212, so that the tension force T acts to rotate the sheet ejection shaft 214.

In a case in which the shaft D-shaped face reaction force R is greater than the tension force T, the sheet ejection shaft 214 is not rotated by the tension force T. Therefore, as illustrated in FIG. 36B, the state in which the inner circumferential face of the press-in hole 212*a*' of the sheet ejection shaft 214 is in contact with the circular arc face of the D-shaped portion of the sheet ejection shaft 214 is maintained.

By contrast, in a case in which the tension force T of the timing belt 213 is greater than the shaft D-shaped face reaction force R, the sheet ejection shaft 214 is rotated by the tension force T. Then, as illustrated in FIG. 36D, the contact portion of the sheet ejection shaft 214 to contact with the inner circumferential face of the press-in hole 212*a*' of the driven pulley 212 changes from the circumferential face to the flat face (the cut face) H. Further, the sheet ejection shaft 214 is rotated by the tension force T, and the upstream side end (i.e., the lower end of the flat face H in FIG. 36E) of the flat face H in the rotational direction that is separated from the press-in hole 212*a* contacts the inner circumferential face of the press-in hole 212*a*. At this time, abnormal sound (noise) occurs.

In order to restrain such occurrence of abnormal sound, it is designed to reduce the tension force T of the timing belt 213 to be smaller than the shaft D-shaped face reaction force R. However, in a case in which a center distance of the drive pulley and the driven pulley becomes longer (greater) than the shaft D-shaped face reaction force R due to variation in parts and assembly, the tension force T of the timing belt 213 becomes greater than the shaft D-shaped face reaction force R, therefore it was likely to generate abnormal sound (noise).

In order to restrain occurrence of the abnormal sound (noise), grease may be applied to the gap between the D-shaped portion of the sheet ejection shaft 214 and the press-in hole 212*a*' of the driven pulley 212. By applying grease to the gap between the D-shaped portion of the sheet ejection shaft 214 and the press-in hole 212*a*' of the driven pulley 212, the grease acts as resistance when the sheet ejection shaft 214 is rotated by the tension force T relative to the driven pulley 212. Accordingly, it is prevented that the upstream side end in the rotational direction of the flat face H contacts the inner circumferential face of the press-in hole 212*a*' with great force, and therefore occurrence of abnormal sound is restrained. In this case, however, a seal to block the grease is provided, resulting in an increase in costs of the device. Further, an additional step to fill grease is provided, thereby increasing the number of assembly steps.

Therefore, in the belt drive transmission mechanism 220, it is preferable that the driven pulley 212 is attached to the sheet ejection shaft 214 in a press in manner. Accordingly, even when the tension force T of the timing belt 213 is greater than the shaft D-shaped face reaction force R, the sheet ejection shaft 214 is prevented from relatively moving in the press-in hole 212*a*' of the driven pulley 212, and therefore the occurrence of abnormal sound is prevented. Further, the driven pulley 212 and the sheet ejection shaft 214 are assembled by pressing the driven pulley 212 in the sheet ejection shaft 214. Therefore, when compared with a configuration in which grease is filled in the gap, an increase in costs of the device and an increase in the number of assembly steps are restrained.

However, in a case of a configuration in which the sheet ejection shaft 214 is pressed into the entire inner circumferential face of the press-in hole of the driven pulley 212, the assembly of the driven pulley 212 to the sheet ejection shaft 214 becomes difficult. Therefore, in the belt drive transmission mechanism 220, similar to the configuration in which the worm wheel is attached to the drive shaft, the press-in portion of the sheet ejection shaft 214 that is pressed into the driven pulley 212 includes two circular arc faces having different distances from the axial center and one sloped face that connects the two circular arc faces.

Figure 37A:
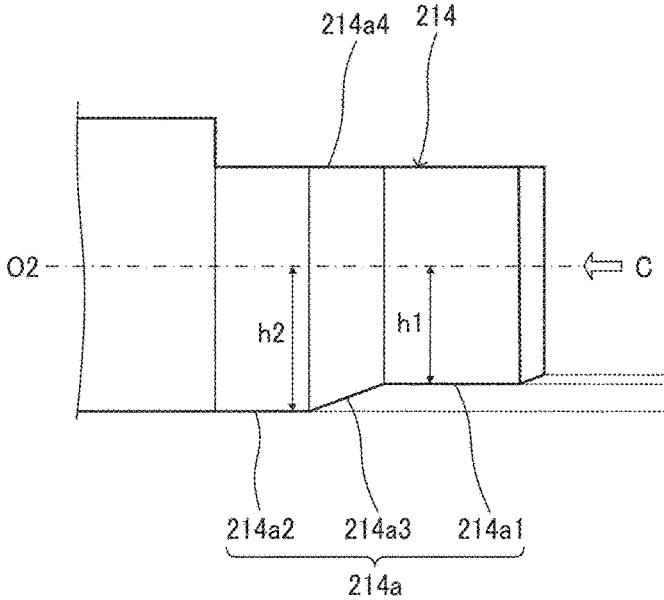
FIGS. 37A and 37B are enlarged views illustrating a sheet ejection shaft near the press-in portion.
Figure 37B:
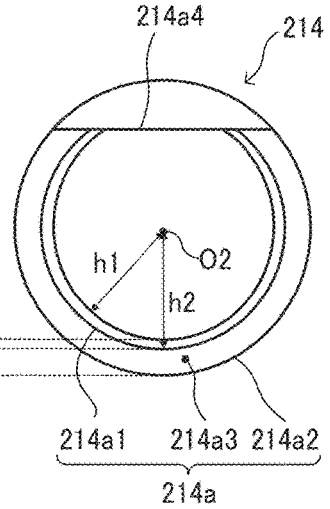

FIGS. 37A and 37B are enlarged views illustrating the sheet ejection shaft 214 near the press-in portion 214*a*. Specifically, FIG. 37A is an enlarged view illustrating the sheet ejection shaft 214, viewed from a direction perpendicular to the axial direction of the sheet ejection shaft 214. FIG. 37B is an enlarged view illustrating the sheet ejection shaft 214, viewed from the axial direction of the sheet ejection shaft 214 (i.e., a direction indicated by arrow C in FIG. 37A).

The press-in portion 214*a* of the sheet ejection shaft 214 includes a flat face (a cut face) 214*a*4, two circular arc faces 214*a*1 and 214*a*2, and a sloped face 214*a*3. The flat face (the cut face) 214*a*4 extends parallel to the axial direction of the sheet ejection shaft 214. The two circular arc faces 214*a*1 and 214*a*2 are provided at positions in the axial direction of the sheet ejection shaft 214, which are same as at least a portion on the flat face 214*a*4 in the axial direction of the sheet ejection shaft 214. The sloped face 214*a*3 is inclined relative to the axis of the sheet ejection shaft 214 to connect the two circular arc faces 214*a*1 and 214*a*2. The two circular arc faces, which are the first circular arc face 214*a*1 and the second circular arc face 214*a*2, have a center of curvature that coincides with an axial center O2 of the sheet ejection shaft 214. However, a distance h1 (that corresponds to a radius of curvature) of the first circular arc face 214*a*1 from the axial center O2 is different from a distance h2 (that corresponds to a radius of curvature) of the second circular arc face 214*a*2 from the axial center O2. Specifically, the first circular arc face 214*a*1 is located on an upstream side of the attaching direction of the driven pulley 212 (i.e., on the right side of FIG. 37A) and the second circular arc face 214*a*2 is located on a downstream side of the attaching direction of the driven pulley 212 (i.e., near the center close to the left side of FIG. 37A). A distance h1 is a distance between the first circular arc face 214*a*1 and the axial center O2 and a distance h2 is a distance between the second circular arc face 173*c* and the axial center O2. The distance h2 of the second circular arc face 214*a*2 from the axial center O2 is longer (greater) than the distance h1 of the first circular arc face 214*a*1 from the axial center O2, which is described as h1<h2.

Figure 38B:
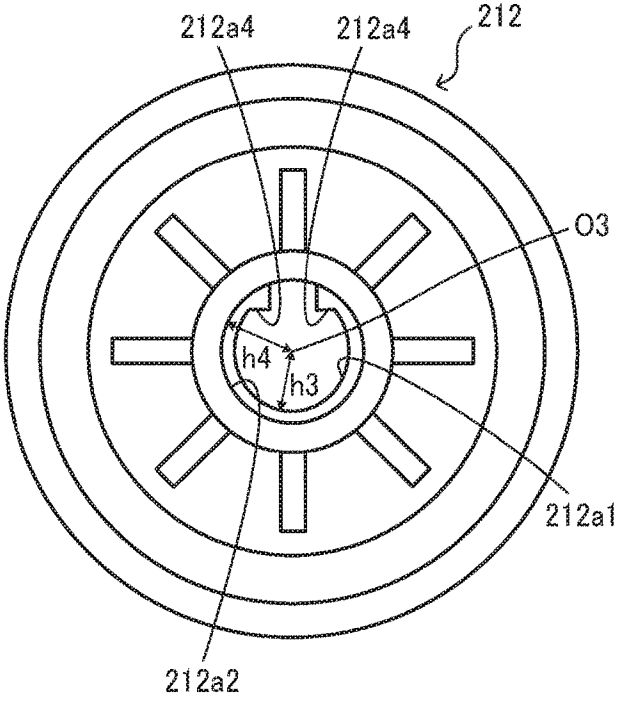
FIGS. 38A and 38B are diagrams illustrating the driven pulley.
Figure 38A:
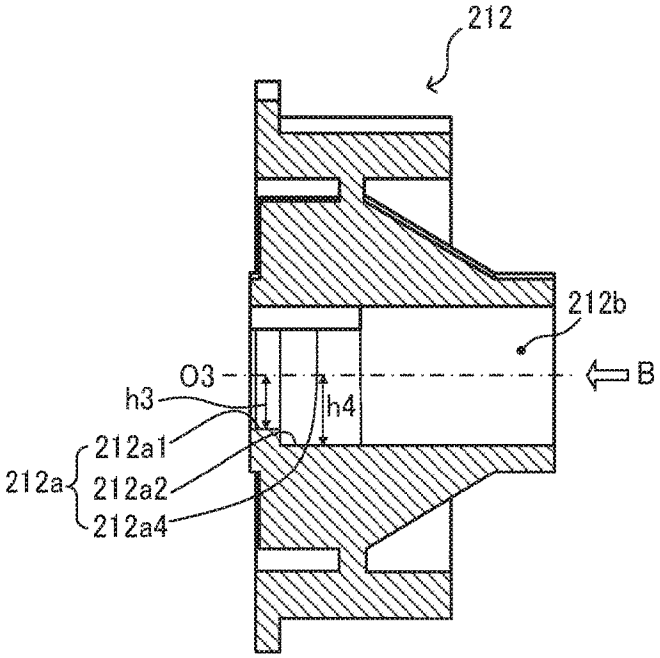

FIGS. 38A and 38B are diagrams illustrating the driven pulley 212. Specifically, FIG. 38A is a cross sectional view of the driven pulley 212. FIG. 38B is a diagram illustrating the driven pulley 212, viewed from the axial direction of the driven pulley 212 (i.e., a direction indicated by arrow B in FIG. 38A).

The press-in hole 212*a* and an insertion hole 212*b* are disposed at the center of rotation of the driven pulley 212. The insertion hole 212*b* is a hole having a circular cross section and approximately the same diameter as the diameter of a body of the sheet ejection shaft 214. The press-in hole 212*a* includes, on the inner circumferential face, an inner circumferential flat face 212*a*4, a first press-in target face 212*a*1, and a second press-in target face 212*a*2. The inner circumferential flat face 212*a*4 is parallel to the axial direction of the sheet ejection shaft 214. The flat face 214*a*4 of the press-in portion 214*a* of the sheet ejection shaft 214 contacts the inner circumferential flat face 212*a*4. The first circular arc face 214*a*1 of the press-in portion 214*a* of the sheet ejection shaft 214 contacts the first press-in target face 212a1 of the press-in hole 212a. The second circular arc face 214a2 of the press-in portion 214a contacts the second press-in target face 212a2 of the press-in hole 212a. The first press-in target face 212a1 and the second press-in target face 212a2 have different distances, i.e., a distance h3 and a distance h4, from the axial center O3 of the driven pulley 212 that is to coincide or to be at the same position as the axial center O2 of the sheet ejection shaft 214. When the driven pulley 212 is completely attached to the sheet ejection shaft 214, the distance h3 of the first press-in target face 212a1 and the axial center O3 and the distance h4 of the second press-in target face 212a2 and the axial center O3 are different from each other. Specifically, the first press-in target face 212a1 is located on an upstream side of the attaching direction of the driven pulley 212 (i.e., on the left side of FIG. 38A) and the second press-in target face 212a2 is located on a downstream side of the attaching direction of the driven pulley 212 (i.e., on the right side of FIG. 38A). The first press-in target face 212a1 has a distance h3 from the axial center O3 and the second press-in target face 212a2 has a distance h4 from the axial center O3 from the axial center O3. The distance h4 of the second press-in target face 212a2 from the axial center O3 is longer (greater) than the distance h3 of the first press-in target face 212a1 from the axial center O3, which is expressed as $h3<h4$.

A cut-in amount of the first press-in target face 212a1 to the first circular arc face 214a1 is reduced to be smaller than a cut-in amount of the second press-in target face 212a2 to the second circular arc face 214a2. Specifically, a relation of $(h1-h3)<(h2-h4)$ is satisfied where "h1" represents a distance from the axial center O2 to the first circular arc face 214a1, "h2" represents a distance from the axial center O2 to the second circular arc face 214a2, "h3" represents a distance from the axial center O3 to the first press-in target face 212a1 and "h4" represents a distance from the axial center O3 to the second press-in target face 212a2.

Figure 39A:
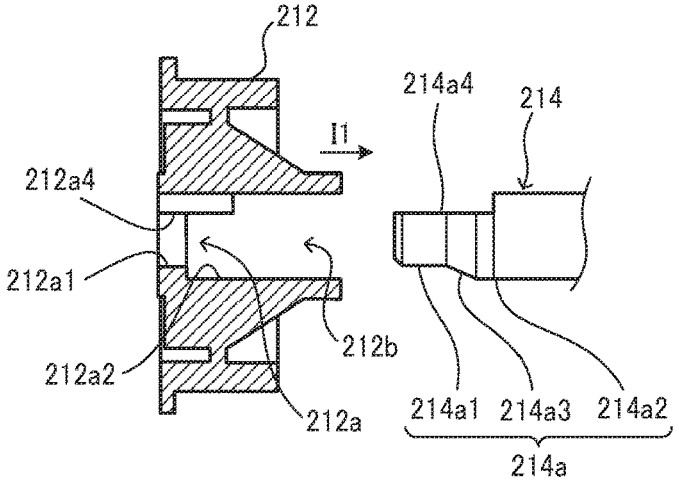
FIGS. 39A, 39B and 39C are views for explaining attachment of the driven pulley to the sheet ejection shaft.
Figure 39B:
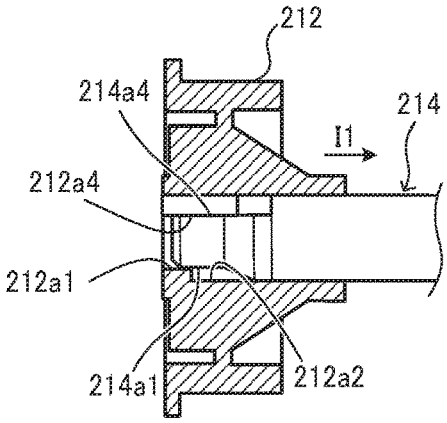
Figure 39C:
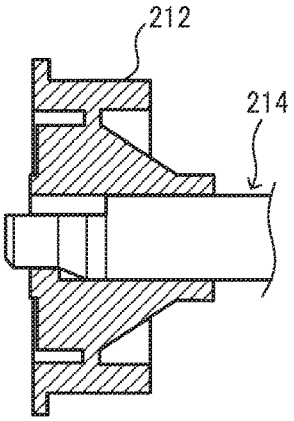

FIGS. 39A, 39B, and 39C are diagrams illustrating movement of the driven pulley 212 when the driven pulley 212 is pressed into the sheet ejection shaft 214.

As illustrated in FIG. 39A, the driven pulley 212 is moved in a direction indicated by arrow I1 in FIG. 39A, so as to insert one end of the sheet ejection shaft 214 into the insertion hole 212b of the driven pulley 212. One end of the sheet ejection shaft 214 has a tapered shape increasing the diameter gradually toward the center of the sheet ejection shaft 214 in the axial direction of the sheet ejection shaft 214. Therefore, even if the axial center O3 of the driven pulley 212 is shifted from the axial center O2 of the sheet ejection shaft 214 when the sheet ejection shaft 214 is inserted into the driven pulley 212, the tapered shape at the one end of the sheet ejection shaft 214 guides the driven pulley 212, so as to smoothly insert the sheet ejection shaft 214 into the insertion hole 212b of the driven pulley 212.

As the sheet ejection shaft 214 is inserted into the insertion hole 212b of the driven pulley 212, the first press-in target face 212a1 of the press-in hole 212a contacts the one end of the sheet ejection shaft 214. As the driven pulley 212 is further moved in the direction indicated by arrow I1 in FIG. 39B from this state, the first press-in target face 212a1 and the inner circumferential flat face 212a4 that is disposed at the same position as the first press-in target face 212a1 in the axial direction are elastically deformed and, as illustrated in FIG. 39B, the flat face (the cut face) 214a4 that extends to the one end of the sheet ejection shaft 214 is pressed into the press-in hole 212a. From this state, as the driven pulley 212 is further moved in the direction of the arrow I1 in FIG. 39B. However, as described above, the biting amount of the first press-in target face 212a1 to the sheet ejection shaft 214 is reduced to be smaller than the biting amount of the second press-in target face 212a2 to the sheet ejection shaft 214. Therefore, the moving load of the driven pulley 212 is relatively weak so that the driven pulley 212 is moved in the direction I1 without applying a great force. As a result, as illustrated in FIG. 39C, the driven pulley 212 is easily attached and fixed to the sheet ejection shaft 214.

However, as described above, the biting amount of the first press-in target face 212a1 to the first circular arc face 214a1 (h1−h3) is set to be smaller than the biting amount of the second press-in target face 212a2 to the second circular arc face 214a2 (h2−h4). By so doing, it is likely that the driven pulley 212 is attached to the sheet ejection shaft 214 in a tilted manner or at an angle to the sheet ejection shaft 214 due to the difference of the biting amounts. In order to avoid such tilt of the driven pulley 212 relative to the sheet ejection shaft 214, the cut-in amount of the first press-in target face 212a1 to the first circular arc face 214a1 (h1−h3) is preferably set to be substantially equal to the cut-in amount of the second press-in target face 212a2 to the second circular arc face 214a2 (h2−h4), in other words, it is preferable to satisfy the following relation: $(h1-h3)\approx(h2-h4)$.

In the belt drive transmission mechanism 220, the portion of the driven pulley 212 to which the sheet ejection shaft 214 is pressed in is divided into the first press-in target face 212a1 and the second press-in target face 212a2 in the axial direction of the driven pulley 212. Therefore, when compared with the configuration in which the sheet ejection shaft 214 is pressed into the entire inner circumferential face of the press-in hole 212a, a press-in area of the press-in hole 212a is reduced. Accordingly, the driven pulley 212 is attached to the sheet ejection shaft 214 easily. Further, in this example, since both ends of the press-in hole 212a in the axial direction of the driven pulley 212 are pressed in, even if the press-in area of the press-in hole 212a is reduced, the driven pulley 212 can be fixedly attached to the sheet ejection shaft 214 without tilting.

Further, in the belt drive transmission mechanism 220, the gap is provided between the driven pulley 212 and the sloped face 214a3 of the press-in portion 214a of the sheet ejection shaft 214 in the state in which the driven pulley 212 is pressed into the sheet ejection shaft 214, and therefore the driven pulley 212 is not in contact with the sloped face 214a3. Therefore, even when the axial length of the first circular arc face 214a1, the axial length of the second circular arc face 214a2, and the length of the sloped face 214a3 are different relative to the specified lengths due to manufacturing error, the press-in portion 214a of the press-in portion 214a is pressed into the press-in hole 212a of the driven pulley 212 entirely.

Further, as illustrated in FIG. 38B, the center in the left and right direction of the D-shaped portion of the press-in hole 212a is cut. Therefore, the inner circumferential flat face 212a4 of the press-in hole 212a is divided into both lateral sides of the press-in hole 212a in FIG. 38B. By so doing, when the driven pulley 212 is pressed into the press-in portion 214a of the sheet ejection shaft 214, the inner circumferential flat face 212a4 is elastically deformed easily. Accordingly, the driven pulley 212 is assembled to the sheet ejection shaft 214 easily.

Variation.

It is to be noted that, in the present embodiments described above, the flat faces (the cut faces) of the press-in portion 73a and the press-in portion 214a are made of a single flat face. However, similar to a comparative configuration, multiple flat faces may be disposed along the attaching direction of a drive transmitting member such as the worm wheel 75 or the driven pulley 212 and have different distances from the axis center of a rotary shaft such as the drive shaft 73 or the sheet ejection shaft 214, and the distance between the downstream side flat face of the multiple flat faces and the axis center may be greater (longer) than the upstream side flat face of the multiple flat faces and the axis center in the attaching direction of the drive transmitting member.

The configurations according to the above-descried embodiments are not limited thereto. This disclosure can achieve the following aspects effectively.

Aspect 1.

A drive transmitting device (for example, the drive device 50) includes a drive source (for example, the drive motor 51, the sheet ejection motor 211), a drive transmitting body (for example, the worm wheel 75, the driven pulley 212), and a rotary shaft (for example, the drive shaft 73, the sheet ejection shaft 214). The drive source applies a driving force. The drive transmitting body has a press-in target portion (for example, the press-in hole 75*c*, the press-in hole 212*a*) and receives the driving force from the drive source. The rotary shaft includes a press-in portion (for example, the press-in portion 73*a*, the press-in portion 214*a*) mounted on one end of the rotary shaft in an axial direction of the rotary shaft to be pressed into the press-in target portion of the drive transmitting body. The press-in portion includes a flat face (for example, the flat face 173*d*, the flat face 214*a*4) and multiple circular arc faces (for example, the first circular arc faces 173*a* and 214*a*1 and the second circular arc faces 173*c* and 214*a*2). The flat face extends parallel to the axial direction of the rotary shaft. The multiple circular arc faces are disposed parallel to the axial direction of the rotary shaft and have distances different from each other from an axial center of the rotary shaft and extend parallel to the axial direction of the rotary shaft. Each of the multiple circular arc faces is disposed at a same position in the axial direction of the rotary shaft as at least a portion of the flat face in the axial direction of the rotary shaft. The multiple circular arc faces include a first circular arc face (for example, the first circular arc face 173*a* or 214*a*1) on an upstream side of an attaching direction of the drive transmitting body and having a radius of curvature (for example, the distance h1) and a second circular arc face (for example, the second circular arc face 173*c* or 214*a*2) on a downstream side of the attaching direction of the drive transmitting body and having a radius of curvature (for example, the distance h2). The radius of curvature of the second circular arc face of the multiple circular arc faces is greater than the radius of curvature of the first circular arc face of the multiple circular arc faces.

In Aspect 1, of the multiple circular arc faces provided on the press-in portion of the rotary shaft, the distance between the second circular arc face on the downstream side in the attaching direction of the drive transmitting body and the axial center is greater than the distance between the first circular arc face on the upstream side in the attaching direction of the drive transmitting body and the axial center. Therefore, the outer diameter of the press-in portion is smaller on the upstream side in the attaching direction of the drive transmitting body than the downstream side in the attaching direction of the drive transmitting body. As a result, the inner diameter on the downstream side of the press-in target portion (for example, the press-in hole 75*c* or 212*a*) of the drive transmitting body in the attaching direction is greater than he inner diameter on the upstream side of the press-in target portion of the drive transmitting body in the attaching direction. Therefore, as described above with reference to FIGS. 22A through 22C, in the state in which the upstream portion of the press-in portion in the attaching direction in the attaching direction of the drive transmitting body has a gap relative to the inner circumferential face of the press-in target portion, the press-in portion is press-fitted into the press-in target portion after the press-in portion has entered in the press-in target portion to some extent. When the upstream side in the press-in portion of the rotary shaft in the attaching direction of the drive transmitting body enters the inside of the press-in target portion, by moving the drive transmitting body as described below, the axial center of the press-in target portion (for example, the axial center O3 indicated by a broken line in FIG. 22A) coincides with the axial center of the rotary shaft (for example, the axial center O2 indicated by a broken line in FIG. 22A). That is, the drive transmitting body is moved in a direction (for example, the direction 13 indicated by arrow in FIG. 22B) in which the inner wall face of the press-in target portion opposed to the plurality of circular arc faces arranged in the press-in portion in parallel with the attaching direction of the drive transmitting body separates from the plurality of circular arc faces. By moving the drive transmitting body as described above, the inner wall face (for example, the inner circumferential flat face 175*d*) of the press-in target portion contacts a continuous surface that extends from an upstream side end to a downstream side end of the press-in portion in the attaching direction of the drive transmitting body (for example, a single flat face (cut face) in the present embodiment. The continuous surface including the plurality of flat faces in the above-described Variation may also be applicable). Accordingly, the axial center of the press-in target portion (for example, the axial center O3 indicated by a broken line in FIG. 22A) coincides with the axial center of the rotary shaft (for example, the axial center O2 indicated by a broken line in FIG. 22A). Then, by pressing the press-in portion into the press-in target portion in a state in which the inner wall face of the press-in target portion contacts the continuous surface of the press-in portion, the press-in portion is pressed into the press-in target portion while the axial center of the press-in target portion (for example, the axial center O3) coincides with the axial center of the rotary shaft (for example, the axial center O2).

As described above, in Aspect 1, part of the press-in portion may enter the press-in target portion before the press-in portion is pressed in the press-in target portion. Therefore, the continuous surface of the press-in portion and the inner wall face (for example, the inner circumferential flat face 175*d*) of the press-in target portion to contact the continuous surface are used to match the axial center of the press-in target portion and the axial center of the rotary shaft. Consequently, the press-in portion of the rotary shaft is pressed into the press-in target portion of the drive transmitting body without visually aligning the axial center of the press-in target portion and the axial center of the rotary shaft. Accordingly, when compared with the comparative configuration in which the outer diameter of the press-in portion on the upstream side in the attaching direction of the drive transmitting body is equal to the outer diameter of the press-in portion on the downstream side in the attaching direction of the drive transmitting body and the axial center of the press-in target portion and the axial center of the rotary shaft are visually aligned when the press-in portion is pressed into the press-in target portion, the configuration of Aspect 1 achieves easy assembly of the drive transmitting body to the rotary shaft.

In the configuration of Aspect 1, not the plurality of flat faces (cut faces) of the press-in portion of the rotary shaft but the plurality of circular arc faces of the press-in portion of the rotary shaft have different distances from the axial center of the rotary shaft and are disposed along the axial direction of the rotary shaft on the circular arc face side opposite to the flat face (the cut face) of the press-in portion of the rotary shaft. As a result, the configuration according to Aspect 1 achieves the easy assembly of the drive transmitting body to the rotary shaft. By contrast, in the comparative configuration, not the plurality of circular arc faces of the press-in portion of the rotary shaft but the plurality of flat faces (cut faces) of the press-in portion of the rotary shaft have different distances from the axial center of the rotary shaft and are disposed along the axial direction of the rotary shaft on the flat face (the cut face) side opposite to the flat face (the cut face) of the press-in portion of the rotary shaft. As a result, the comparative configuration achieves the easy assembly of the drive transmitting body to the rotary shaft.

The configuration of Aspect 1 is advantageous in the following matters when compared with the above-described comparative configuration.

In forming the above-described comparative press-in portion, a flat face having multiple steps along the axial direction of the rotary shaft is formed. Therefore, the above-described multiple flat faces are formed by performing a milling process to the one end of the rotary shaft having a cylindrical shape. Therefore, the milling process is repeated by the number of flat faces. By contrast, when forming the press-in portion according to Aspect 1, a circular arc face is provided with multiple steps along the axial direction of the rotary shaft. In this case, one end portion of the rotary shaft having a cylindrical shape is processed by turning to form a circular arc face from the one end portion. Therefore, the press-in portion is formed by one turning processing. Therefore, it is advantageous in that the number of processing steps can be reduced.

Aspect 2.

In Aspect 1, the press-in portion (for example, the press-in portion 73*a*) further includes a sloped face (for example, the sloped faces 173*b* or 214*a*3) joining the first circular arc face on the upstream side of the attaching direction of the rotary shaft and the second circular arc face on the downstream side of the attaching direction of the rotary shaft.

According to this configuration, as described with reference to FIGS. 19A through 19F, in a state in which the axial center (for example, the axial center O3) of the press-in target portion (for example, the press-in hole 75*c*) of the drive transmitting body (for example, the worm wheel 75) is shifted from the axial center (for example, the axial center O2) of the rotary shaft (for example, the drive shaft 73), the drive transmitting body is moved in the axial direction and the press-in target portion is inserted into the press-in portion, the downstream end portion in the attaching direction of the press-in target portion contacts the sloped face of the press-in portion of the rotary shaft. As the drive transmitting member is further moved in the axial direction, the driving force transmitting member is guided by the sloped face toward where the flat face (cut face) of the press-in portion approaches the inner circumferential flat face (for example, the inner circumferential flat face 175*d* or 212*a*4) of the press-in target portion. Accordingly, the axial center of the press-in target portion of the drive transmitting body matches the axial center of the rotary shaft. As described above, by moving the drive transmitting body in the axial direction, the axial center of the press-in target portion of the drive transmitting body and the axial center of the rotary shaft match. Therefore, the press-in portion of the rotary shaft is pressed into the press-in target portion of the drive transmitting body easily.

Aspect 3.

In Aspect 1 or Aspect 2, the press-in target portion of the drive transmitting body includes multiple press-in target faces (for example, the first press-in target face 175*a* and 212*a*1 and the second press-in target face 175*b* and 212*a*2) into which each of the multiple circular arc faces of the press-in portion is pressed, and at least one press-in target face of the multiple press-in target faces includes a circular arc face to contact the circular arc face of the press-in portion over an entire area in a circumferential direction of the circular arc face of the press-in portion.

According to this configuration, a relatively large contact area is provided between the press-in target face of the press-in target portion of the drive transmitting body and the circular arc face of the press-in portion of the rotary shaft, so that the drive transmitting body is prevented from coming off or being separated from the rotary shaft easily.

Aspect 4.

In Aspect 1 or Aspect 2, the press-in target portion of the drive transmitting body (for example, the worm wheel 75) includes multiple press-in target faces (for example, the first press-in target faces 175*a* and 212*a*1 and the second press-in target faces 175*b* and 212*a*2) into which each of the multiple circular arc faces of the press-in portion (for example, the press-in portion 73*a*) is pressed. At least one press-in target face of the multiple press-in target faces includes a contact face to contact a portion in the circumferential direction of the circular arc face (for example, the first circular arc face 173*a* and the second circular arc face 173*c*) of the press-in portion (for example, the press-in portion 73*a*).

According to this configuration, the press-in target face of the press-in target portion of the drive transmitting body partially contacts the circular arc face in the inner circumferential direction of the press-in portion of the rotary shaft. As a result, as described with reference to FIGS. 23A, 23B, 23C, and 26, compared to the configuration in which the press-in target face of the press-in target portion contacts the press-in portion over the entire area in the circumferential direction of the circular arc face of the press-in portion, the press-in target face of the press-in target portion achieves less resistance when the press-in portion of the rotary shaft is pressed into the pre of the drive transmitting body. Accordingly, the press-in portion of the rotary shaft is pressed into the press-in target portion of the drive transmitting body.

Aspect 5.

In Aspect 4, the multiple contact faces of the at least one press-in target face include circular arc faces to contact the press-in portion along the circular arc face of the press-in portion.

According to this configuration, the drive transmitting body contacts the circular arc face of the press-in portion of the rotary shaft over the entire area of the press-in target face of the press-in target portion of the drive transmitting body. As a result, even if the press-in target face of the press-in target portion partially contacts the corresponding circular arc face of the press-in portion, a relatively large contact area in which the press-in target face of the press-in target portion and the circular arc face of the press-in portion contact is secured, so that the drive transmitting body is prevented from coming off or being separated from the rotary shaft.

Aspect 6.

In Aspect 4, the contact face of the at least one press-in target face includes a flat face.

According to this configuration, as described with reference to FIG. 24, an easy processing for forming the press-in target portion of the drive transmitting body is achieved.

Aspect 7.

In any one of Aspect 4 through Aspect 6, the multiple contact faces are faces perpendicular to the rotary shaft in the axial direction of the press-in target portion of the drive transmitting body and are disposed symmetrical about the line perpendicular to the flat face.

According to this configuration, as described with reference to FIG. 26, unevenness of the pressing force to press the flat face (for example, the flat face (the cut face) 173*d*) of the press-in portion (for example, the press-in portion 73*a*) to the inner circumferential flat face of the press-in target press-in target portion (for example, the inner circumferential flat face 175*d* of the press-in hole 75*c*4) is restrained, and therefore backlash or assembly error is restrained or prevented.

Aspect 8.

In any one of Aspect 3 through Aspect 7, the multiple press-in target faces (for example, the first press-in target faces 175*a* and 212*a*1, the second press-in target faces 175*b* and 212*a*2) include a first press-in target face (for example, the first press-in target face 175*a* or 212*a*1) on an upstream side of the attaching direction of the drive transmitting body (for example, the worm wheel 75, the driven pulley 212) and a second press-in target face (for example, the second press-in target face 175*b* or 212*a*2) on a downstream side of the attaching direction of the drive transmitting body. A distance (for example, the distance h4) from the axial center of the rotary shaft to the second press-in target face is greater than a distance (for example, the distance h3) from the axial center of the rotary shaft to the first press-in target face.

According to this configuration, as described in the above-described embodiment above, part of the press-in portion is inserted into the press-in target portion (for example, the press-in hole 75*c*) before the press-in portion is pressed into the press-in target portion.

Aspect 9.

In any one of Aspect 1 through Aspect 8, the driving force is transmitted to a cam (for example, the pair of cams 44) to a moving body (for example, the pressure roller 19) against a biasing body (for example, the springs 43).

As described in the embodiments above, in the configuration in which the cam is driven to move the moving body against the biasing body, it is likely that the cam rotates faster than a rotation driving speed at which the cam is rotated by the driving force applied by the drive source, due to the biasing force applied by the biasing body. When the cam is rotated faster than the rotation driving speed by the driving force applied by the drive source, the drive transmission body collides with the upstream side drive transmitting body (for example, the worm 61) disposed at the upstream side of the drive transmitting direction to which the driving force is applied, in the rotational direction. In Aspect 9, the drive transmission body (for example, the worm wheel 75) is pressed into the rotary shaft (for example, the drive shaft 73), and therefore the drive transmission body does not have any backlash to the rotary shaft in the rotational direction. Consequently, vibration of the drive transmission body in the rotational direction after collision can be restrained, and therefore occurrence of noise due to vibration can be restrained.

Aspect 10.

In Aspect 9, the drive transmitting device (for example, the drive device 50) further including a drive side coupling (for example, the drive side coupling 75*a*) to receive the driving force from the drive source, a driven side coupling (for example, the driven side coupling 71*b*) to engage with the drive side coupling, and a torque limiter (for example, the torque limiter 72) to couple the drive side coupling and the driven side coupling while driving.

According to this configuration, as described in the embodiments above, when the cam (for example, the pair of cams 44) is rotated by the biasing body (for example, the pair of springs 43) faster than the rotation driving speed at which the cam is rotated by the driving force applied by the drive source, the driven side coupling is rotated faster than the drive side coupling. Therefore, the torque is applied to the torque limiter so as to start the torque limiter. When the torque limiter is started and the drive transmission is blocked, a rotational load such as a frictional force is generated to the torque limiter. The rotational load applied to the torque limiter becomes the rotational load to the cam, which brakes the rotation of the cam. As a result, the rotation of the pair of cams is reduced, and therefore it is prevented that the driven side engagement projection (for example, the driven side engagement projection 171) collides of the driven side coupling with the drive side engagement projection (for example, the drive side engagement projection 175) of the drive side coupling 75*a* with great force. Consequently, occurrence of a sound of collision can be reduced.

By contrast, when the cam is rotated by the driving force applied by the drive source, the driving force is transmitted from the drive side coupling to the driven side coupling. Therefore, no torque is applied to the torque limiter, and therefore the torque is not started to operate. Accordingly, when the cam is rotated by the driving force applied by the drive source, the load is not applied, and therefore a motor that is less expensive and has a relatively small output torque can be employed.

Aspect 11.

In Aspect 9 or Aspect 10, the moving body is a pressure roller (for example, the pressure roller 19) to press a fixing roller (for example, the fixing roller 18).

According to this configuration, sound of collision generated when the pressure roller is separated from the fixing roller can be restrained.

Aspect 12.

In any one of Aspect 1 through Aspect 11, the drive transmitting device further includes at least one spur gear (for example, the cam gear 55, the second output gear 54, the first output gear 53).

According to this configuration, as described in the embodiments above, the at least one gear moves in a thrust direction (an axial direction) when driving, and therefore the at least one spur gear is restrained from colliding a member disposed opposite the at least one spur gear in the thrust direction. Accordingly, sound of collision is restrained or prevented from occurring.

Aspect 13.

In any one of Aspect 1 through Aspect 11, the drive transmitting device (for example, the drive device 50) includes the drive source (for example, the sheet ejection motor 211) and further includes multiple pulleys (for example, the drive pulley 211*b* and the driven pulley 212) and a belt (for example, the timing belt 213) wound around the multiple pulleys. One of the multiple pulleys is mounted on a shaft (for example, the sheet ejection shaft 214) of a driving body (for example, the pair of sheet ejecting rollers 20) to which the driving force is transmitted from the drive source via the belt. The rotary shaft includes the shaft of the driving body. The driving body includes a pulley (for example, the driven pulley 212) of the multiple pulleys, and the pulley is mounted on the shaft of the drive body.

According to this configuration, the multiple pulleys such as the driven pulley 212 can be easily pressed into the shaft of the drive body. Further, by fixedly pressing the pulley into the shaft of the drive body, generation of noise can be prevented.

Aspect 14.

In Aspect 13, the driving body is a sheet ejecting roller (for example, the pair of sheet ejecting rollers 20).

According to this configuration, an abnormal noise generated when driving the sheet ejecting roller can be restrained.

Aspect 15.

In Aspect 15, an image forming apparatus (for example, the image forming apparatus 100) includes an image forming device (for example, the process cartridges 1) to form an image on a recording medium (for example, the sheet P), and the drive transmitting device (for example, the drive device 50) according to any one of Aspect 1 through Aspect 14, to transmit the driving force from the drive source (for example, the drive motor 51).

According to this configuration, easy attachment of a drive transmitting member to a rotary shaft can be achieved.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A drive transmitting device comprising:

a drive source configured to apply a driving force;

a drive transmitting body having a press-in target portion, the drive transmitting body configured to receive the driving force from the drive source; and a rotary shaft including a press-in portion mounted on one end of the rotary shaft in an axial direction of the rotary shaft, the press-in portion configured to press into the press-in target portion of the drive transmitting body, the press-in portion including:

a flat face extending parallel to the axial direction of the rotary shaft; and a plurality of circular arc faces disposed parallel to the axial direction of the rotary shaft, having distances different from each other from an axial center of the rotary shaft, and extending parallel to the axial direction of the rotary shaft, the plurality of circular arc faces each being disposed at a same position in the axial direction of the rotary shaft as at least a portion of the flat face in the axial direction of the rotary shaft, the plurality of circular arc faces including a first circular arc face and a second circular arc face, the first circular arc face being on an upstream side of the second circular arc face in an attaching direction of the drive transmitting body and having a radius of curvature, the second circular arc face being on a downstream side of the first circular arc face in the attaching direction of the drive transmitting body and having a radius of curvature, the radius of curvature of the second circular arc face being greater than the radius of curvature of the first circular arc face.

2. The drive transmitting device according to claim 1, wherein the press-in portion further includes a sloped face joining the first circular arc face and the second circular arc face.

3. The drive transmitting device according to claim 1, wherein the press-in target portion of the drive transmitting body includes a plurality of press-in target faces into which the plurality of circular arc faces of the press-in portion is pressed, and at least one press-in target face of the plurality of press-in target faces includes a circular arc face configured to contact a circular arc face of the plurality of circular arc faces of the press-in portion over an entire area in a circumferential direction of the circular arc face of the press-in portion.

4. The drive transmitting device according to claim 3, wherein the plurality of press-in target faces includes a first press-in target face and a second press-in target face, the first press-in target face being on an upstream side of the second press-in target face in the attaching direction of the drive transmitting body, the second press-in target face being on a downstream side of the attaching direction of the drive transmitting body, and a distance from the axial center of the rotary shaft to the second press-in target face is greater than a distance from the axial center of the rotary shaft to the first press-in target face.

5. The drive transmitting device according to claim 1, wherein the press-in target portion of the drive transmitting body includes a plurality of press-in target faces into which the plurality of circular arc faces of the press-in portion is pressed, and at least one press-in target face of the plurality of press-in target faces includes a contact face configured to contact a portion in a circumferential direction of a circular arc face of the plurality of circular arc faces of the press-in portion.

6. The drive transmitting device according to claim 5, wherein the contact face of the at least one press-in target face includes a circular arc face configured to contact the press-in portion along the circular arc face of the press-in portion.

7. The drive transmitting device according to claim 5, wherein the contact face of the at least one press-in target face includes a flat face.

8. The drive transmitting device according to claim 1, wherein the press-in target portion of the drive transmitting body includes a plurality of press-in target faces into which the plurality of circular arc faces of the press-in portion is pressed, and at least one press-in target face of the plurality of press-in target faces includes a plurality of contact faces configured to contact the plurality of circular arc faces of the press-in portion on a plurality of portions in a circumferential direction of each of the plurality of circular arc faces of the press-in portion.

9. The drive transmitting device according to claim 8, wherein each of the plurality of contact faces of the at least one press-in target face includes a circular arc face configured to contact the press-in portion along the plurality of circular arc faces of the press-in portion.

10. The drive transmitting device according to claim 8, wherein each of the plurality of contact faces of the at least one press-in target face includes a flat face.

11. The drive transmitting device according to claim 8, wherein the plurality of contact faces are faces perpendicular to the rotary shaft in the axial direction of the press-in target portion of the drive transmitting body and are disposed symmetrical about a line perpendicular to the flat face.

12. The drive transmitting device according to claim 1, further comprising:

a cam configured to receive the driving force to move a moving body against a biasing force from a biasing body.

13. The drive transmitting device according to claim 12, further comprising:

a drive side coupling configured to receive the driving force from the drive source;

a driven side coupling configured to engage with the drive side coupling; and a torque limiter configured to couple the drive side coupling and the driven side coupling during driving.

14. The drive transmitting device according to claim 12, wherein the moving body includes a pressure roller to press a fixing roller.

15. The drive transmitting device according to claim 1, further comprising:

at least one spur gear.

16. The drive transmitting device according to claim 1, further comprising:

a plurality of pulleys; and a belt wound around the plurality of pulleys, wherein one of the plurality of pulleys is mounted on a shaft of a driving body to which the driving force is transmitted from the drive source via the belt, the rotary shaft includes the shaft of the driving body, and the drive transmitting body includes a pulley of the plurality of pulleys, and the pulley of the plurality of pulleys is mounted on the shaft of the driving body.

17. The drive transmitting device according to claim 16, wherein the driving body includes a sheet ejecting roller.

18. An image forming apparatus comprising:

the drive transmitting device according to claim 1.

* * * * *